US007374272B2

(12) United States Patent
Seshimo et al.

(10) Patent No.: US 7,374,272 B2
(45) Date of Patent: May 20, 2008

(54) LIQUID EJECTING APPARATUS

(75) Inventors: Tatsuya Seshimo, Nagano-Ken (JP); Mitsutaka Iwasaki, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 414 days.

(21) Appl. No.: 11/154,728

(22) Filed: Jun. 17, 2005

(65) Prior Publication Data

US 2005/0275682 A1 Dec. 15, 2005

Related U.S. Application Data

(63) Continuation-in-part of application No. 10/813,623, filed on Mar. 31, 2004, now abandoned.

(30) Foreign Application Priority Data

Mar. 31, 2003 (JP) ..... 2003-096042
Mar. 15, 2004 (JP) ..... 2004-073351
Jun. 18, 2004 (JP) ..... 2004-181565

(51) Int. Cl.
*B41J 2/165* (2006.01)

(52) U.S. Cl. ..... 347/23; 347/29; 347/30; 347/32

(58) Field of Classification Search ..... 347/23, 347/29, 30, 32, 33, 35
See application file for complete search history.

(56) References Cited

U.S. PATENT DOCUMENTS 5,466,131 A 11/1995 Altham et al.
5,917,515 A 6/1999 Nonoyama et al.
2001/0017637 A1 8/2001 Yoshida et al.

FOREIGN PATENT DOCUMENTS

| | | |
|---|---|---|
| EP | 0 540 344 A2 | 5/1993 |
| EP | 0 865 924 A2 | 9/1998 |
| JP | 55-064178 A | 5/1980 |
| JP | 05-138893 A | 6/1993 |
| JP | 06-071897 A | 3/1994 |
| JP | 6-328730 A | 11/1994 |
| JP | 06-328730 A | 11/1994 |

*Primary Examiner*—Shih-wen Hsieh
(74) *Attorney, Agent, or Firm*—Sughrue Mion, PLLC

(57) ABSTRACT

A liquid ejecting apparatus includes: a head member having a nozzle and a liquid-ejecting unit; a main controlling part that drives the liquid-ejecting unit based on ejecting data; a capping member relatively movable between a position away from the head member and a position in contact with the head member; a suction way communicated with an inside of the capping member; and a built-in slide-rotator type of positive displacement pump provided in the suction way. A state-quantity recognizing part recognizes a state quantity related to a dry state in an inside of the positive displacement pump. A judging part judges whether the inside of the positive displacement pump is dry, by comparing the state quantity with a standard state quantity. A preliminary-operation carrying-out part carries out a preliminary operation for wetting the inside of the positive displacement pump, when the inside of the positive displacement pump is dry.

49 Claims, 31 Drawing Sheets

LIQUID EJECTING APPARATUS

This is a Continuation-In-Part of application Ser. No. 10/813,623 filed Mar. 31, 2004, now abandoned entitled "LIQUID EJECTING APPARATUS". The entire disclosure of the prior application, application Ser. No. 10/813,623 is hereby incorporated by reference.

FIELD OF THE INVENTION

This invention relates to a liquid ejecting apparatus having a head member capable of ejecting a drop of liquid from a nozzle.

BACKGROUND OF THE INVENTION

Generally, an ink-jetting recording apparatus, which is an example of liquid ejecting apparatus, includes a recording head having a nozzle, an ink-jetting means for ejecting ink from the nozzles (for example, a piezoelectric vibrating member or a heat-generating member), and a main controlling part that controls the ink-jetting means based on recording data.

The nozzle of the recording head may be clogged with thickened ink. In order to prevent clogging of the nozzle with the thickened ink, the thickened ink may be forcibly sucked from the nozzle.

Tube pumps are commonly used for forcibly sucking the thickened ink. In a tube pump, a tube is collapsed by a pulley, and then returns to an original shape of the tube due to rigidity thereof. The latter volume change provides a suction power.

However, the rigidity of the tube may change depending on temperature change or the like, so that suction speed may also change undesirably. In addition, in order to increase a volume of sucked ink, it is effective to raise a rotation speed of the pulley. However, there is no effect if the pulley is rotated at a speed faster than that at which the collapsed tube returns to the original shape. That is, the volume of sucked ink can not be increased greatly. In addition, if the diameter of the tune is increased, the volume of sucked ink may be increased. However, in that case, the thickness of the tube has to be increased in order to maintain the rigidity of the tube, which results in the larger sucking system.

The inventor has paid attention to a built-in slide-rotator type of positive displacement pump, because it is easy to downsize and optimally design the built-in slide-rotator type of positive displacement pump depending on a driving rotational speed and/or a required flow rate.

However, in the built-in slide-rotator type of positive displacement pump, there is the following problem, that is, when the inside of the positive displacement pump comes to nearly a dry state due to a long disuse or the like, the seal tightness between the pump frame (casing) and the slide-rotator (gear or the like) may be weakened so that the suction power may be considerably reduced.

JP Laid-Open Publication No. 55-64178 discloses a technique wherein a wetting agent is injected from outside into between a seal ring and a seal plate before driving a gear pump (an example of built-in slide-rotator type of positive displacement pump), when a kind of heated liquid is conveyed by the gear pump.

However, it is necessary to inject the wetting agent into the built-in slide-rotator type of positive displacement pump only when the inside comes to nearly a dry state. That is, if the wetting agent is injected in the built-in slide-rotator type of positive displacement pump always before driving the positive displacement pump, the wetting agent may be wasted in surplus. This is not preferable.

SUMMARY OF THE INVENTION

The object of this invention is to solve the above problems, that is, to provide a liquid ejecting apparatus including a built-in slide-rotator type of positive displacement pump wherein the inside of the positive displacement pump can be efficiently returned from a dry state to a wet state.

In this specification and claims, the "wet state" in the inside of the positive displacement pump means a state capable of providing a negative pressure equal to or greater than −5 kPa, preferably −15 kPa, by means of an operation of the positive displacement pump.

In order to achieve the object, the invention is a liquid ejecting apparatus comprising: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; a built-in slide-rotator type of positive displacement pump provided in the suction way; a state-quantity recognizing part that recognizes a state quantity related to a dry state in an inside of the built-in slide-rotator type of positive displacement pump; a standard-state-quantity setting part in which a standard state quantity is set, the standard state quantity being a standard for carrying out a preliminary operation for wetting the inside of the positive displacement pump; a judging part that judges whether the inside of the positive displacement pump is dry or not, by comparing the state quantity recognized by the state-quantity recognizing part with the standard state quantity set in the standard-state-quantity setting part; and a preliminary-operation carrying-out part that carries out the preliminary operation for wetting the inside of the positive displacement pump, when it is judged by the judging part that the inside of the positive displacement pump is dry.

According to the above feature, since the preliminary operation for wetting the inside of the positive displacement pump is carried-out only when it is judged that the inside of the positive displacement pump is dry, the inside of the positive displacement pump can be efficiently returned from a dry state to a wet state.

Alternatively, the invention is a liquid ejecting apparatus comprising: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; a built-in slide-rotator type of positive displacement pump provided in the suction way; a state-quantity recognizing part that recognizes a state quantity related to a dry state in an inside of the built-in slide-rotator type of positive displacement pump; a standard-state-quantity setting part in which a standard state quantity is set, the standard state quantity being a standard for carrying out a preliminary operation for wetting the inside of the positive displacement pump; a judging part that judges whether the inside of the positive displacement pump is dry or not, by comparing the state quantity recognized by the state-quantity recognizing part with the standard state quantity set in the standard-state-quantity setting part; a displaying part that displays judge result by the judging part; an inputting part into which a preliminary-operation instruction is manually inputted; and a preliminary-operation carrying-out part that carries out the preliminary operation for wetting the inside of the positive displacement pump, based on the preliminary-operation instruction inputted into the inputting part.

According to the above feature, when it is judged that the inside of the positive displacement pump is dry, the judge result is displayed by the displaying unit, so that an operator (user) can estimate or notice a dry state in the inside of the positive displacement pump. This makes it possible to efficiently carry out the preliminary operation for wetting the inside of the positive displacement pump.

For example, the preliminary-operation carrying-out part is adapted to cause the liquid-ejecting unit to eject liquid from the nozzle into the capping member, and thereafter drive the built-in slide-rotator type of positive displacement pump for a predetermined preliminary-operation time.

In the case, by means of the liquid ejected by the liquid-ejecting unit, the built-in slide-rotator type of positive displacement pump is efficiently returned to a wet state. Thus, it is unnecessary to prepare a special wetting agent. In addition, it is unnecessary to provide another mechanism for introducing a wetting agent, that is, the structure is simpler.

Alternatively, the built-in slide-rotator type of positive displacement pump may have a pump frame connected to the suction way, and a wetting-agent supplying way for supplying a wetting agent may be connected to the pump frame. In the case, it is preferable that the preliminary-operation carrying-out part is adapted to supply the wetting agent into the pump frame via the wetting-agent supplying way. In the case, an optimum wetting agent can be supplied at an optimum flow rate.

For example, if a priming pump is provided in the wetting-agent supplying way, it is preferable that the preliminary-operation carrying-out part is adapted to supply the wetting agent into the pump frame by causing the priming pump to operate.

In addition, if the head member is integrated with a pushing member, and the pushing member is movable in a direction in such a manner that the pushing member can push the priming pump to cause the priming pump to operate, it is preferable that the preliminary-operation carrying-out part is adapted to supply the wetting agent into the pump frame by causing the priming pump to operate via the pushing member by moving the head member.

Alternatively, the invention is a liquid ejecting apparatus comprising: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; a built-in slide-rotator type of positive displacement pump provided in the suction way; a state-quantity recognizing part that recognizes a state quantity related to a dry state in an inside of the built-in slide-rotator type of positive displacement pump; a standard-state-quantity setting part in which a standard state quantity is set, the standard state quantity being a standard for carrying out a preliminary operation for wetting the inside of the positive displacement pump; a judging part that judges whether the inside of the positive displacement pump is dry or not, by comparing the state quantity recognized by the state-quantity recognizing part with the standard state quantity set in the standard-state-quantity setting part; and a displaying part that displays judge result by the judging part; wherein the built-in slide-rotator type of positive displacement pump has a pump frame connected to the suction way; a wetting-agent supplying way for supplying a wetting agent is connected to the pump frame; a priming pump is provided in the wetting-agent supplying way; and a manual inputting part for causing the priming pump to operate is connected to the priming pump.

According to the above feature, when it is judged that the inside of the positive displacement pump is dry, the judge result is displayed by the displaying unit, so that an operator (user) can estimate or notice a dry state in the inside of the positive displacement pump. This makes it possible to efficiently cause the priming pump to operate for wetting the inside of the positive displacement pump.

For example, the state quantity related to a dry state in an inside of the built-in slide-rotator type of positive displacement pump is a non-operating time of the positive displacement pump. In the case, the state-quantity recognizing part is a non-operating-time recognizing part that recognizes the non-operating time, the standard state quantity being a standard for carrying out a preliminary operation is a standard time being a standard for carrying out a preliminary operation., the standard-state-quantity setting part is a standard-time setting part in which the standard time is set, and the judging part is adapted to judge that the inside of the positive displacement pump is dry, when the non-operating time recognized by the non-operating-time recognizing part is equal to or longer than the standard time set in the standard-time setting part.

Alternatively, the state quantity related to a dry state in an inside of the built-in slide-rotator type of positive displacement pump may be a continuous open time of the capping member or an elapsed time in an OFF state of an electric power source.

Alternatively, the state quantity related to a dry state in an inside of the built-in slide-rotator type of positive displacement pump may be a state quantity related to an operating state of the positive displacement pump after the positive displacement pump has been driven for a predetermined time.

Specifically, for example, the state quantity related to an operating state of the positive displacement pump is a pressure in the capping member after the positive displacement pump has been driven for a predetermined time. If the pressure in the capping member after the positive displacement pump has been driven for a predetermined time doesn't reach a predetermined negative pressure, it can be estimated that the inside of the positive displacement pump is in a dry state. In the case, the state-quantity recognizing part is a pressure detecting part that recognizes the pressure in the capping member, the standard state quantity being a standard for carrying out a preliminary operation is a standard negative pressure being a standard for carrying out a preliminary operation, the standard-state-quantity setting part is a standard-negative-pressure setting part in which the standard negative pressure is set, and the judging part is adapted to judge that the inside of the positive displacement pump is dry, when the pressure in the capping member recognized by the pressure detecting part is equal to or above the standard negative pressure set in the standard-negative-pressure setting part. A film sensor or the like provided in a liquid way may be used as the pressure detecting part.

Alternatively, the state quantity related to an operating state of the positive displacement pump may be a state quantity related to a liquid flow after the positive displacement pump has been driven for a predetermined time. If an expected liquid flow isn't generated after the positive displacement pump has been driven for a predetermined time, it can be estimated that the inside of the positive displacement pump is in a dry state. The state quantity related to a liquid flow may be detected by a photon-interrupter provided in a liquid way, or an electrode provided in the capping member or the positive displacement pump, or the like. In addition, a liquid flow into the pump may be detected, by detecting change in a rotational load of a motor for driving the pump from an electrical current waveform of the motor.

Herein, the built-in slide-rotator type of positive displacement pump means any pump including: a casing member, at least one rotator consisting of one or more parts, and a power transfer device for rotating the rotator, wherein a pump action is achieved by volume change caused by rotation of the rotator in the casing member. For example, the built-in slide-rotator type of positive displacement pump may be any gear pump, any roots pump, any quimby screw pump, any vane pump, or the like.

In addition, the concept of the present invention can be also applied to cases using a reciprocating-mechanism type of positive displacement pump instead of the built-in slide-rotator type of positive displacement pump. That is, the invention is a liquid ejecting apparatus comprising: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; a reciprocating-mechanism type of positive displacement pump provided in the suction way; a state-quantity recognizing part that recognizes a state quantity related to a dry state in an inside of the reciprocating-mechanism type of positive displacement pump; a standard-state-quantity setting part in which a standard state quantity is set, the standard state quantity being a standard for carrying out a preliminary operation for wetting the inside of the positive displacement pump; a judging part that judges whether the inside of the positive displacement pump is dry or not, by comparing the state quantity recognized by the state-quantity recognizing part with the standard state quantity set in the standard-state-quantity setting part; and a preliminary-operation carrying-out part that carries out the preliminary operation for wetting the inside of the positive displacement pump, when it is judged by the judging part that the inside of the positive displacement pump is dry.

According to the above feature, since the preliminary operation for wetting the inside of the positive displacement pump is carried out only when it is judged that the inside of the positive displacement pump is dry, the inside of the positive displacement pump can be efficiently returned from a dry state to a wet state.

Alternatively, the invention is a liquid ejecting apparatus comprising: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; a reciprocating-mechanism type of positive displacement pump provided in the suction way; a state-quantity recognizing part that recognizes a state quantity related to a dry state in an inside of the reciprocating-mechanism type of positive displacement pump; a standard-state-quantity setting part in which a standard state quantity is set, the standard state quantity being a standard for carrying out a preliminary operation for wetting the inside of the positive displacement pump; a judging part that judges whether the inside of the positive displacement pump is dry or not, by comparing the state quantity recognized by the state-quantity recognizing part with the standard state quantity set in the standard-state-quantity setting part; a displaying part that displays judge result by the judging part; an inputting part into which a preliminary-operation instruction is manually inputted; and a preliminary-operation carrying-out part that carries out the preliminary operation for wetting the inside of the positive displacement pump, based on the preliminary-operation instruction inputted into the inputting part.

According to the above feature, when it is judged that the inside of the positive displacement pump is dry, the judge result is displayed by the displaying unit, so that an operator (user) can estimate or notice a dry state in the inside of the positive displacement pump. This makes it possible to efficiently carry out the preliminary operation for wetting the inside of the positive displacement pump.

For example, the preliminary-operation carrying-out part is adapted to cause the liquid-ejecting unit to eject liquid from the nozzle into the capping member, and thereafter drive the reciprocating-mechanism type of positive displacement pump for a predetermined preliminary-operation time.

In the case, by means of the liquid ejected by the liquid-ejecting unit, the reciprocating-mechanism type of positive displacement pump is efficiently returned to a wet state. Thus, it is unnecessary to prepare a special wetting agent. In addition, it is unnecessary to provide another mechanism for introducing a wetting agent, that is, the structure is simpler.

Alternatively, the reciprocating-mechanism type of positive displacement pump may have a pump frame connected to the suction way, and a wetting-agent supplying way for supplying a wetting agent may be connected to the pump frame. In the case, it is preferable that the preliminary-operation carrying-out part is adapted to supply the wetting agent into the pump frame via the wetting-agent supplying way. In the case, an optimum wetting agent can be supplied at an optimum flow rate.

For example, if a priming pump is provided in the wetting-agent supplying way, it is preferable that the preliminary-operation carrying-out part is adapted to supply the wetting agent into the pump frame by causing the priming pump to operate.

In addition, if the head member is integrated with a pushing member, and the pushing member is movable in a direction in such a manner that the pushing member can push the priming pump to cause the priming pump to operate, it is preferable that the preliminary-operation carrying-out part is adapted to supply the wetting agent into the pump frame by causing the priming pump to operate via the pushing member by moving the head member.

Alternatively, the invention is a liquid ejecting apparatus comprising: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; a reciprocating-mechanism type of positive displacement pump provided in the suction way; a state-quantity recognizing part that recognizes a state quantity related to a dry state in an inside of the reciprocating-mechanism type of positive displacement pump; a standard-state-quantity setting part in which a standard state quantity is set, the standard state quantity being a standard for carrying out a preliminary operation for wetting the inside of the positive displacement pump; a judging part that judges whether the inside of the positive displacement pump is dry or not, by comparing the state quantity recognized by the state-quantity recognizing part with the standard state quantity set in the standard-state-quantity setting part; and a displaying part that displays judge result by the judging part; wherein the reciprocating-mechanism type of positive displacement pump has a pump frame connected to the suction way; a wetting-agent supplying way for supplying a wetting agent is connected to the pump frame; a priming pump is provided in the wetting-agent supplying way; and a manual inputting part for causing the priming pump to operate is connected to the priming pump.

According to the above feature, when it is judged that the inside of the positive displacement pump is dry, the judge result is displayed by the displaying unit, so that an operator (user) can estimate or notice a dry state in the inside of the positive displacement pump. This makes it possible to efficiently cause the priming pump to operate for wetting the inside of the positive displacement pump.

For example, the state quantity related to a dry state in an inside of the reciprocating-mechanism type of positive displacement pump is a non-operating time of the positive displacement pump. Alternatively, the state quantity related to a dry state in an inside of the reciprocating-mechanism type of positive displacement pump may be a continuous open time of the capping member or an elapsed time in an OFF state of an electric power source.

Alternatively, the state quantity related to a dry state in an inside of the reciprocating-mechanism type of positive displacement pump may be a state quantity related to an operating state of the positive displacement pump after the positive displacement pump has been driven for a predetermined time.

The reciprocating-mechanism type of positive displacement pump may be any piston pump, any bellows pump, any diaphragm pump, or the like.

Alternatively, the invention is a controlling unit for controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a built-in slide-rotator type of positive displacement pump provided in the suction way; the controlling unit comprising a state-quantity recognizing part that recognizes a state quantity related to a dry state in an inside of the built-in slide-rotator type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

Alternatively, the invention is a controlling unit for controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a reciprocating-mechanism type of positive displacement pump provided in the suction way; the controlling unit comprising a state-quantity recognizing part that recognizes a state quantity related to a dry state in an inside of the reciprocating-mechanism type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

A computer system can materialize the controlling units or any element of the above controlling units.

This invention includes a storage unit capable of being read by a computer, storing a program for materializing the controlling unit or the element in a computer system.

This invention also includes the program itself for materializing the controlling unit or the element in the computer system.

This invention includes a storage unit capable of being read by a computer, storing a program including a command for controlling a second program executed by a computer system including a computer, the program being executed by the computer system to control the second program to materialize the controlling unit or the element.

This invention also includes the program itself including the command for controlling the second program executed by the computer system including the computer, the program being executed by the computer system to control the second program to materialize the controlling unit.

The storage unit may be not only a substantial object such as a floppy disk or the like, but also a network for transmitting various signals.

In addition, the invention is a method of controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a built-in slide-rotator type of positive displacement pump provided in the suction way; the method comprising a step of recognizing a state quantity related to a dry state in an inside of the built-in slide-rotator type of positive displacement pump, a step of judging whether the inside of the positive displacement pump is dry or not, by comparing the state quantity related to a dry state in an inside of the built-in slide-rotator type of positive displacement pump with a standard state quantity that has been set in advance, and a step of carrying out a preliminary operation for wetting the inside of the positive displacement pump, when it is judged that the inside of the positive displacement pump is dry.

Alternatively, the invention is a method of controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a reciprocating-mechanism type of positive displacement pump provided in the suction way; the method comprising a step of recognizing a state quantity related to a dry state in an inside of the reciprocating-mechanism type of positive displacement pump, a step of judging whether the inside of the positive displacement pump is dry or not, by comparing the state quantity related to a dry state in an inside of the reciprocating-mechanism type of positive displacement pump with a standard state quantity that has been set in advance, and a step of carrying out a preliminary operation for wetting the inside of the positive displacement pump, when it is judged that the inside of the positive displacement pump is dry.

Alternatively, the invention is a liquid ejecting apparatus comprising: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; a built-in slide-rotator type of positive displacement pump provided in the suction way; and a preliminary-operation carrying-out mechanism that automatically carries out a preliminary operation for wetting an inside of the positive displacement pump, in connection with a driving start of the positive displacement pump, when the capping member is located at the position in contact with the head member.

According to the above feature, the preliminary-operation carrying-out mechanism can automatically carry out a preliminary operation for wetting an inside of the built-in slide-rotator type of positive displacement pump. Thus, the inside of the built-in slide-rotator type of positive displacement pump can be always in a wet state.

Preferably, the built-in slide-rotator type of positive displacement pump has a pump frame connected to the suction way, a wetting-agent storing part for storing a wetting agent temporarily is formed in the pump frame, and the preliminary-operation carrying-out mechanism is adapted to supply the wetting agent stored in the wetting-agent storing part into the pump frame, in connection with a driving start of the positive displacement pump, when the capping member is located at the position in contact with the head member.

In the case, the wetting agent can be immediately supplied from the wetting-agent storing part of the pump frame into the pump frame. Thus, the inside of the built-in slide-rotator type of positive displacement pump can be immediately brought to a wet state. Thus, precision of operational control of the built-in slide-rotator type of positive displacement pump can be improved.

More preferably, portion of a defining wall forming the wetting-agent storing part is elastically deformable, and the preliminary-operation carrying-out mechanism is adapted to supply the wetting agent stored in the wetting-agent storing part into the pump frame by elastic deformation of the portion of a defining wall.

In the case, the structure is simple and can be miniaturized.

In the case, more preferably, the wetting-agent storing part is communicated with the suction way, the wetting agent is the same as the liquid ejected from the nozzle, and the portion of a defining wall is adapted to be elastically deformed by a negative pressure in the wetting-agent storing part, which is generated in connection with a driving start of the positive displacement pump when the capping member is located at the position in contact with the head member.

In the case, the elastic deformation can be generated automatically. Thus, no additional apparatus is required, the structure is simple, and the structure can be miniaturized much more.

In the case, more preferably, elasticity of the portion of a defining wall is adjusted in such a manner that the portion is elastically deformed by a negative pressure in the wetting-agent storing part, which is generated in connection with a driving start of the positive displacement pump when the capping member is located at the position in contact with the head member, and that the portion is not deformed by another negative pressure in the wetting-agent storing part, which is generated in connection with a driving start of the positive displacement pump when the capping member is located at the position away from the head member.

In the case, a no-load suction operation can be carried out.

BEST MODE FOR CARRYING OUT THE INVENTION

Embodiments of the invention will now be described in more detail with reference to drawings.

Figure 1:
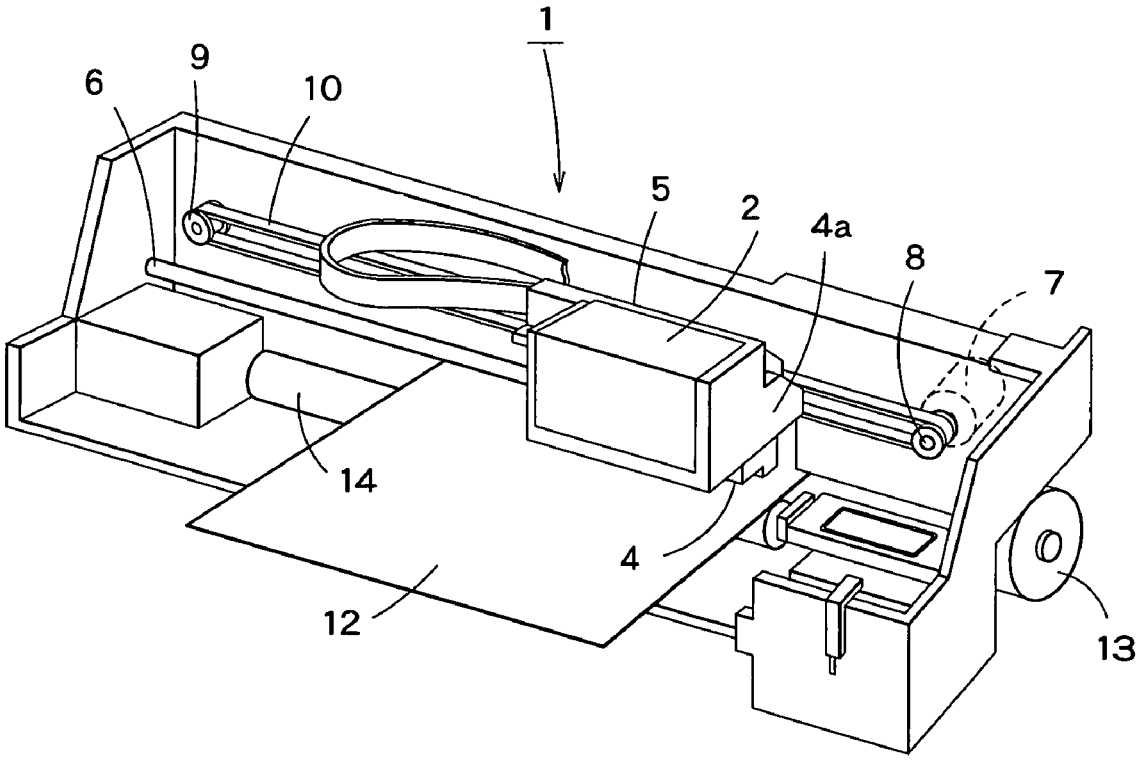
FIG. 1 is a schematic perspective view of an ink-jetting recording apparatus of a first embodiment according to the invention.

FIG. 1 is a schematic perspective view of an ink-jetting printer 1 as a liquid ejecting apparatus of a first embodiment according to the invention. The ink-jetting printer 1 includes a carriage 5 supporting a recording head 4 (head member) that has a cartridge holder 4*a* capable of holding an ink cartridge 2 (liquid container). The carriage 5 is adapted to be reciprocated in a main scanning direction by a head-scanning mechanism.

The head-scanning mechanism is formed by: a guide bar 6 horizontally extending in a housing, a pulse motor 7 arranged at a right portion of the housing, a driving pulley 8 connected to a rotational shaft of the pulse motor 7, a free pulley 9 mounted at a left portion of the housing, a timing belt 10 connected to the carriage 5 and going around the driving pulley 8 and the free pulley 9, and a controller 11 (see FIG. 6) for controlling the pulse motor 7. Thus, the carriage 5 i.e. the recording head 4 can be reciprocated in the main scanning direction i.e. in a width direction of a recording paper 12, by driving the pulse motor 7.

The printer 1 includes a paper feeding mechanism for feeding the recording paper 12 or any other recording medium (a medium onto which the ink (liquid) is jetted (ejected)) in a feeding direction (sub-scanning direction). The paper feeding mechanism consists of a paper feeding motor 13, a paper feeding roller 14 or the like. The recording paper 12, which is an example of a recording medium, is fed in a subordinate scanning direction in turn by the paper feeding mechanism, in cooperation with the recording operation of the recording head 4.

The printer 1 is adapted to conduct a recording operation when the recording head 4 is moved forth (single-direction recording).

Figure 2A:
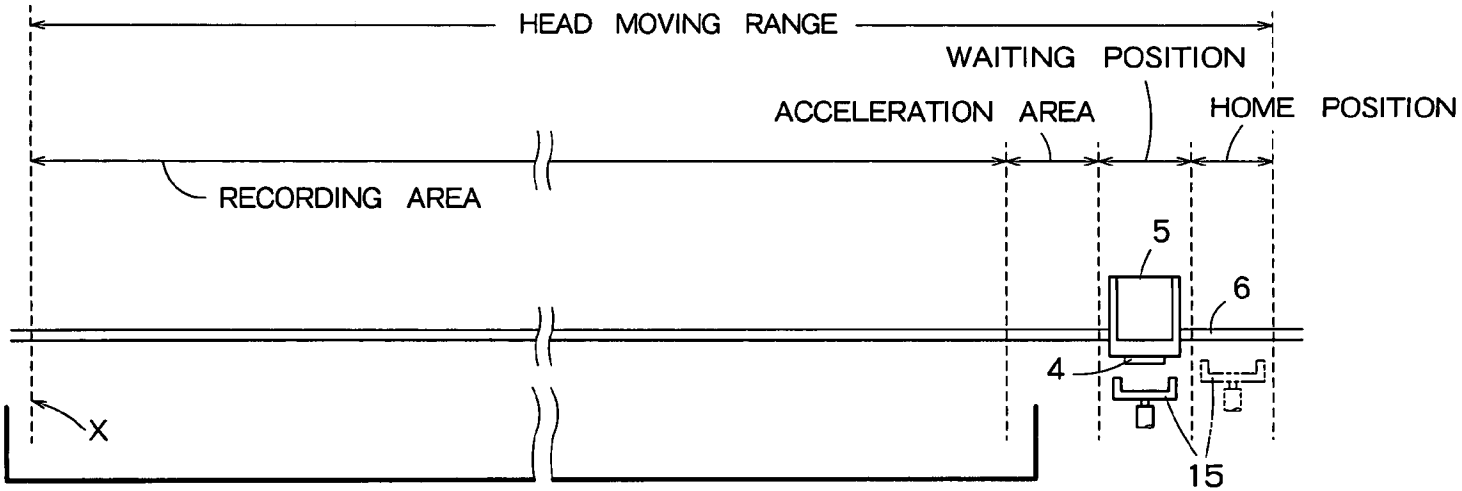
FIG. 2A is a schematic view for explaining a scanning range of a recording head when the ink-recording apparatus conducts a single-direction (one-way) printing.

A home position and a waiting position of the recording head 4 (carriage 5) are set in a scanning range of the carriage 5 and in an end area outside an objective recording area. As shown in FIG. 2A, the home position is set at an end portion (a right end portion in FIG. 2A) in the scanning range of the recording head-4. The waiting position is set substantially adjacently to the home position on a side of the objective recording area.

This invention can be applied to a printer that is adapted to conduct a recording operation when the recording head 4 is moved back as well when the recording head 4 is moved forth (double-direction recording). In such a printer, as shown in FIG. 2B, a second waiting position WP2 may be set at an opposite end portion with respect to a home position, in addition to a first waiting position WP1 substantially adjacent to the home position.

Figure 3A:
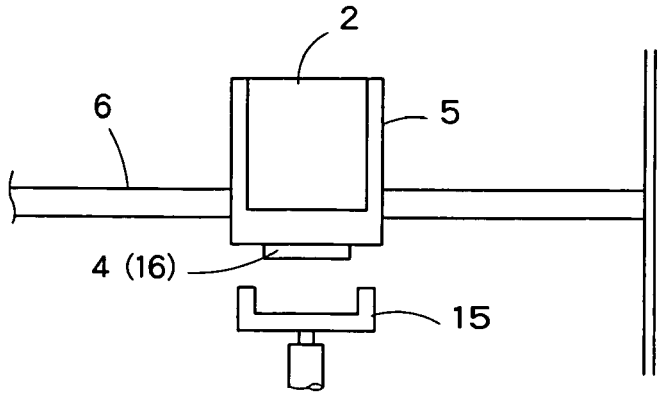
FIG. 3A is a schematic view for explaining a movement of the recording head, the recording head being located at a waiting position.
Figure 3B:
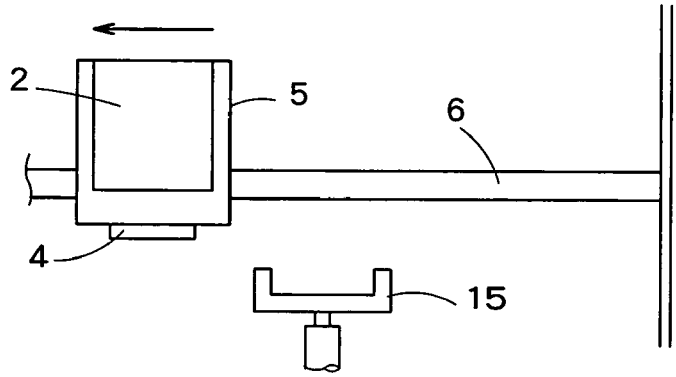
FIG. 3B is a schematic view for explaining the movement of the recording head, the recording head being moved from the waiting position to an objective recording area.
Figure 3C:
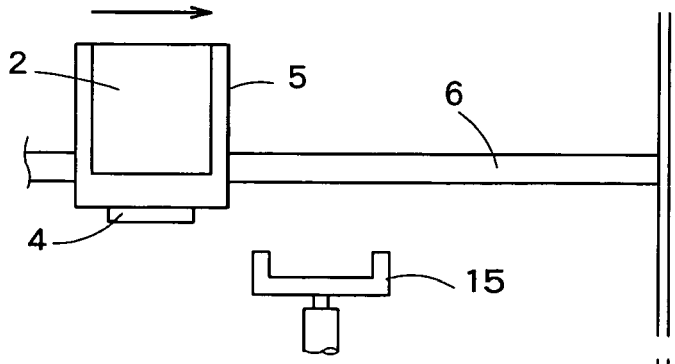
FIG. 3C is a schematic view for explaining the movement of the recording head, the recording head being moved back from the objective recording area to the waiting position.
Figure 3D:
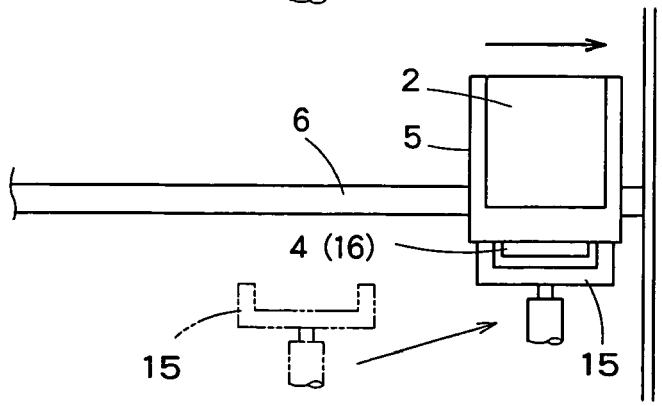
FIG. 3D is a schematic view for explaining the movement of the recording head, the recording head being located at a home position.

The home position is a position that the recording head 4 is moved to and stays at when electric power supply is off or when a long time has passed since the last recording operation. When the recording head 4 stays at the home position, as shown in FIG. 3D, a capping member 15 of the capping mechanism comes in contact with a nozzle plate 16 (see FIG. 6) and substantially seals nozzles 17 (see FIG. 6), which is described below in detail. The capping member 15 is a tray-like member having a substantially square shape, being open upward, and made of an elastic material such as a rubber. A moisture retaining material such as felt is attached inside the capping member 15. When the recording head 4 is sealed by the capping member 15, an inside of the capping member 15 is kept in high humid condition. Thus, it can be prevented that solvent of the ink evaporates from the nozzles 17.

The waiting position is a starting position for moving the recording head 4 in the main scanning direction. That is, normally, the recording head 4 stays and waits at the waiting position. When a recording operation is started, the recording head 4 is moved from the waiting position to the objective recording area. Then, when the recording operation is completed, the recording head 4 is moved back to the waiting position.

Figure 2B:
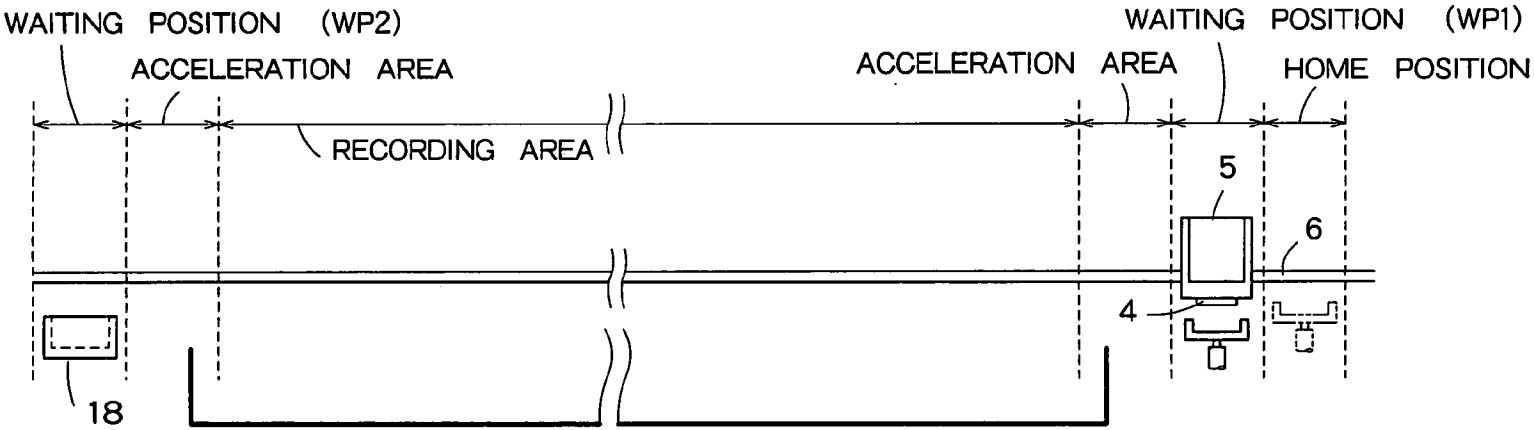
FIG. 2B is a schematic view for explaining a scanning range of a recording head when the ink-recording apparatus conducts a double-direction (forth and back) printing.

In a case of the printer for the double-direction recording, with reference to FIG. 2B, the recording head 4 is moved forth from the first waiting position WP1 to the second waiting position WP2 through the objective recording area, while jetting one or more drops of ink to the objective recording area. After that, the recording head 4 stays and waits at the second waiting position WP2. Then, the recording head 4 is moved back from the second waiting position WP2 to the first waiting position WP1 through the objective recording area, while jetting one or more drops of ink to the objective recording area. After that, the recording head 4 stays and waits at the first waiting position WP1. After that, the recording operation during moved forth and the recording operation during moved back are repeated in turn.

An ink-receiving member may be arranged under the waiting position in order to collect ink discharged from the recording head 4 because of flushing operations (maintenance operations). In the embodiment, the capping member 15 functions as such an ink-receiving member. That is, as shown in FIG. 3A, the capping member 15 is usually located at a position under the waiting position of the recording head 4 (a little apart from the nozzle plate 16). Then, when the recording head 4 is moved to the home position, as shown in FIG. 3D, the capping member 15 is also moved diagonally upward to the home position and to the nozzle plate 16 in order to seal the nozzles 17.

In the case of the printer for the double-direction recording, as shown in FIG. 2B, a second ink-receiving member 18 maybe arranged under the second waiting position WP2. The second ink-receiving member 18 maybe a flushing box open upward i.e. toward the recording head 4.

In addition, in the embodiment, an acceleration area is set between the waiting position and the objective recording area. The acceleration area is an area for raising a scanning velocity of the recording head 4 to a predetermined velocity.

Figure 4A:
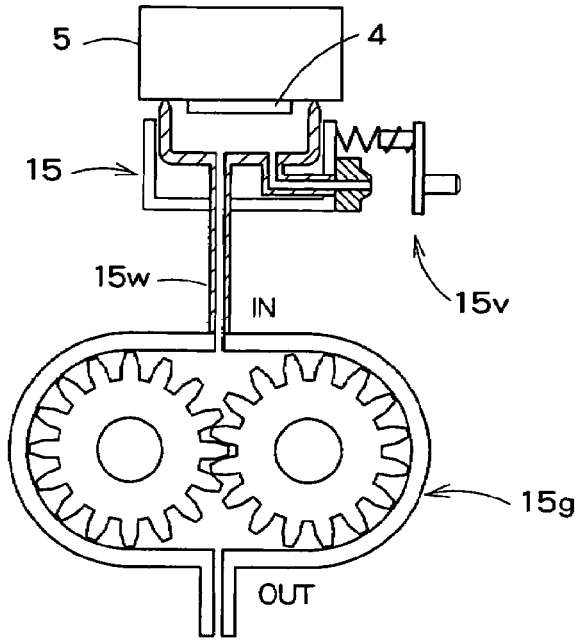
FIG. 4A is a schematic sectional view of a capping member in the embodiment wherein an opening valve is opened.

Herein, as shown in FIG. 4, a suction way 15*w* is extended from the capping member 15 of the embodiment. The suction way is communicated with the inside of the capping member 15. A gear pump 15*g*, which is a built-in slide-rotator type of positive displacement pump, is provided on the way of the suction way 15*w*. In the embodiment, the gear pump 15*g* is formed in such a precise manner that a gap between a gear and a pump frame (casing) is not more than 100 micron in both a radial direction and a thickness direction.

An example of structure of the gear pump 15*g* is explained in detail with reference to FIGS. 5A to 5C. FIG. 5A is a perspective view of the gear pump 15*g*, FIG. 5B is an exploded view of the gear pump 15*g*, and FIG. 5C is a partial sectional view of the gear pump 15.

Figure 5B:
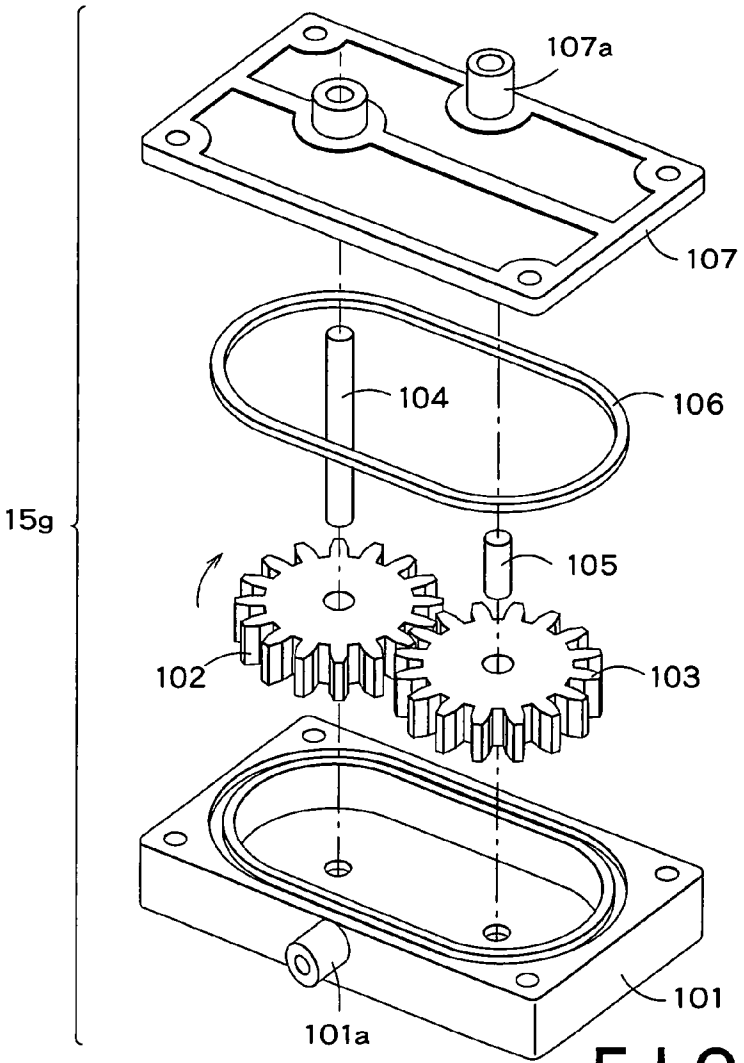
FIG. 5B is an exploded view of the gear pump.
Figure 5A:
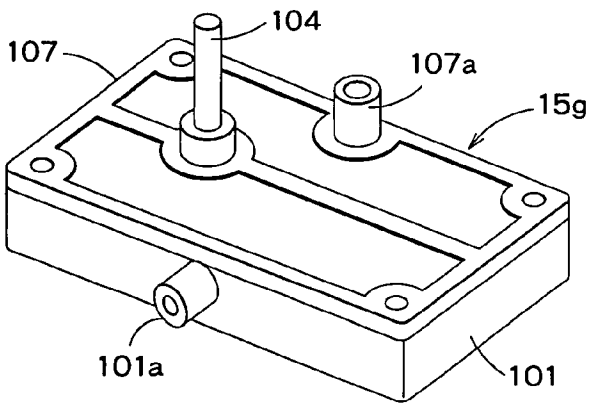
FIG. 5A is a perspective view of a gear pump in the embodiment.
Figure 5C:
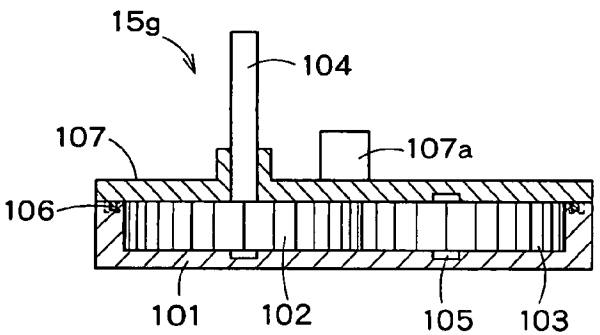
FIG. 5C is a partial sectional view of the gear pump.

As shown in FIGS. 5A to 5C, the gear pump 15*g* includes: a pump frame (casing) 151 having a suction port 151*a* connected to the suction way 15*w*; and a driving gear 152 and a driven gear 153 that are engaged with each other and slidably contained in the pump frame 151 with the above precision (via liquid (ink) menisci). The driving gear 152 is rotated by means of a driving gear shaft 154 that pierces the pump frame 151 and/or a lid 157. The driven gear 153 is pivotally supported by the pump frame 151 and the lid 157 via a driven gear shaft 155 that is parallel to the driving gear shaft 154. The pump frame (casing) 151 is sealed by the lid 157 via a packing 156. In the example, the lid 157 has a discharging port 157*a*. The suction port 151*a* and the discharging port 157*a* are located opposite with respect to a slide area between the gears 152, 153 and the pump frame 151.

When the driving gear 152 is rotated in a direction shown by an arrow in FIG. 5B by the driving gear shaft 154, the driven gear 153 engaged with the driving gear 152 is also rotated, so that the ink is conveyed from an IN area in the pump frame 151 (on the side of the suction port 151*a*) to an OUT area therein (on the side of the discharging port 157*a*) to achieve a pump function.

Figure 4B:
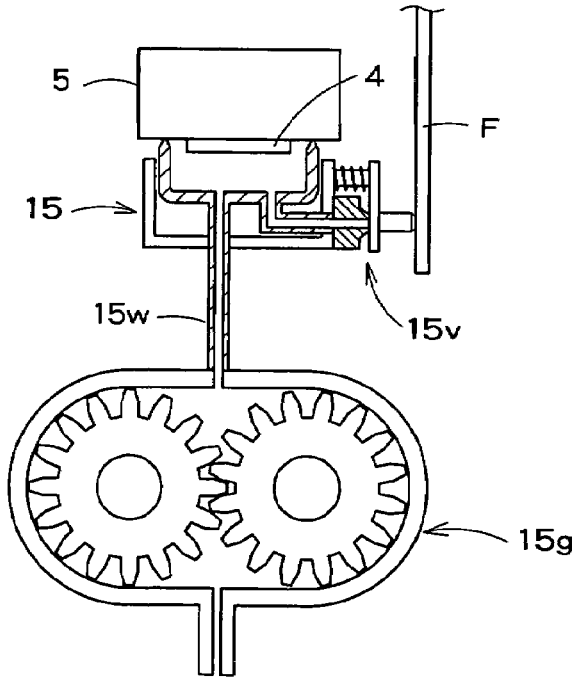
FIG. 4B is a schematic sectional view of the capping member in the embodiment wherein the opening valve is closed.

Herein, in the gear pump 15*g*, the seal at the engaging area and the casing area can not be released, even if the rotational direction of the gears is changed. That is, it is impossible for the In area and the OUT area to be communicated with each other to achieve an atmospheric release of the capping member 15. Therefore, the capping member 15 of the embodiment has a release-valve mechanism 15*v* that is normally open. The release-valve mechanism 15*v* has a small diameter. As shown in FIG. 4B, the release-valve mechanism 15*v* is adapted to close only when the capping member 15 comes in contact with a frame F or the like, correspondingly to when it is necessary to suck the ink.

Thus, the inside of the capping member 15 is normally communicated with the atmosphere, so that it is prevented the menisci are broken down by temperature change or the like, while the capping member 15 is suitably sealed when the ink has to be sucked.

Next, the inside mechanism of the recording head 4 is explained. The recording head 4 has: a black head unit capable of jetting a drop of black ink, a cyan head unit capable of jetting a drop of cyan ink, a magenta head unit capable of jetting a drop of magenta ink, a yellow head unit capable of jetting a drop of yellow ink, a light cyan head unit capable of jetting a drop of light cyan ink, and a light magenta head unit capable of jetting a drop of light magenta ink. Each head unit has a bottom surface on which the nozzles 17 are formed in the sub-scanning direction. The number of the nozzles 17 for each head unit is common, so that the nozzles 17 of the respective head units are also aligned in the main scanning direction.

Figure 6:
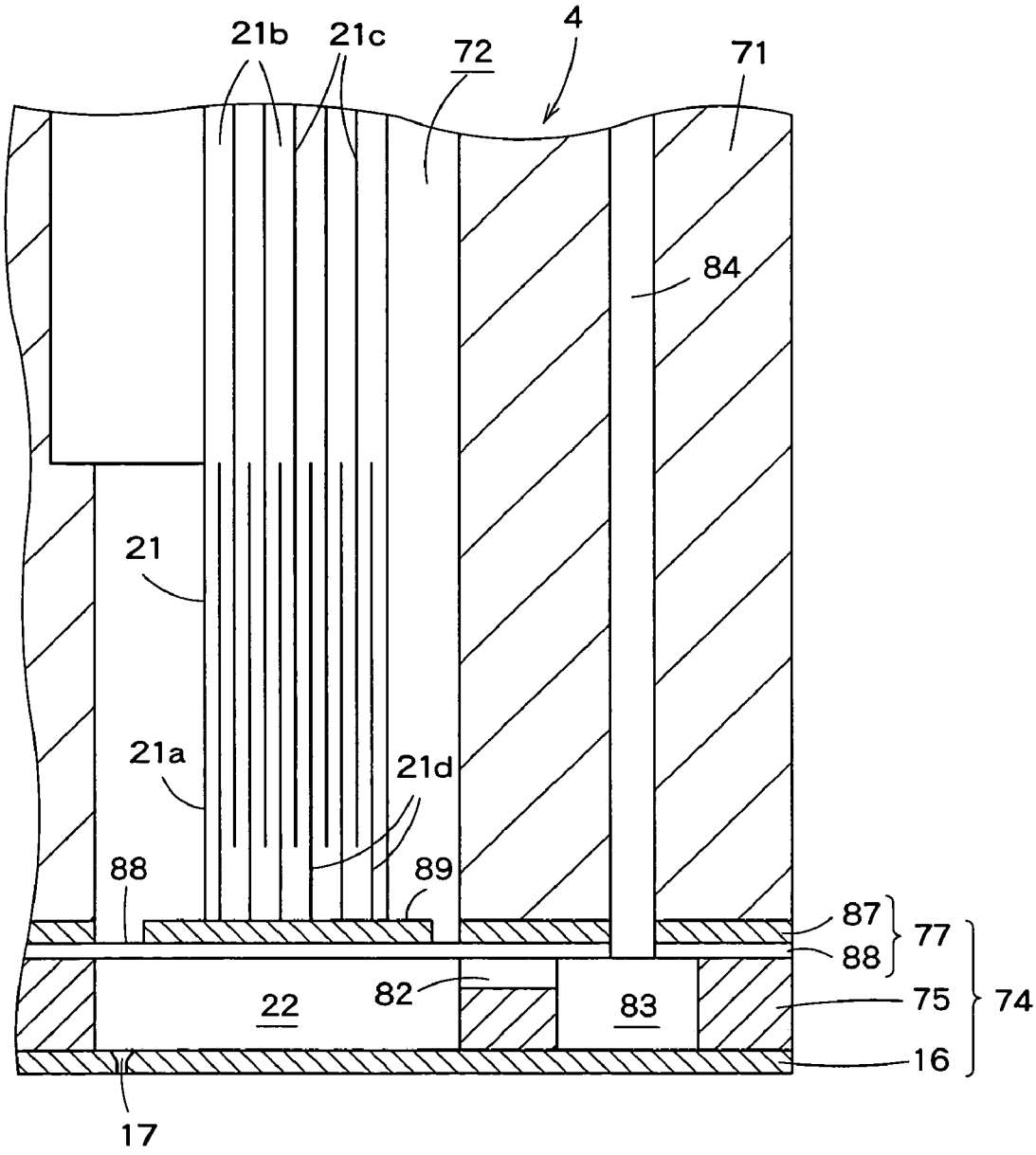
FIG. 6 is a sectional view of a head unit included in the recording head.

The head units in the embodiment have substantially the same structure. As shown in FIG. 6, the head unit has a plastic box-like case 71 defining a housing room 72. The longitudinal-mode piezoelectric vibrating unit 21 has a shape of teeth of a comb, and is inserted in the housing room 72 in such a manner that points of teeth-like portions 21*a* of the piezoelectric vibrating unit 21 are aligned at an opening of the housing room 72. A ink-way unit 74 is bonded on a surface of the case 71 on the side of the opening of the housing room 72. The points of the teeth-like portions 21*a* are fixed at predetermined positions of the ink-way unit 74 to function as piezoelectric vibrating members respectively.

The piezoelectric vibrating unit 21 comprises a plurality of piezoelectric layers 21*b*. As shown in FIG. 6, common inside electrodes 21*c* and individual inside electrodes 21*d* are inserted alternately between each adjacent two of the piezoelectric layers 21*b*. The piezoelectric layers 21*b*, the common inside electrodes 21*c* and the individual inside electrodes 21*d* are integrated and cut into the shape of the teeth of the comb. Thus, when a voltage is provided between the common inside electrodes 21*c* and an individual inside electrode 21*d*, a piezoelectric vibrating member contracts in a longitudinal direction of each of the piezoelectric layers 21*b*.

The ink-way unit 74 consists of a nozzle plate 16, an elastic plate 77 and an ink-way forming plate 75 sandwiched between the nozzle plate 16 and the elastic plate 77. The nozzle plate 16, the ink-way forming plate 75 and the elasticplate 77 are integrated as shown in FIG. 6.

A plurality of nozzles 17 is formed in the nozzle plate 16. A plurality of pressure generating chambers 22, a plurality of supplying ways 82 and a common chamber 83 are formed in the ink-way forming plate 75. Each of the pressure chambers 22 is defined by partition walls, and is communicated with a corresponding nozzle 17 at an end portion thereof and with a corresponding supplying way 82 at the other end portion thereof. The common chamber 83 is communicated with all the supplying ways 82, and has a longitudinal shape. For example, the longitudinal common chamber 83 may be formed by an etching process when the ink-way forming plate 75 is a silicon wafer. Then, the pressure chambers 22 are formed in the longitudinal direction of the common chamber 83 at the same intervals (pitches) as nozzles 17. Then, a groove as an supplying way 82 is formed between each of the pressure chambers 22 and the common chamber 83. In the case, the supplying way 82 is connected to an end of the pressure chamber 22, while the nozzle 17 is located near the other end of the pressure chamber 22. The common chamber 83 is adapted to supply ink saved in the ink cartridge 2 to the pressure chambers 22. An supplying tube 84 from the ink cartridge is communicated with a middle portion of the common chamber 83.

The elastic plate 77 is layered on a surface of the ink-way forming plate 75 opposed to the nozzle plate 16. In the case, the elastic plate 77 consists of two laminated layers that are a stainless plate 87 and an elastic high-polymer film 88 such as a PPS film. The stainless plate 87 is provided with island portions 89 for fixing the teeth-like portions 21*a* as the piezoelectric vibrating members 21 in respective portions corresponding to the pressure chambers 22, by an etching process.

In the above head unit, a tooth-like portion 21*a* as a piezoelectric vibrating member can expand in the longitudinal direction. Then, an island portion 89 is pressed toward the nozzle plate 16, the elastic film 88 is deformed. Thus, a corresponding pressure chamber 22 contracts. On the other hand, the tooth-like portion 21*a* as the piezoelectric vibrating member can contract from the expanding state in the longitudinal direction. Then, the elastic film 88 is returned to the original state owing to elasticity thereof. Thus, the corresponding pressure chamber 22 expands. By causing the pressure chamber 22 to expand and then causing the pressure chamber 22 to contract, a pressure of the ink in the pressure chamber 22 increases so that the ink drop is jetted from a nozzle 17.

That is, in the above head unit, when a tooth-like portion 2la as a piezoelectric vibrating member is charged or discharged, the volume of the corresponding pressure chamber 22 is also changed. Thus, by using the change of the volume of the pressure chamber 22, the pressure of the ink in the pressure chamber 22 can be changed, so that a drop of the ink can be jetted from the corresponding nozzle 17 or a meniscus at the corresponding nozzle 17 can be minutely vibrated. The meniscus means a free surface of the ink exposed at an opening of the nozzle 17.

Instead of the above longitudinal-mode piezoelectric vibrating unit 21, bending-mode piezoelectric vibrating members can be used. When a bending-mode piezoelectric vibrating member is used, a charging operation causes a pressure chamber to contract, and a discharging operation causes the pressure chamber to expand.

Figure 7:
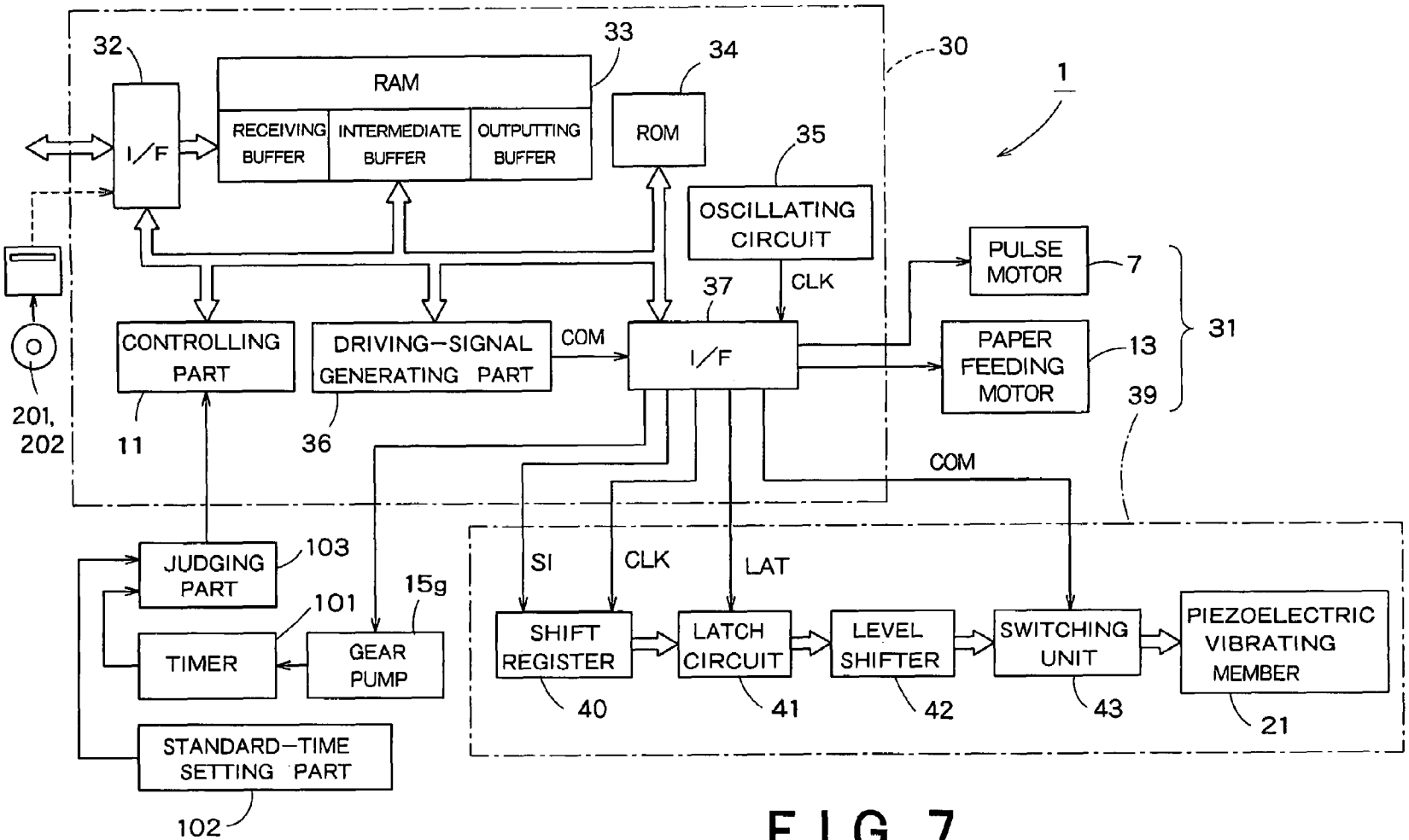
FIG. 7 is a schematic block diagram for explaining an electric structure of the ink-jetting recording apparatus of the embodiment.

Then, an electric structure of the printer 1 is explained. As shown in FIG. 7, the ink-jetting printer 1 has a printer controller 30 and a printing engine 31.

The printer controller 30 has: an outside interface (outside I/F) 32, a RAM 33 which is able to temporarily store various data, a ROM 34 which stores a controlling program or the like, a controlling part 11 including CPU or the like, an oscillating circuit 35 for generating a clock signal, an driving-signal generating part 36 for generating an driving signal that is supplied into each head unit of the recording head 4, and an inside interface (inside I/F) 37 that is adapted to send the driving signal, dot-pattern-data (bit-map-data) developed according to printing data (jetting data) or the like to the print engine 31.

The outside I/F 32 is adapted to receive printing data consisting of character codes, graphic functions, image data or the like from a host computer not shown or the like. In addition, a busy signal (BUSY) or an acknowledge signal (ACK) is adapted to be outputted to the host computer or the like through the outside I/F 32.

In addition, the outside I/F 32 in the embodiment is connected to an interface unit 100 such as a keyboard, which may function as an input part into which information of dense-thin desire of a user about a "fully-covering" control may be inputted by the user.

The RAM 33 has a receiving buffer, an intermediate buffer, an outputting buffer and a work memory not shown. The receiving buffer is adapted to receive the printing data through the outside I/F 32, and temporarily store the printing data. The intermediate buffer is adapted to store intermediate-code-data converted from the printing data by the controlling part 11. The outputting buffer is adapted to store dot-pattern-data which are data for printing obtained by decoding (translating) the intermediate-code-data (for example, level data).

The ROM 34 stores font data, graphic functions or the like in addition to the controlling program (controlling routine) for carrying out various data-processing operations. The ROM 34 also stores various setting data for maintenance operations.

The controlling part 11 is adapted to carry out various controlling operations according to the controlling program stored in the ROM 34. For example, the controlling part 11 reads out the printing data from the receiving buffer, converts the printing data into the intermediate-code-data, and causes the intermediate buffer to store the intermediate-code-data. Then, the controlling part 11 analyzes the intermediate-code-data in the intermediate buffer and develops (decodes) the intermediate-code-data into the dot-pattern-data with reference to the font data and the graphic functions or the like stored in the ROM 34. Then, the controlling part 11 carries out necessary decorating operations to the dot-pattern-data, and thereafter causes the outputting buffer to store the dot-pattern-data.

When the dot-pattern-data corresponding to one line recorded by one main scanning of the recording head 4 are obtained, the dot-pattern-data are outputted to an electric driving system 39 of each head unit of the recording head 4 from the outputting buffer through the inside I/F 37 in turn. Then, the carriage 5 is moved in the main scanning direction, that is, the recording operation for the one line is conducted. When the dot-pattern-data corresponding to the one line are outputted from the outputting buffer, the intermediate-code-data that has been developed are deleted from the intermediate buffer, and the next developing operation starts for the next intermediate-code-data.

In addition, the controlling part 11 is adapted to control a maintenance operation (a recovering operation) conducted separately from the recording operation by the recording head 4.

In addition, the controlling part 11 is also adapted to control a preliminary operation for wetting the inside of the gear pump 15*g*. That is, the controlling part 11 is connected to the gear pump 15*g* to function as a preliminary-operation carrying-out part.

For the preliminary-operation control of the gear pump 15*g* by the controlling part 11, there are provided a timer 101 (an example of non-operating-time recognizing part as a state-quantity recognizing part) that measures a non-operating time Tn of the gear pump 15*g*, a standard-time setting part 102 (an example of standard-state-quantity setting part) in which a standard time Ts (an example of standard state quantity) being a standard for carrying out the preliminary operation is set, and a judging part 103 that is adapted to judge that the inside of the gear pump 15*g* is dry, when the non-operating time Tn measured by the timer 101 is equal to or longer than the standard time Ts set in the standard-time setting part 102. Then, the controlling part 11 is adapted to carry out the preliminary operation for wetting the inside of the gear pump 15*g* when it is judged by the judging part 103 that the non-operating time Tn is equal to or longer than the standard time Ts, that is, when it is judged that the inside of the gear pump 15*g* is dry.

In the preliminary operation of the embodiment, a flushing operation of the ink is carried out from the recording head 4 to the capping member 15 in such a manner that a predetermined volume of the ink is ejected into the capping member 15, and then the gear pump 15*g* is caused to operate for a predetermined time.

The print engine 31 includes a paper feeding motor 13 as a paper feeding mechanism, a pulse motor 7 as a head scanning mechanism, and an electric driving system 39 of the recording head 4.

Then, the electric driving system 39 of the recording head 4 is explained. As shown in FIG. 7, the electric driving system 39 includes shift registers 40, latch circuits 41, level shifters 42 and switching units 43 and the piezoelectric vibrating members 21, which are electrically connected in the order. The shift registers 40 correspond to the respective nozzles 17, the latch circuits 41 correspond to the respective nozzles 17, the level shifters 42 correspond to the respective nozzles 17, and the switching units 43 correspond the respective nozzles 17, respectively. In addition, the piezoelectric vibrating members 21 also correspond to the respective nozzles 17 of the recording head 4, respectively.

In the electric driving system 39, when a selecting datum supplied to a switching unit 43 is "1", the switching unit 43 is closed (connected) and the driving signal is directly supplied to a corresponding piezoelectric vibrating member 21. Thus, the piezoelectric vibrating member 21 deforms according to the signal-waveform of the driving signal. On the other hand, when a selecting datum supplied to a switching unit 43 is "0", the switching unit 43 is opened (unconnected) and the driving signal is not supplied to a corresponding piezoelectric vibrating member 21.

As described above, based on the selecting data, the driving signal maybe selectively supplied to each piezoelectric vibrating member 21. Thus, dependently on given selecting data, a drop of the ink may be jetted from a nozzle 17 or a meniscus of ink may be caused to minutely vibrate.

Next, an operation of the printer 1 is explained.

Figure 8:
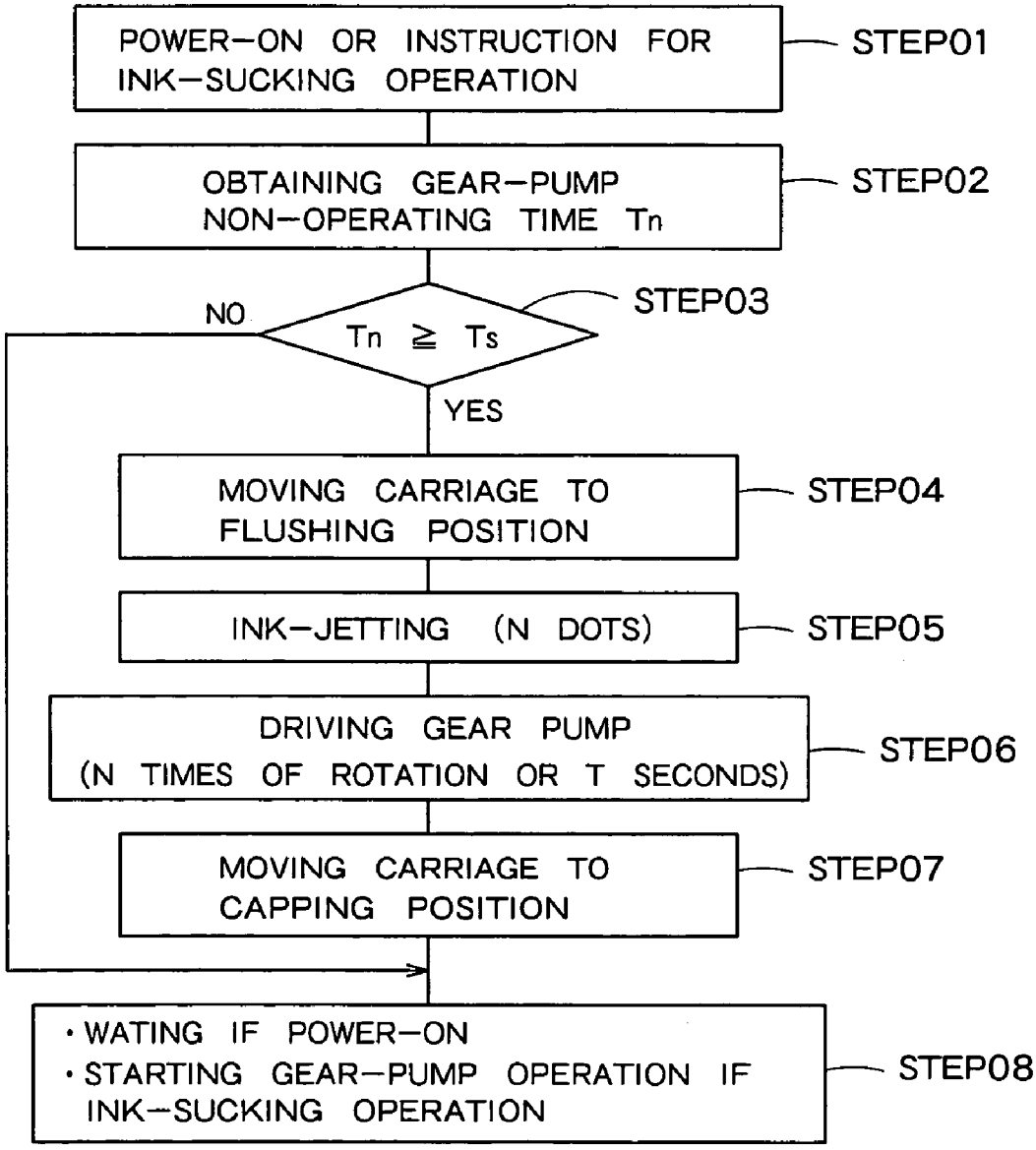
FIG. 8 is a flow chart showing a preliminary operation for the gear pump.

When electric power is supplied to the printer 1, a necessary initializing operation is conducted at first. In the embodiment, as shown in FIG. 8, as an initializing operation after the electric power has been supplied (STEP 01), a non-operating time Tn of the gear pump 15*g* is measured i.e. obtained by the timer 101 (STEP 02).

Then, the judging part 103 judges whether the obtained non-operating time Tn is equal to or longer than the standard time Ts set in the standard-time setting part 102 or not (STEP 03).

If the judge result is "No", it is estimated (judged) that a wet state in the inside of the gear pump 15*g* is maintained, so that the state remains as a waiting state (STEP 08).

On the other hand, if the judge result is "Yes", it is estimated (judged) that the inside of the gear pump 15*g* becomes dry to some extent, so that a preliminary operation is carried out by the controlling part 11. Specifically, via the control by the controlling part 11, the recording head 4 (the carriage 5) and the capping member 15 are moved to the flushing position (waiting position) (STEP 04). In that state, via the control by the controlling part 11, a predetermined volume of the ink, for example, N dots of the ink are jetted out by means of a flushing operation (STEP 05). Thus, the predetermined volume of the ink is ejected into the inside of the capping member 15. Then, the gear pump 15*g* is caused to operate n times of rotation or for t seconds (STEP 06). Thus, the ink ejected into the inside of the capping member 15 is conveyed into the inside of the gear pump 15*g*, so that the inside of the gear pump 15*g* is wetted, that is, returned to a wet state. Specifically, the gear pump 15*g* is returned to such a state that the gear pump 15*g* is able to provide a negative pressure greater than −5 kPa, preferably −15 kPa (The above n times of rotation or t seconds is set to satisfy this condition). Then, via the control by the controlling part 11, the recording head 4 (the carriage 5) and the capping member 15 are moved to the capping position (home position), and the recording head 4 is sealed by the capping member 15 (STEP 07). Then, the state remains as a waiting state (STEP 08).

After the initializing operation, when printing data corresponding to one line is outputted from the outputting buffer of the RAM 33, the recording head 4 conducts a maintenance operation (recovering operation) before a recording operation for the one line.

The maintenance operation is conducted for keeping ability of the recording head 4 to jet drops of the ink. The maintenance operation maybe suitably selected from an ink-sucking operation, a flushing operation, a minutely-vibrating operation, and so on.

If the ink-sucking operation is conducted, as shown in FIG. 4B, the release-valve mechanism 15*v* is closed by the frame F or the like to seal the inside of the capping member 15, and thereafter the gear pump 15*g* is caused to operate. Then, the ink is sucked from the nozzles 17 of the recording head 4 by the gear pump 15*g*. At that time, since the gear pump 15*g* is caused to operate when there is a wet state in the inside of the gear pump 15*g*, the ink-sucking action can be satisfactorily assured.

After the maintenance operation is conducted, the recording operation is conducted in the objective recording area based on the printing data. Specifically, while the recording head 4 is moved in the main scanning direction, drops of the ink can be jetted from the nozzles 17 at respective suitable timings.

If the electric power continues to be supplied to the printer 1 for a long time, the maintenance operation may be conducted under certain conditions. If the ink-sucking operation is conducted as the maintenance operation for a case wherein the electric power continues to be supplied to the printer 1 for a long time, before the ink-sucking operation is conducted, the preliminary operation for the gear pump 15*g* is carried out when necessary.

The flowchart of the preliminary operation in the case is substantially the same as that just after the electric power has started to be supplied to the printer 1 (see FIG. 7). That is, after the instruction for the ink-sucking operation has been confirmed (STEP 01), a non-operating time Tn of the gear pump 15*g* is measured i.e. obtained by the timer 101 (STEP 02).

Then, the judging part 103 judges whether the obtained non-operating time Tn is equal to or longer than the standard time Ts set in the standard-time setting part 102 or not (STEP 03).

If the judge result is "No", it is estimated (judged) that a wet state in the inside of the gear pump 15*g* is maintained, so that the ink-sucking operation starts to be carried out under that state (STEP 08).

On the other hand, if the judge result is "Yes", it is estimated that the inside of the gear pump 15*g* becomes dry to some extent, so that a preliminary operation is carried out by the controlling part 11. Specifically, via the control by the controlling part 11, the recording head 4 (the carriage 5) and the capping member 15 are moved to the flushing position (waiting position) (STEP 04). In that state, via the control by the controlling part 11, a predetermined volume of the ink, for example, N dots of the ink are jetted out by means of a flushing operation (STEP 05). Thus, the predetermined volume of the ink is ejected into the inside of the capping member 15. Then, the gear pump 15*g* is caused to operate n times of rotation or for t seconds (STEP 06). Thus, the ink ejected into the inside of the capping member 15 is conveyed into the inside of the gear pump 15*g*, so that the inside of the gear pump 15*g* is wetted, that is, returned to a wet state. Then, via the control by the controlling part 11, the recording head 4 (the carriage 5) and the capping member 15 are moved to the capping position (home position), and the recording head 4 is sealed by the capping member 15 (STEP 07). Thereafter, the ink-sucking operation starts to be carried out under that state (STEP 08).

As described above, according to the embodiment, the ink at the nozzles 17 can be sucked by the gear pump 15*g* that can be relatively easily designed optimally. On the other hand, the inside of the capping member 15 is communicated with the atmosphere via the release-valve mechanism 15*v* that is normally open, so that it is prevented that the menisci of the ink be broken down by air expansion/contraction caused by the temperature change or the like.

In addition, the preliminary operation for wetting the inside of the gear pump 15*g* is carried out only when the non-operating time Tn of the gear pump 15*g* is equal to or longer than the standard time Ts. Thus, the inside of the gear pump 15*g* is efficiently returned to the wet state from the dry state.

In addition, according to the embodiment, the inside of the gear pump 15*g* is wetted with the ink. Thus, it is unnecessary to prepare a special wetting agent. Therefore, it is unnecessary to provide any mechanism for introducing a wetting agent, that is, the structure is simpler.

Figure 9:
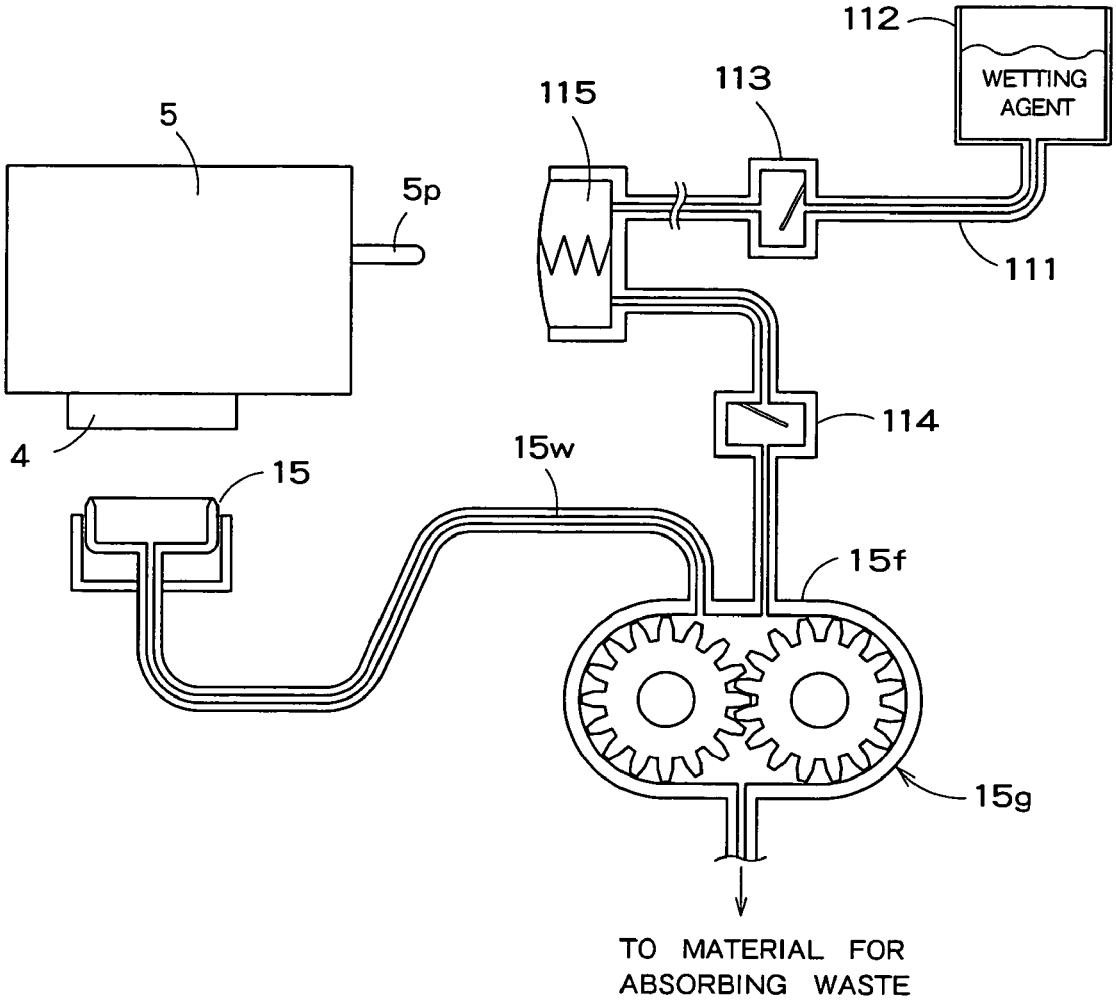
FIG. 9 is a schematic sectional view of a gear pump and periphery thereof in an ink-jetting recording apparatus of a second embodiment according to the invention.

Next, FIG. 9 is a schematic sectional view of a gear pump and periphery thereof in an ink-jetting recording apparatus of a second embodiment according to the invention.

As shown in FIG. 9, a wetting-agent tank 112 is connected to the pump frame 15*f* of the gear pump 15*g* on the side of the capping member 15, via a wetting-agent supplying way 111. An optimum wetting agent is selected for optimally wetting the inside of the gear pump 15*g*, and the wetting-agent tank 112 is filled with the selected wetting agent.

Two check valves 113, 114 are provided on the way of the wetting-agent supplying way 111. A priming pump 115 is provided between the two check valves. The priming pump 115 is adapted to operate when the priming pump 115 itself is pushed. When the priming pump 115 operates, the wetting agent is supplied from the wetting-agent tank 112 into the inside of the gear pump 15*g*.

In the embodiment, a pushing member 5*p* for pushing the priming pump 115 is formed on the carriage 5 integrated with the recording head 4. The pushing member 5*b* is adapted to push the priming pump 115 while the recording head 4 is moved in the main scanning direction, in order to cause the priming pump 115 to operate.

In addition, in the embodiment, the controlling part 11 is adapted not to cause the gear pump 15*g* to operate when the controlling part 11 functions as a preliminary-operation carrying-out part.

Other structure of the embodiment is substantially the same as the first embodiment explained with reference to FIGS. 1 to 8.

Figure 10A:
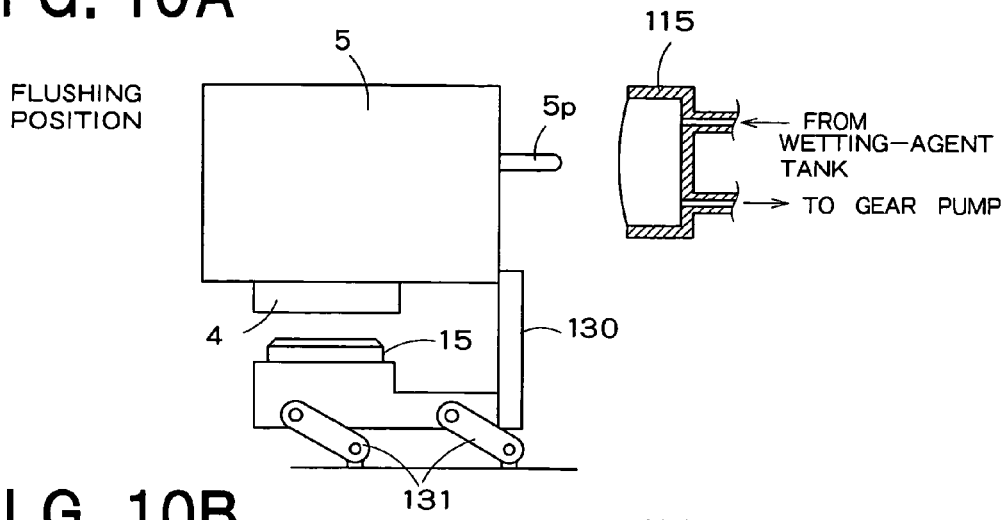
FIG. 10A is a schematic side view of a recording head, a capping member and a priming pump of the second embodiment wherein the recording head is located at a flushing position.
Figure 10B:
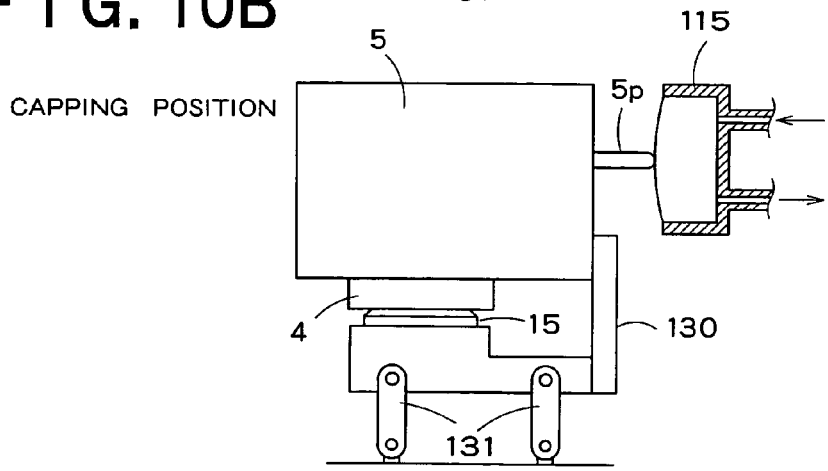
FIG. 10B is a schematic side view of the recording head, the capping member and the priming pump wherein the recording head is located at a capping position.
Figure 10C:
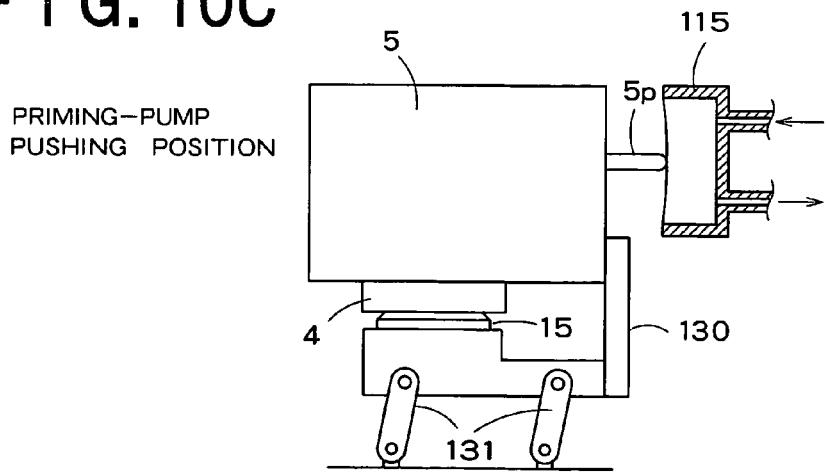
FIG. 10C is a schematic side view of a recording head, a capping member and a priming pump wherein the recording head is located at a priming-pump pushing position.

FIGS. 10A to 10C show an example of arrangement suited for the pushing member 5*p* to push the priming pump 115. In the example, a plate member 130 is provided to come in contact with the carriage 5, and the capping member 15 is movable while keeping a horizontal position via a parallel-linkage mechanism 131.

At the flushing position shown in FIG. 10A, the carriage 5 comes in contact with the plate member 130, but the pushing member 5*p* doesn't come in contact with the priming pump 115.

At the capping position shown in FIG. 10B, the carriage 5 pushes and moves the plate member 130 (and also slides vertically). Then, the capping member 15 is moved up by the parallel-linkage mechanism 131 to seal the recording head 4. At that time, the pushing member 5*p* comes in contact with the priming pump 115, but doesn't push the priming pump 115.

In order to cause the priming pump 115 to operate, as shown in FIG. 10C, the carriage 5 is further moved to the priming pump 115.

Herein, in order to effectively cause the priming pump 115 to operate, it is preferable to repeat the movement of the carriage 5 between the state shown in FIG. 10B and the state shown in FIG. 10C.

Next, an operation of the printer of the second embodiment is explained.

Figure 11:
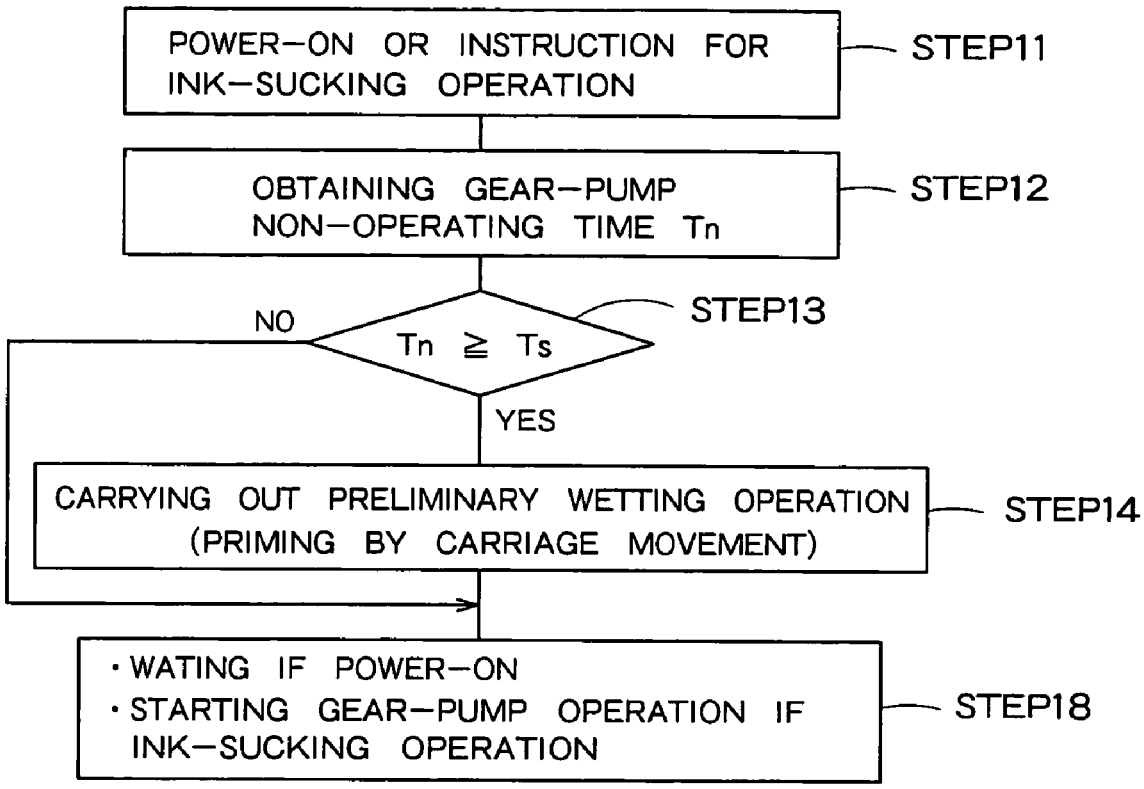
FIG. 11 is a flow chart showing a preliminary operation for a gear pump of the second embodiment.

When electric power is supplied to the printer, a necessary initializing operation is conducted at first. In the embodiment, as shown in FIG. 11, as an initializing operation after the electric power has been supplied (STEP 11), a non-operating time Tn of the gear pump 15*g* is measured i.e. obtained by the timer 101 (STEP 12).

Then, the judging part 103 judges whether the obtained non-operating time Tn is equal to or longer than the standard time Ts set in the standard-time setting part 102 or not (STEP 13).

If the judge result is "No", it is estimated (judged) that a wet state in the inside of the gear pump 15*g* is maintained, so that the state remains as a waiting state (STEP 18).

On the other hand, if the judge result is "Yes", it is estimated (judged) that the inside of the gear pump 15*g* becomes dry to some extent, so that a preliminary operation is carried out by the controlling part 11 (STEP 13). Specifically, via the control by the controlling part 11, the recording head 4 (the carriage 5) is moved to cause the priming pump 115 to operate via the pushing member 5*p*. Thus, the wetting agent is supplied from the wetting-agent tank 112 into the inside of the gear pump 15*g*, so that the inside of the gear pump 15*g* is wetted, that is, returned to a wet state. Then, the state remains as a waiting state (STEP 18).

After the initializing operation, when printing data corresponding to one line is outputted from the outputting buffer of the RAM 33, the recording head 4 conducts a maintenance operation (recovering operation) before a recording operation for the one line.

The maintenance operation is conducted for keeping ability of the recording head 4 to jet drops of the ink. The maintenance operation may be suitably selected from an ink-sucking operation, a flushing operation, a minutely-vibrating operation, and so on.

If the ink-sucking operation is conducted, as shown in FIG. 4B, the release-valve mechanism 15*v* is closed by the frame F or the like to seal the inside of the capping member 15, and thereafter the gear pump 15*g* is caused to operate. Then, the ink is sucked from the nozzles 17 of the recording head 4 by the gear pump 15*g*. At that time, since the gear pump 15*g* is caused to operate when there is a wet state in the inside of the gear pump 15*g*, the ink-sucking action can be satisfactorily assured.

After the maintenance operation is conducted, the recording operation is conducted in the objective recording area based on the printing data. Specifically, while the recording head 4 is moved in the main scanning direction, drops of the ink can be jetted from the nozzles 17 at respective suitable timings.

If the electric power continues to be supplied to the printer 1 for a long time, the maintenance operation may be conducted under certain conditions. If the ink-sucking operation is conducted as the maintenance operation for a case wherein the electric power continues to be supplied to the printer 1 for a long time, before the ink-sucking operation is conducted, the preliminary operation for the gear pump 15*g* is carried out when necessary.

The flowchart of the preliminary operation in the case is substantially the same as that just after the electric power has started to be supplied to the printer (see FIG. 10). Thus, the explanation is omitted.

According to the embodiment as well, the preliminary operation for wetting the inside of the gear pump 15*g* is carried out only when the non-operating time Tn of the gear pump 15*g* is equal to or longer than the standard time Ts. Thus, the inside of the gear pump 15*g* is efficiently returned to the wet state from the dry state.

In addition, according to the embodiment, the inside of the gear pump 15*g* is wetted with a special wetting agent, that is, an optimum wetting agent may be supplied at an optimum flow rate.

Herein, the manner of causing the priming pump to operate is not limited to the above one using the pushing member 5*p*, but also may be various other manners.

Figure 12:
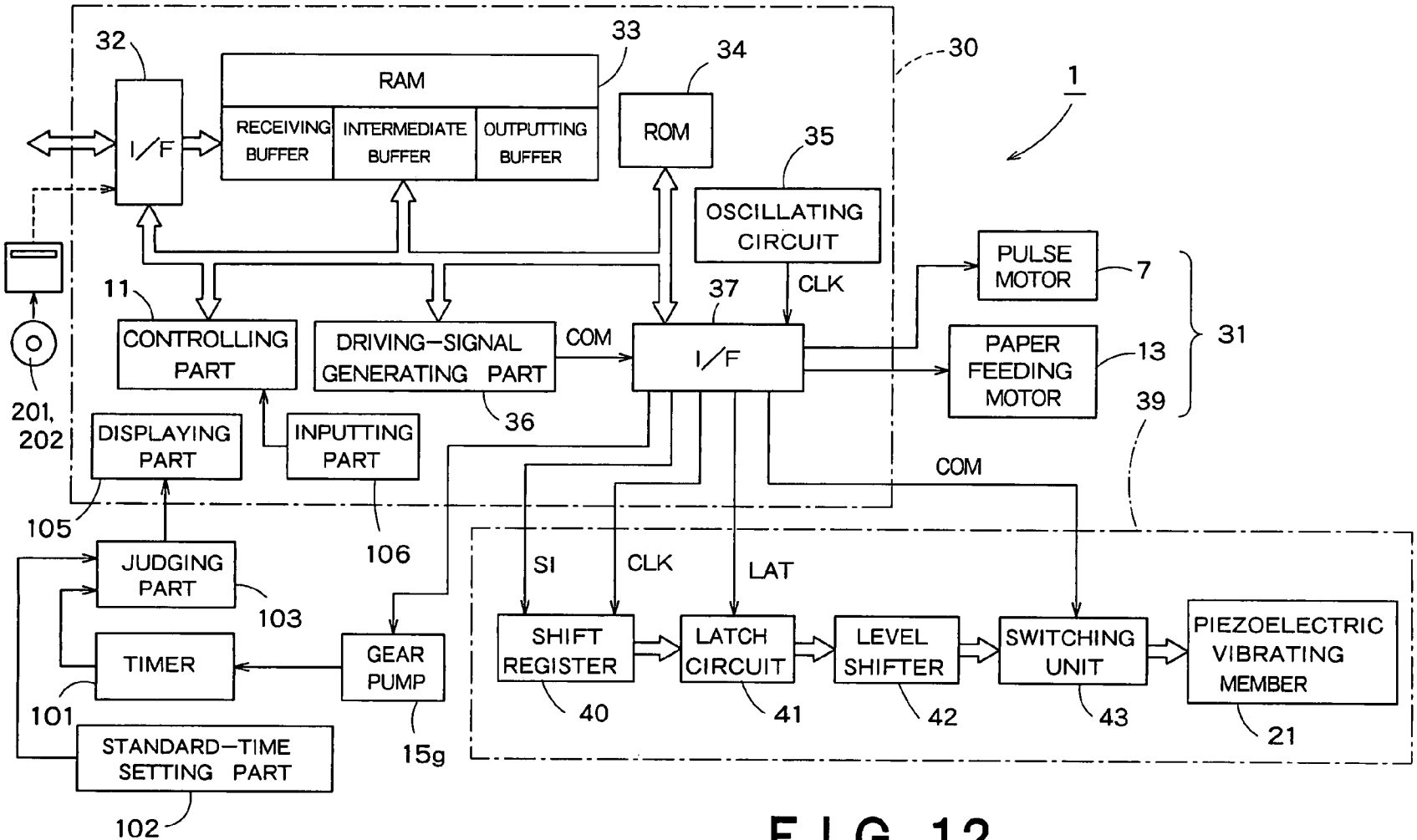
FIG. 12 is a schematic block diagram for explaining an electric structure of an ink-jetting recording apparatus of a third embodiment according to the invention.

Next, FIG. 12 is a schematic block diagram for explaining an electric structure of an ink-jetting recording apparatus of a third embodiment according to the invention. In the above embodiments, the controlling unit 11 is adapted to automatically function as a preliminary-operation carrying-out part based on the judge result by the judging part 103. However, in the third embodiment, the controlling part 11 is adapted to function as a preliminary-operation carrying-out part after an instruction is inputted by a user.

That is, in the embodiment, as shown in FIG. 12, there are provided a displaying part 105 that displays judge result by the judging part 103, and an inputting part 106 into which a preliminary-operation instruction is manually inputted. In addition, the controlling part 11 is adapted to carry out a preliminary operation for wetting the inside of the gear pump 15*g* based on the preliminary-operation instruction inputted into the inputting part 106.

Other structure of the embodiment is substantially the same as the first embodiment explained with reference to FIGS. 1 to 8.

According to the third embodiment, when the non-operating time Tn of the gear pump 15*g* is equal to or longer than the standard time Ts, this information is displayed by the displaying part 105. Then, the user can estimate that the inside of the gear pump 15*g* becomes dry to some extent. Thus, by the user inputting the preliminary-operation instruction into the inputting part 106, the preliminary operation for wetting the inside of the gear pump 15*g* can be carried out efficiently.

Figure 13:
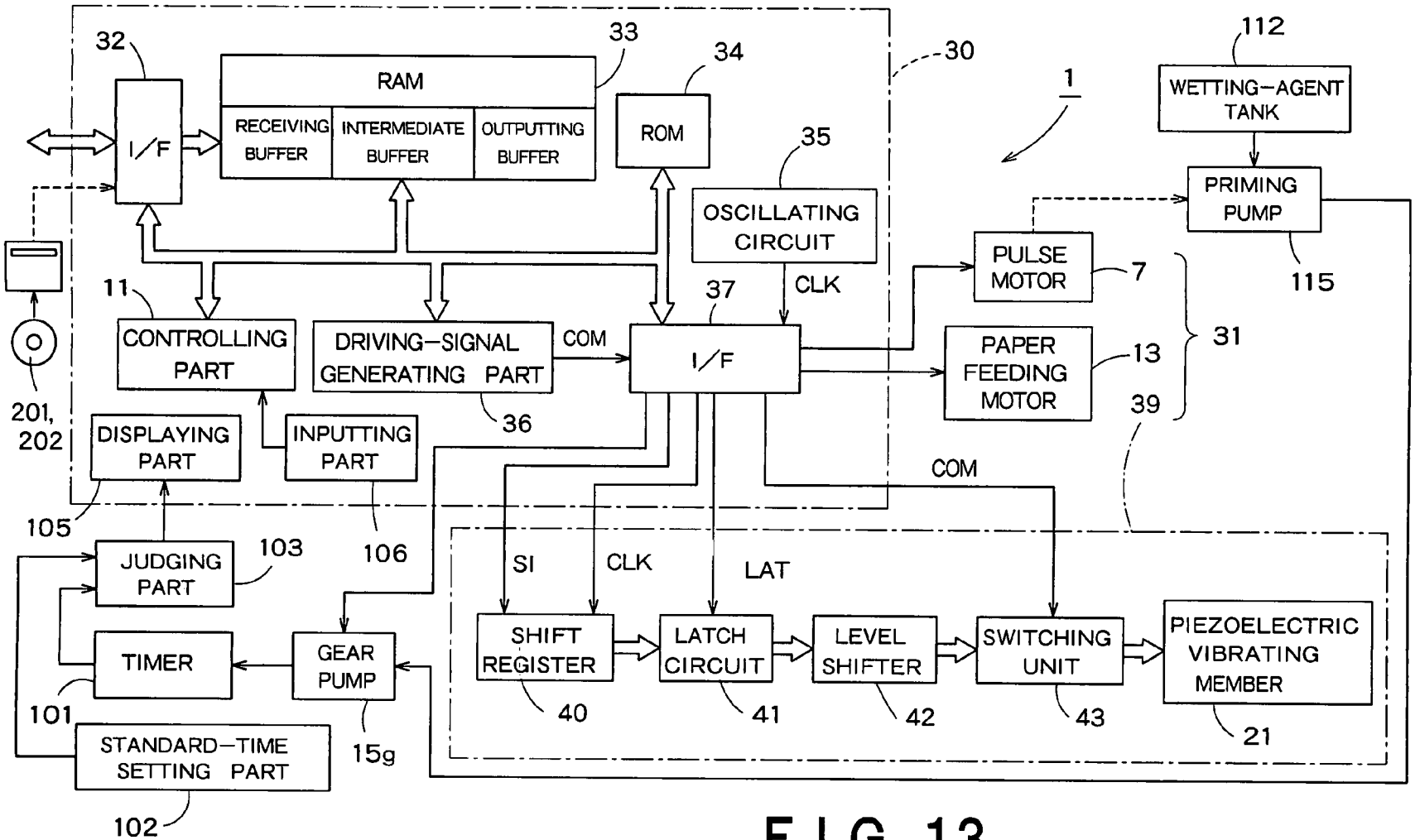
FIG. 13 is a schematic block diagram for explaining an electric structure of an ink-jetting recording apparatus of a fourth embodiment according to the invention.

Next, FIG. 13 is a schematic block diagram for explaining an electric structure of an ink-jetting recording apparatus of a fourth embodiment according to the invention. In the fourth embodiment too, the controlling part 11 is adapted to function as a preliminary-operation carrying-out part after an instruction is inputted by a user.

That is, in the embodiment, as shown in FIG. 13, there are provided a displaying part 105 that displays judge result by the judging part 103, and an inputting part 106 into which a preliminary-operation instruction is manually inputted. In addition, the controlling part 11 is adapted to carry out a preliminary operation for wetting the inside of the gear pump 15*g* based on the preliminary-operation instruction inputted into the inputting part 106.

Other structure of the embodiment is substantially the same as the second embodiment explained with reference to FIGS. 9 to 11.

According to the fourth embodiment too, when the non-operating time Tn of the gear pump 15*g* is equal to or longer than the standard time Ts, that information is displayed by the displaying part 105. Then, the user can estimate that the inside of the gear pump 15*g* becomes dry to some extent. Thus, by the user inputting the preliminary-operation instruction into the inputting part 106, the preliminary operation for wetting the inside of the gear pump 15*g* can be carried out efficiently.

If a manner not using the pushing member 5*b* is adopted as a manner of causing the priming pump 115 to operate, the priming pump 115 may be directly caused to operate by the preliminary-operation instruction.

In the above embodiments, the non-operating time Tn of the gear pump 15*g* is used as a state quantity related to the dry state in the inside of the gear pump 15*g*. However, a continuous open time of the capping member 15, an elapsed time in an OFF state of an electric power source, or the like may be used instead of the non-operating time Tn.

Alternatively, the state quantity related to the dry state in the inside of the gear pump 15*g* may be a state quantity related to an operating state of the gear pump 15 after the gear pump 15*g* has been driven for a predetermined time.

Specifically, for example, as a state quantity related to an operating state of the gear pump 15*g*, a pressure in the capping member 15 after the gear pump 15*g* has been driven for a predetermined time is used. If the pressure in the capping member 15 after the gear pump 15*g* has been driven for a predetermined time doesn't reach a predetermined negative pressure, it can be estimated that the inside of the gear pump 15*g* is in a dry state.

Figure 14:
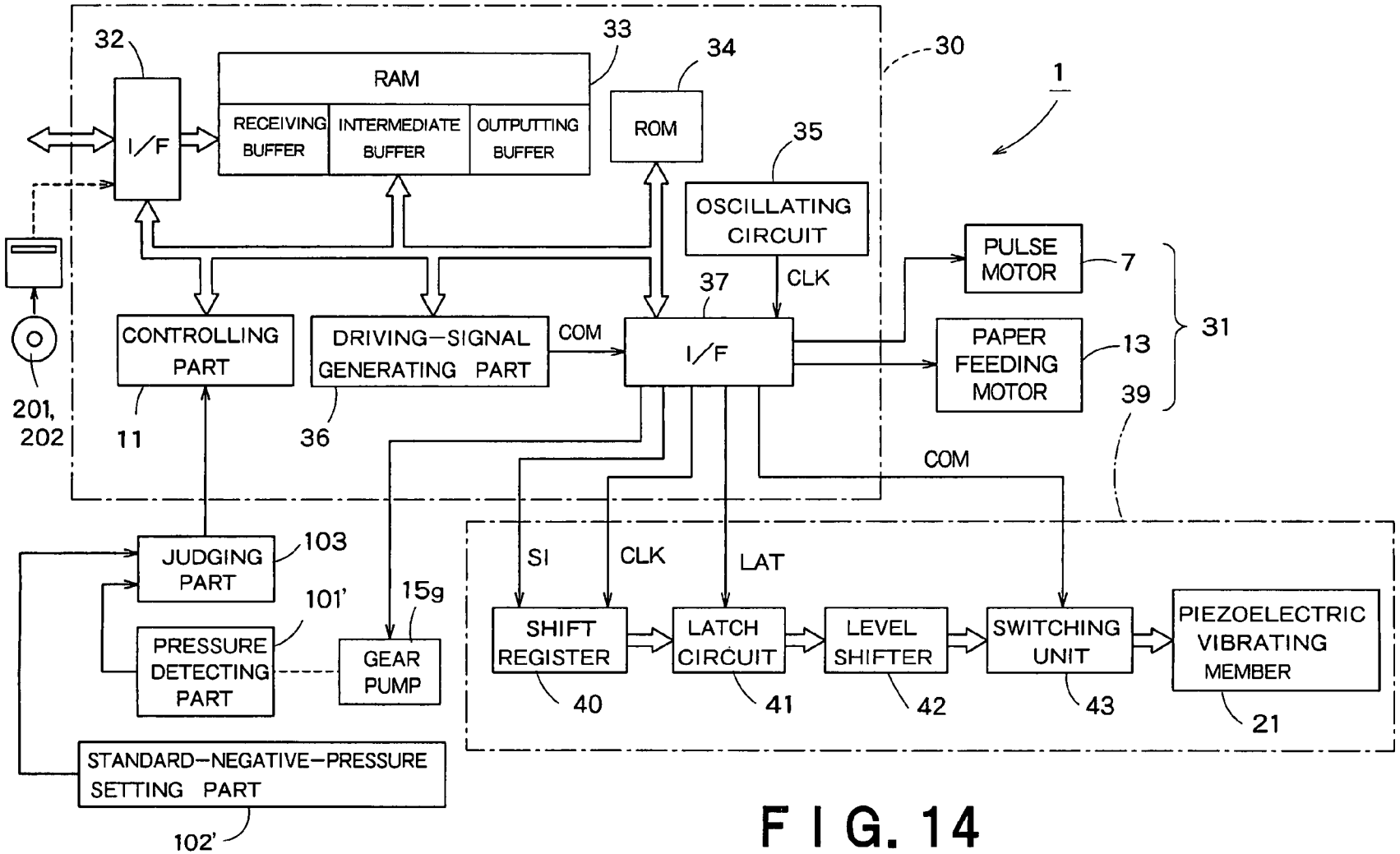
FIG. 14 is a schematic block diagram for explaining an electric structure of an ink-jetting recording apparatus of a fifth embodiment according to the invention.

Such an embodiment is explained. FIG. 14 is a schematic block diagram for explaining an electric structure of an ink-jetting recording apparatus of a fifth embodiment according to the invention.

In the fifth embodiment, as a state-quantity recognizing part, a pressure detecting part 101' is provided instead of the timer 101. For example, the pressure detecting part 101' may consist of a film sensor or the like, and may be arranged in the suction way 15*w* from the capping member 15 or the inside of the capping member 15 to the gear pump 15*g*.

In addition, in the embodiment, as a standard-state-quantity setting part, a standard-negative-pressure setting part 102', in which a standard negative pressure Ps being a standard for carrying out a preliminary operation is set, is provided instead of the standard-time setting part 102, in which the standard time Ts being a standard for carrying out a preliminary operation is set.

The judging part 103 is adapted to judge that the inside of the gear pump 15*g* is dry, when the pressure in the capping member Pn recognized by the pressure detecting part 101' is equal to or above the standard negative pressure Ps set in the standard-negative-pressure setting part 102'.

The controlling part 11 of the embodiment is adapted' to cause the gear pump 15*g* to operate for a predetermined time in order to judge (estimate) the inside state of the gear pump 15*g*. Thereafter, when the judging part 103 judges that the pressure in the capping member Pn is equal to or above the standard negative pressure Ps (doesn't exceed the standard negative pressure Ps), that is, when the judging part 103 judges that the inside of the gear pump 15*g* is in a dry state, the controlling part 11 is adapted to carry out a preliminary operation for wetting the inside of the gear pump 15*g*.

Other structure of the embodiment is substantially the same as the first embodiment explained with reference to FIGS. 1 to 8.

Next, an operation of the printer of the fifth embodiment is explained.

Figure 15:
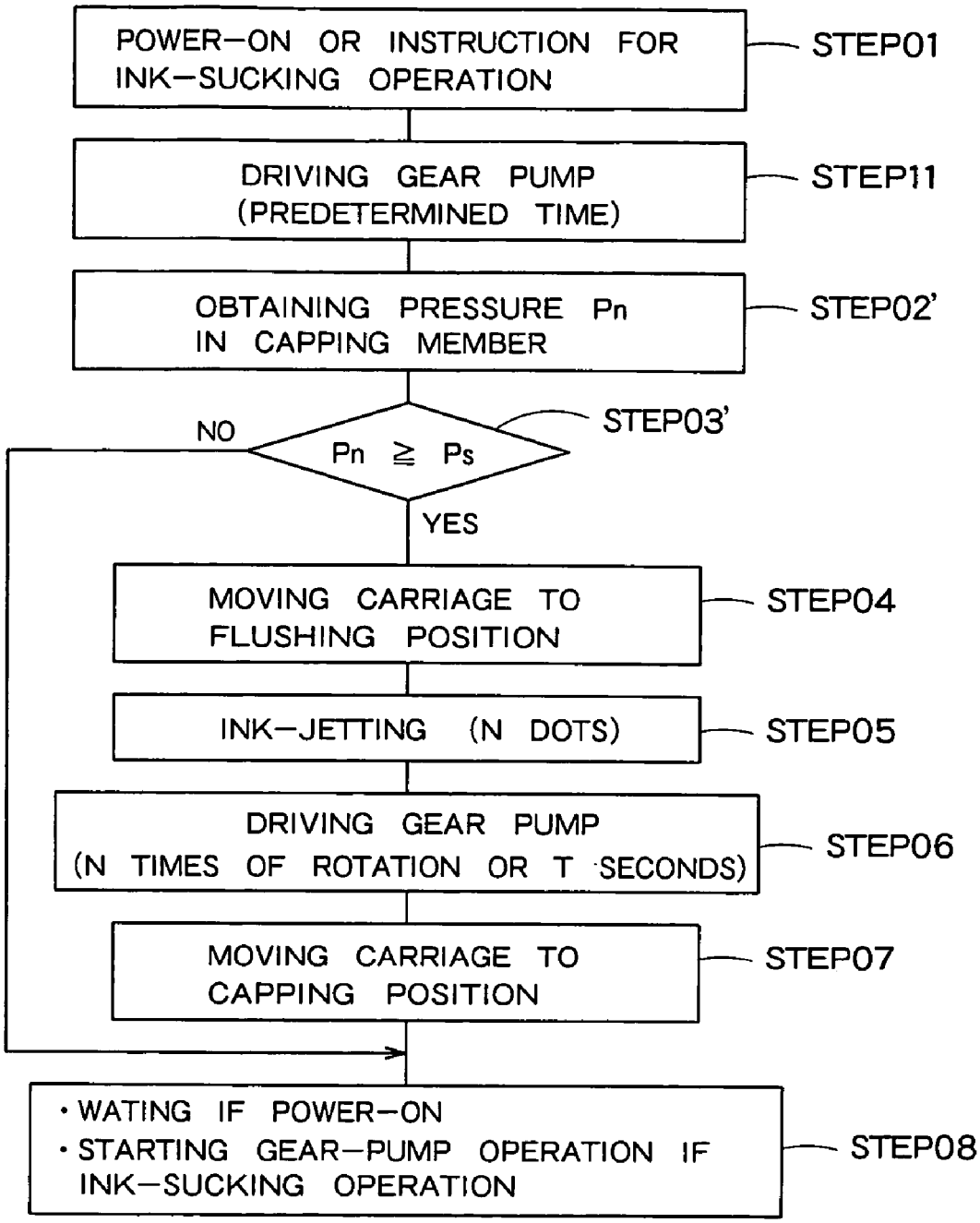
FIG. 15 is a flow chart showing a preliminary operation for a gear pump of the fifth embodiment.

When electric power is supplied to the printer 1, a necessary initializing operation is conducted at first. In the embodiment, as shown in FIG. 15, as an initializing operation after the electric power has been supplied (STEP 01), the gear pump 15*g* is caused to operate for a predetermined time (STEP 11), and a pressure in the capping member Pn is measured i.e. obtained by the pressure detecting part 101' (STEP 02').

Then, the judging part 103 judges whether the obtained pressure in the capping member Pn is equal to or above the standard negative pressure Ps set in the standard-negative-pressure setting part 102' or not (STEP 03').

If the judge result is "No", it is estimated (judged) that a wet state in the inside of the gear pump 15*g* is maintained, so that the state remains as a waiting state (STEP 08).

On the other hand, if the judge result is "Yes", it is estimated (judged) that the inside of the gear pump 15*g* becomes dry to some extent, so that a preliminary operation is carried out by the controlling part 11. Specifically, via the control by the controlling part 11, the recording head 4 (the carriage 5) and the capping member 15 are moved to the flushing position (waiting position) (STEP 04). In that state, via the control by the controlling part 11, a predetermined volume of the ink, for example, N dots of the ink are jetted out by means of a flushing operation (STEP 05). Thus, the predetermined volume of the ink is ejected into the inside of the capping member 15. Then, the gear pump 15*g* is caused to operate n times of rotation or for t seconds (STEP 06). Thus, the ink ejected into the inside of the capping member 15 is conveyed into the inside of the gear pump 15*g*, so that the inside of the gear pump 15*g* is wetted, that is, returned to a wet state. Then, via the control by the controlling part 11, the recording head 4 (the carriage 5) and the capping member 15 are moved to the capping position (home position), and the recording head 4 is sealed by the capping member 15 (STEP 07). Then, the state remains as a waiting state (STEP 08).

After the initializing operation, when printing data corresponding to one line is outputted from the outputting buffer of the RAM 33, the recording head 4 conducts a maintenance operation (recovering operation) before a recording operation for the one line.

The maintenance operation is conducted for keeping ability of the recording head 4 to jet drops of the ink. The maintenance operation may be suitably selected from an ink-sucking operation, a flushing operation, a minutely-vibrating operation, and so on.

If the ink-sucking operation is conducted, as shown in FIG. 4B, the release-valve mechanism 15*v* is closed by the frame F or the like to seal the inside of the capping member 15, and thereafter the gear pump 15*g* is caused to operate. Then, the ink is sucked from the nozzles 17 of the recording head 4 by the gear pump 15*g*. At that time, since the gear pump 15*g* is caused to operate when there is a wet state in the inside of the gear pump 15*g*, the ink-sucking-action can be satisfactorily assured.

After the maintenance operation is conducted, the recording operation is conducted in the objective recording area based on the printing data. Specifically, while the recording head 4 is moved in the main scanning direction, drops of the ink can be jetted from the nozzles 17 at respective suitable timings.

If the electric power continues to be supplied to the printer for a long time, the maintenance operation may be conducted under certain conditions. If the ink-sucking operation is conducted as the maintenance operation for a case wherein the electric power continues to be supplied to the printer 1 for a long time, before the ink-sucking operation is conducted, the preliminary operation for the gear pump 15*g* is carried out when necessary.

The flowchart of the preliminary operation in the case is substantially the same as that just after the electric power has started to be supplied to the printer 1 (see FIG. 15). That is, after the instruction for the ink-sucking operation has been confirmed (STEP 01), the gear pump 15*g* is caused to operate for a predetermined time (STEP 11), and a pressure in the capping member Pn is measured i.e. obtained by the pressure detecting part 101' (STEP 02').

Then, the judging part 103 judges whether the obtained pressure in the capping member Pn is equal to or above the standard negative pressure Ps set in the standard-negative-pressure setting part 102' or not (STEP 03').

If the judge result is "No", it is estimated (judged) that a wet state in the inside of the gear pump 15*g* is maintained, so that the ink-sucking operation starts to be carried out under that state (STEP 08).

On the other hand, if the judge result is "Yes", it is estimated that the inside of the gear pump 15*g* becomes dry to some extent, so that a preliminary operation is carried out by the controlling part 11. Specifically, via the control by the controlling part 11, the recording head 4 (the carriage 5) and the capping member 15 are moved to the flushing position (waiting position) (STEP 04). In that state, via the control by the controlling part 11, a predetermined volume of the ink, for example, N dots of the ink are jetted out by means of a flushing operation (STEP 05). Thus, the predetermined volume of the ink is ejected into the inside of the capping member 15. Then, the gear pump 15*g* is caused to operate n times of rotation or for t seconds (STEP 06). Thus, the ink ejected into the inside of the capping member 15 is conveyed into the inside of the gear pump 15*g*, so that the inside of the gear pump 15*g* is wetted, that is, returned to a wet state. Then, via the control by the controlling part 11, the recording head 4 (the carriage 5) and the capping member 15 are moved to the capping position (home position), and the recording head 4 is sealed by the capping member 15 (STEP 07). Thereafter, the ink-sucking operation starts to be carried out under that state (STEP 08).

According to the embodiment, only when the pressure in the capping member Pn after the gear pump 15*g* has been driven for a predetermined time is equal to or above the standard negative pressure Ps, the preliminary operation for wetting the inside of the gear pump 15*g* can be carried out. Thus, in the case too, the inside of the gear pump 15*g* is efficiently returned to the wet state from the dry state.

Furthermore, as a state quantity related to an operating state of the gear pump 15*g*, a state quantity related to an ink flow after the gear pump 15*g* has been driven for a predetermined time may be also used. If an expected ink flow isn't generated after the gear pump 15*g* has been driven for a predetermined time, it can be estimated that the inside of the gear pump 15*g* is in a dry state. The state quantity related to an ink flow may be detected by a photon-interrupter provided in the suction way 15w, or an electrode provided in the capping member 15 or the gear pump 15*g*, or the like. In addition, an ink flow into the gear pump 15*g* may be detected, by detecting change in a rotational load of a motor (not shown) for driving the gear pump 15*g* from an electrical current waveform of the motor.

In addition, the gear pump is used in the above embodiments. However, instead of the gear pump, any roots pump, any quimby screw pump, any vane pump, or any other built-in slide-rotator type of positive displacement pump may be used.

An example of structure of a roots pump is explained in detail with reference to FIGS. 1A to 16C. FIG. 16A is a perspective view of a roots pump 200, FIG. 16B is an exploded view of the roots pump 200, and FIG. 16C is a plan view of the roots pump 200 from which a lid 207 is removed.

Figure 16B:
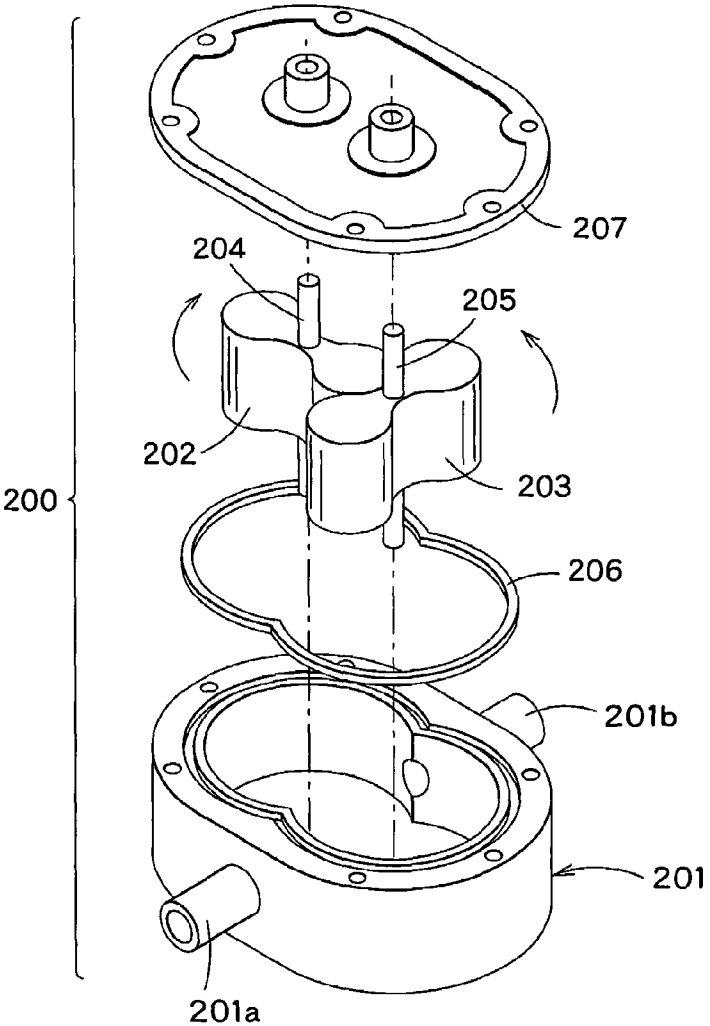
FIG. 16B is an exploded view of the roots pump.
Figure 16A:
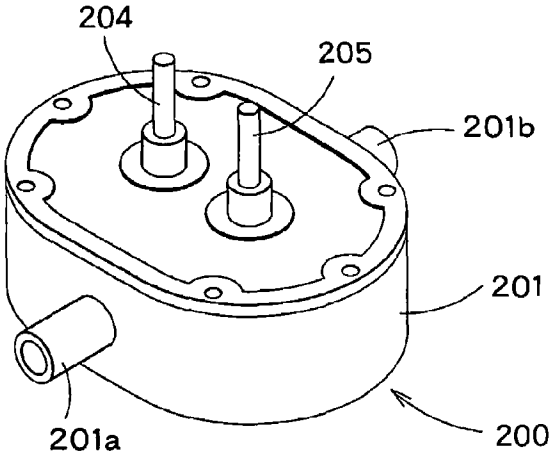
FIG. 16A is a perspective view of a roots pump.
Figure 16C:
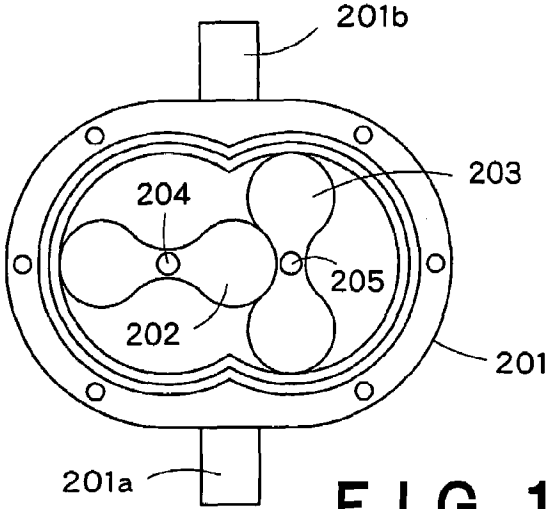
FIG. 16C is a plan view of the roots pump from which a lid is removed.

As shown in FIGS. 16A to 16C, the roots pump 200 includes: a pump frame (casing) 201 having a suction port 201*a* connected to the suction way 15*w*; and a first rotator 202 and a second rotator 203 that are in a rolling contact with each other and that are contained in the pump frame 201. The first rotator 202 is rotated by means of a first driving shaft 204 that pierces the pump frame 201 and/or the lid 207. Similarly, the second rotator 203 is rotated by means of a second driving shaft 205 that pierces the pump frame 201 and/or the lid 207. The first driving shaft 204 and the second driving shaft 205 are arranged in parallel. The pump frame (casing) 201 is sealed by the lid 207 via a packing 206. In the example, the pump frame 201 has a discharging port 201*b*. The suction port 201*a* and the discharging port 201*b* are located opposite with respect to a slide area between the rotators 202, 203 and the pump frame 201.

For example, the roots pump 200 is formed in such a precise manner that a gap between the first and second rotators 202, 203 and the pump frame 201 is not more than 100 micron in both a radial direction and a thickness direction.

When the first rotator 202 and the second rotator 203 are synchronously rotated in a direction shown by arrows in FIG. 16B by the first driving shaft 204 and the second driving shaft 205, the first rotator 202 and the second rotator 203 slide on the pump frame 201 (via liquid (ink) menisci) while the first rotator 202 and the second rotator 203 roll on each other. Thus, the ink is conveyed from an IN area in the pump frame 201 (on the side of the suction port 201*a*) to an OUT area therein (on the side of the discharging port 201*b*) to achieve a pump function.

Herein, in the roots pump 200, the seal at the rolling area and the casing area can not be released, even if the rotational direction of the rotators is changed. That is, it is impossible for the In area and the OUT area to be communicated with each other to achieve an atmospheric release of the capping member 15. Therefore, for example, similarly to the case shown in FIGS. 4A and 4B, the release-valve mechanism 15*v* that is normally open may be provided at the capping member 15. The release-valve mechanism 15*v* is adapted to close only when the capping member 15 comes in contact with a frame F or the like, correspondingly to when it is necessary to suck the ink. Thus, the inside of the capping member 15 is normally communicated with the atmosphere, so that it is prevented the menisci are broken down by temperature change or the like, while the capping member 15 is suitably sealed when the ink has to be sucked.

Figure 17A:
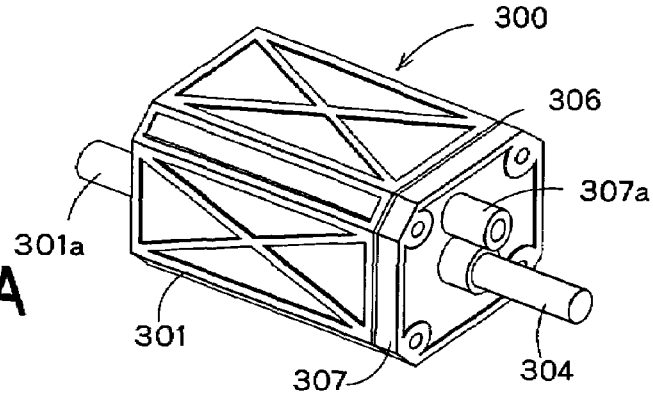
FIG. 17A is a perspective view of a quimby screw pump.

Next, an example of structure of a quimby screw pump is explained in detail with reference to FIGS. 17A to 17C. FIG. 17A is a perspective view of a quimby screw pump 300, FIG. 17B is an exploded view of the quimby screw pump 300, and FIG. 17C is a partial sectional view of the quimby screw pump 300.

Figure 17B:
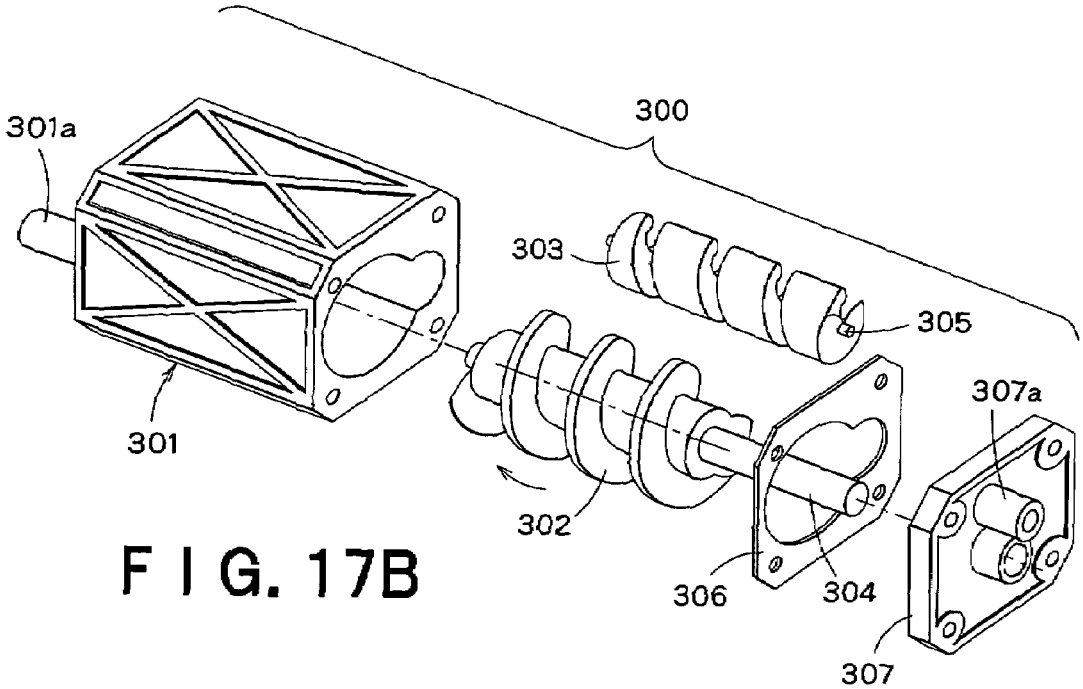
FIG. 17B is an exploded view of the quimby screw pump.
Figure 17C:
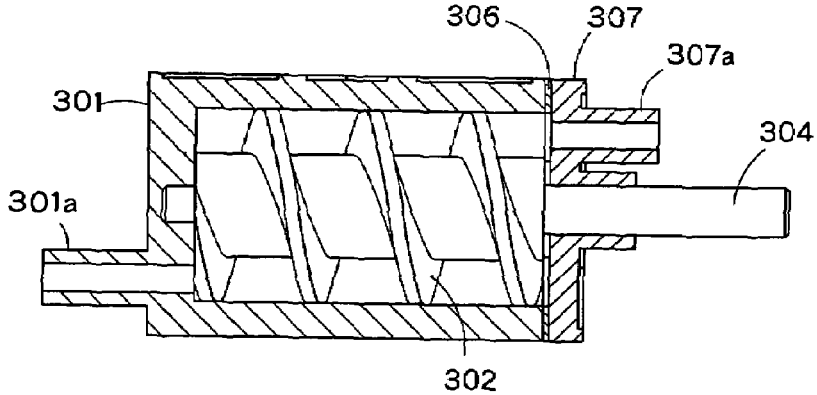
FIG. 17C is a partial sectional view of the quimby screw pump.

As shown in FIGS. 17A to 17C, the quimby screw pump 300 includes: a pump frame (casing) 301 having a suction port 301*a* connected to the suction way 15*w*; and a driving spiral 302 and a driven spiral 303 that are engaged with each other and slidably contained in'the pump frame 301 (via liquid (ink) menisci). The driving spiral 302 is rotated by means of a driving shaft 304 that pierces the pump frame 301 and/or a lid 307. The driven spiral 303 is pivotally supported by the pump frame 301 and the lid 307 via a driven shaft 305 that is parallel to the driving shaft 304. The pump frame (casing) 301 is sealed by the lid 307 via a packing 306. In the example, the lid 307 has a discharging port 307*a*. The suction port 301*a* and the discharging port 307*a* are located opposite with respect to a slide area between the spirals 302, 303 and the pump frame 301.

For example, the quimby screw pump 300 is formed in such a precise manner that a gap between the driving and driven spirals 302, 303 and the pump frame 301 is not more than 100 micron.

When the driving spiral 302 is rotated in a direction shown by an arrow in FIG. 17B by the driving shaft 304, the driven spiral 303 engaged with the driving spiral 302 is also rotated, so that the ink is conveyed from an IN area in the pump frame 301 (on the side of the suction port 301*a*) to an OUT area therein (on the side of the discharging port 307*a*) to achieve a pump function. Therefore, for example, similarly to the case shown in FIGS. 4A and 4B, the release-valve mechanism 15*v* that is normally open may be provided at the capping member 15. The release-valve mechanism 15*v* is adapted to close only when the capping member 15 comes in contact with a frame F or the like, correspondingly to when it is necessary to suck the ink. Thus, the inside of the capping member 15 is normally communicated with the atmosphere, so that it is prevented the menisci are broken down by temperature change or the like, while the capping member 15 is suitably sealed when the ink has to be sucked.

Next, an example of structure of a vane pump is explained in detail with reference to FIGS. 18A to 18C. FIG. 18A is a perspective view of a vane pump 400, FIG. 18B is an exploded view of the vane pump 400, and FIG. 18C is a plan view of the vane pump 400 from which a lid 407 is removed.

Figure 18B:
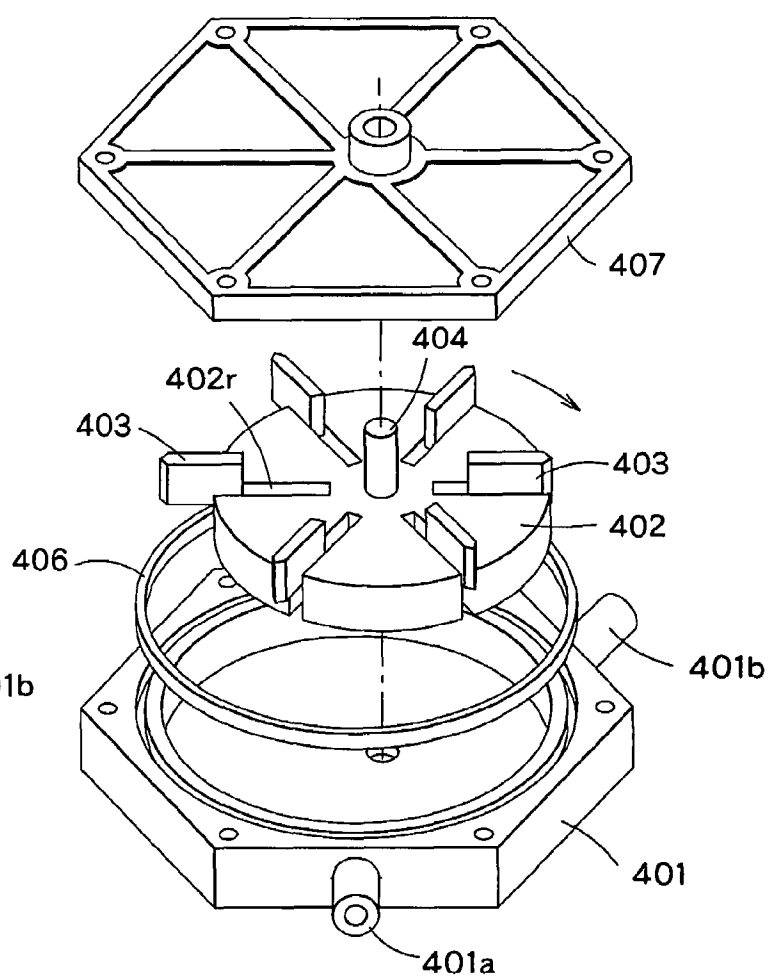
FIG. 18B is an exploded view of the vane pump.
Figure 18A:
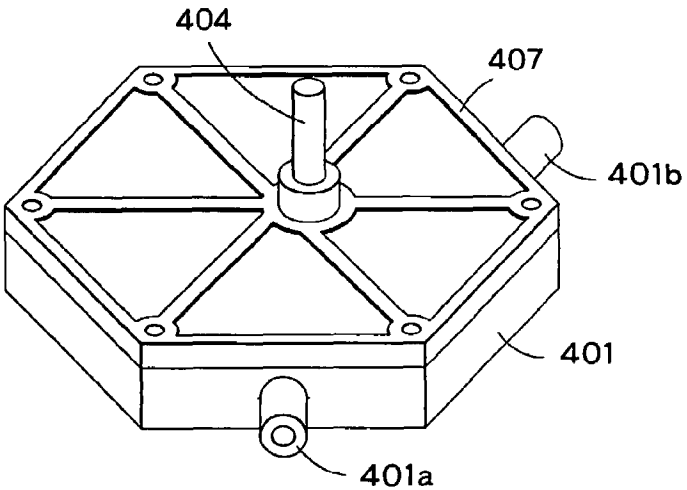
FIG. 18A is a perspective view of a vane pump.
Figure 18C:
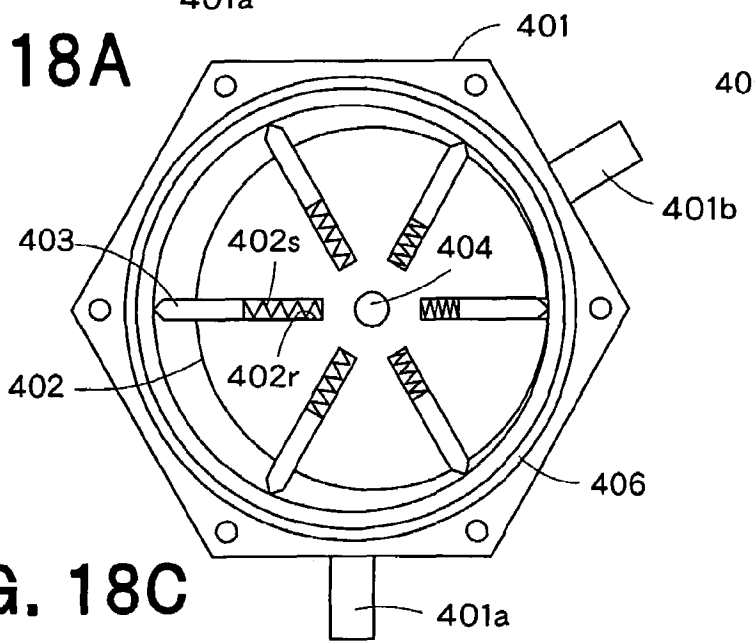
FIG. 18C is a plan view of the vane pump from which a lid is removed.

As shown in FIGS. 18A to 18C, the vane pump 400 includes: a pump frame (casing) 401 having a suction port 401*a* connected to the suction way 15*w*; and a rotor 402 that is contained in the pump frame 401. The rotor 402 has a cylindrical shape whose diameter is smaller than a diameter of a cylindrical space in the pump frame 401.

The rotor 402 is rotated by means of a driving shaft 404 that pierces the pump frame 401 and/or the lid 407. The driving shaft 404 is eccentrically located with respect to a center of the cylindrical space in the pump frame 401. Apart of the outside periphery of the rotor 402 is adapted to slide on an inside surface of the pump frame 401 (via liquid (ink) menisci). A plurality of (six in the shown example) concave portions 402*r* is formed in the outside periphery of the rotor 402, at substantially even intervals in a circumferential direction thereof. A blade 403 is provided in each concave portion 402*r* via a spring 402*s*. The spring 402*s* provides a biasing force tending to move the blade 403 outwardly. The pump frame (casing) 401 is sealed by the lid 407 via a packing 406. In the example, the pump frame 401 has a discharging port 401*b*. The suction port 401*a* and the discharging port 401*b* are located in such a manner that a slide area between the rotor 402 and the pump frame 401 is sandwiched between the suction port 401*a* and the discharging port 401*b*.

For example, the vane pump 400 is formed in such a precise manner that a gap between the rotor 402 and the pump frame 401 is not more than 100 micron.

When the rotor 402 is rotated in a direction shown by an arrow in FIG. 18B by the driving shaft 404, by means of the blades 403 protruding from the rotor 402, the ink is conveyed from an IN area in the pump frame 401 (on the side of the suction port 401*a*) to an OUT area therein (on the side of the discharging port 401*b*) to achieve a pump function.

Herein, in the vane pump 400, the seal at the slide area can not be released, even if the rotational direction of the rotor 402 is changed. That is, it is impossible for the In area and the OUT area to be communicated with each other to achieve an atmospheric release of the capping member 15. Therefore, for example, similarly to the case shown in FIGS. 4A and 4B, the release-valve mechanism 15*v* that is normally open may be provided at the capping member 15. The release-valve mechanism 15*v* is adapted to close only when the capping member 15 comes in contact with a frame F or the like, correspondingly to when it is necessary to suck the ink. Thus, the inside of the capping member 15 is normally communicated with the atmosphere, so that it is prevented the menisci are broken down by temperature change or the like, while the capping member 15 is suitably sealed when the ink has to be sucked.

Figure 19A:
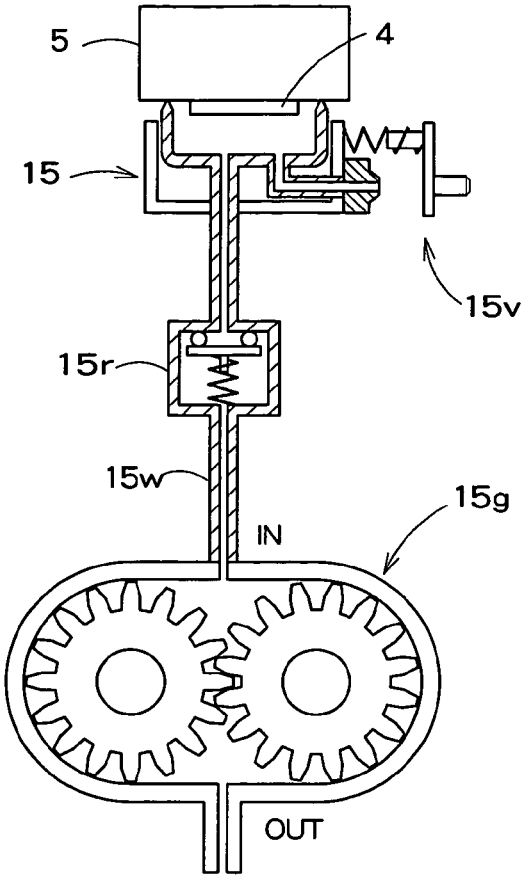
FIG. 19A is a schematic sectional view of a capping member in an embodiment wherein an opening valve is opened, the embodiment including a check valve between the capping member and a pump frame.
Figure 19B:
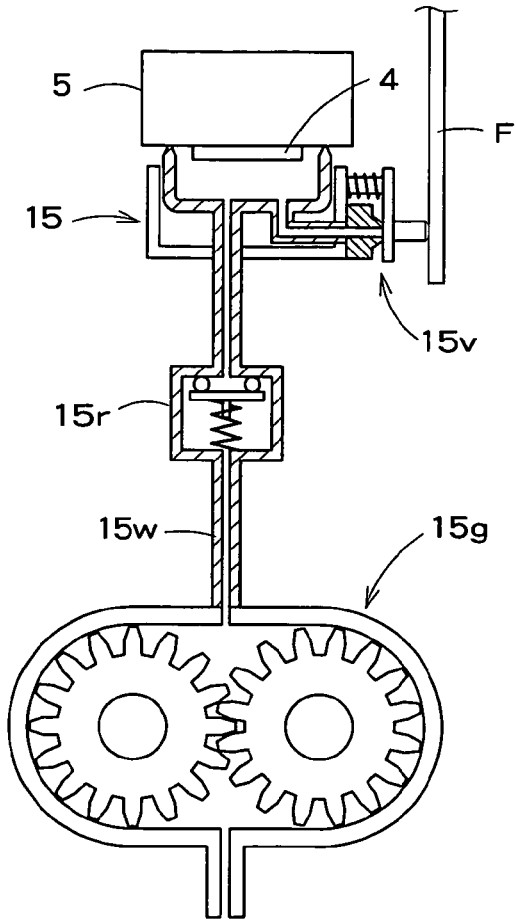
FIG. 19B is a schematic sectional view of the capping member in the embodiment wherein the opening valve is closed.

Regarding the above built-in slide-rotator type of positive displacement pumps, if precision of components thereof is low, when the sucking operation is stopped, the liquid seal in the pump may be break down at a time so that the atmospheric release may be advanced too fast. In such a case, air bubbles may enter the capping member and the nozzles to remarkably deteriorate the ink-jetting performance of the recording head. In the case, it is preferable to provide a check valve between the capping member 15 and the built-in slide-rotator type of positive displacement pump 15*g*, 200, 300 or 400. An embodiment including such a check valve 15*r* is shown in FIGS. 19A and 19B, correspondingly to FIGS. 4A and 4B.

In addition, instead of the built-in slide-rotator type of positive displacement pump like the gear pump, a reciprocating-mechanism type of positive displacement pump such as a piston pump, a bellows pump, a diaphragm pump, or the like may be also used.

Figure 20:
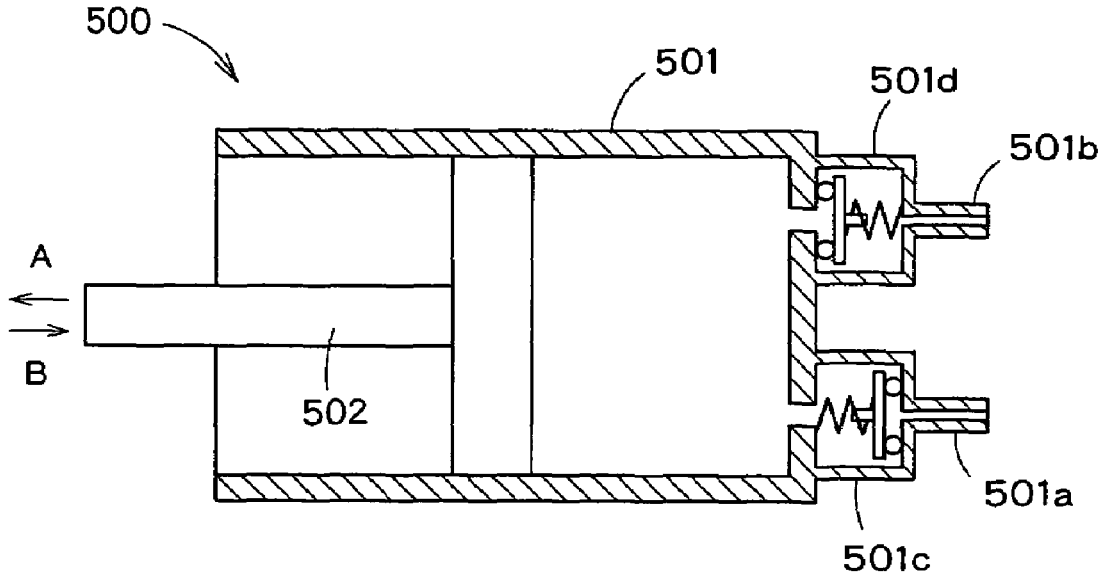
FIG. 20 is a schematic sectional view of a piston pump.

An example of structure of a piston pump is explained in detail with reference to FIG. 20. FIG. 20 is a schematic sectional view of a piston pump 500.

As shown in FIG. 20, the piston pump 500 includes a pump frame (cylinder) 501 whose volume is changeable by a reciprocating motion of a piston 502. A suction port 501*a*, which is connected to the suction way 15*w*, is formed at the pump frame 501 via a first check valve 501*c*. A discharging port 501*b* is also formed at the pump frame 501 via a second check valve 501*d*.

When the piston 502 is moved in a direction shown by an arrow A in FIG. 20, the ink is introduced from the suction port 501*a* into the pump frame 501 through the first check valve 501*c*. At that time, the second check valve 501*d* is not opened, so that the ink is not introduced back through the discharging port 501*b*. Then, when the piston 502 is moved in a direction shown by an arrow B in FIG. 20, the ink is conveyed from the inside of the pump frame 501 to the discharging port 501*b* through the second check valve 501*d*. At that time, the first check valve 501*c* is not opened, so that the ink is not conveyed back to the suction port 501*a*. This reciprocating motion of the piston 502 is repeated, so that the ink is conveyed from an IN area in the pump frame 501 (on the side of the suction port 501*a*) to an OUT area therein (on the side of the discharging port 501*b*) to achieve a pump function.

Herein, in the piston pump 500, it is impossible for the In area and the OUT area to be communicated with each other to achieve an atmospheric release of the capping member 15. Therefore, for example, similarly to the case shown in FIGS. 4A and 4B, the release-valve mechanism 15*v* that is normally open may be provided at the capping member 15. The release-valve mechanism 15*v* is adapted to close only when the capping member 15 comes in contact with a frame F or the like, correspondingly to when it is necessary to suck the ink. Thus, the inside of the capping member 15 is normally communicated with the atmosphere, so that it is prevented the menisci are broken down by temperature change or the like, while the capping member 15 is suitably sealed when the ink has to be sucked.

Figure 21:
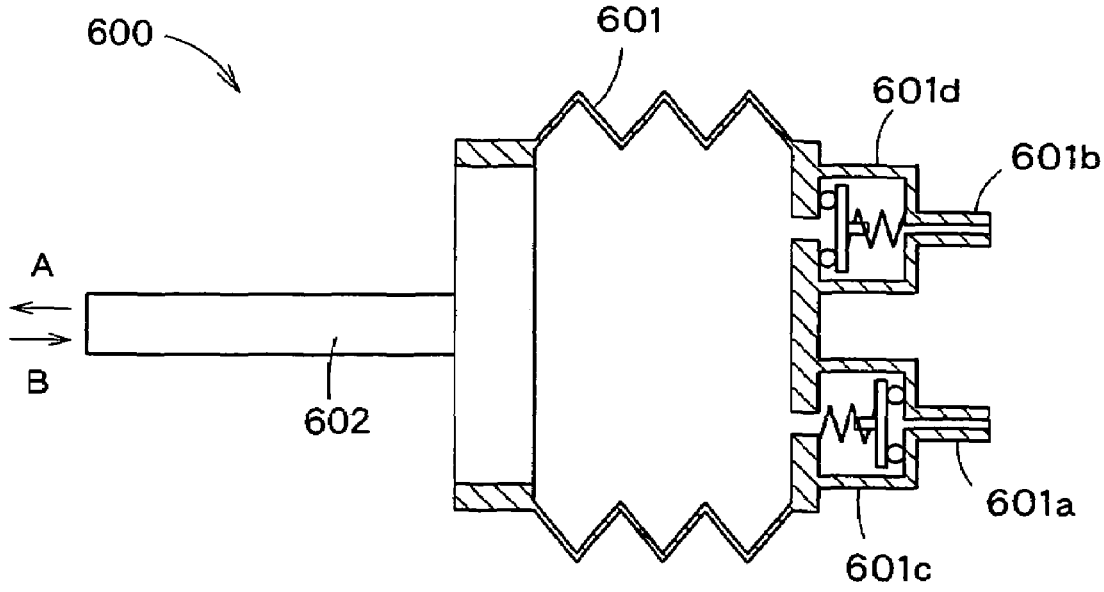
FIG. 21 is a schematic sectional view of a bellows pump.

Next, an example of structure of a bellows pump is explained in detail with reference to FIG. 21. FIG. 21 is a schematic sectional view of a bellows pump 600.

As shown in FIG. 21, the bellows pump 600 includes a bellows frame 601 whose volume is changeable by a reciprocating mechanism 602. A suction port 601*a*, which is connected to the suction way 15*w*, is formed at the bellows frame 601 via a first check valve 601*c*. A discharging port 601*b* is also formed at the bellows frame 601 via a second check valve 601*d*.

When the bellows frame 601 expands in a direction shown by an arrow A in FIG. 21, the ink is introduced from the suction port 601*a* into the bellows frame 601 through the first check valve 601*c*. At that time, the second check valve 601*d* is not opened, so that the ink is not introduced back through the discharging port 601*b*. Then, when the bellows frame 601 contracts in a direction shown by an arrow B in FIG. 21, the ink is conveyed from the inside of the bellows frame 601 to the discharging port 601*b* through the second check valve 601*d*. At that time, the first check valve 601*c* is not opened, so that the ink is not conveyed back to the suction port 601*a*. This expansion and contraction motion of the bellows frame 601 is repeated, so that the ink is conveyed from an IN area in the bellows frame 601 (on the side of the suction port 601*a*) to an OUT area therein (on the side of the discharging port 601*b*) to achieve a pump function.

Herein, in the bellows pump 600, it is impossible for the In area and the OUT area to be communicated with each other to achieve an atmospheric release of the capping member 15. Therefore, for example, similarly to the case shown in FIGS. 4A and 4B, the release-valve mechanism 15*v* that is normally open may be provided at the capping member 15. The release-valve mechanism 15*v* is adapted to close only when the capping member 15 comes in contact with a frame F or the like, correspondingly to when it is necessary to suck the ink. Thus, the inside of the capping member 15 is normally communicated with the atmosphere, so that it is prevented the menisci are broken down by temperature change or the like, while the capping member 15 is suitably sealed when the ink has to be sucked.

Figure 22:
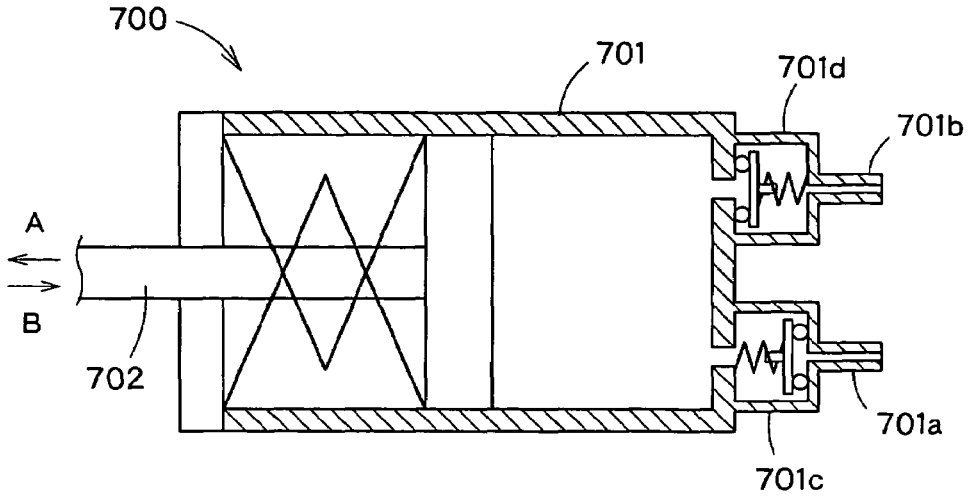
FIG. 22 is a schematic sectional view of a diaphragm pump.

Next, an example of structure of a diaphragm pump is explained in detail with reference to FIG. 22. FIG. 22 is a schematic sectional view of a diaphragm pump 700.

As shown in FIG. 22, the diaphragm pump 700 includes a pump frame (cylinder) 701 whose volume is changeable by a reciprocating motion of a diaphragm 702. A suction port 701*a*, which is connected to the suction way 15*w*, is formed at the pump frame 701 via a first check valve 701*c*. A discharging port 701*b* is also formed at the pump frame 701 via a second check valve 701*d*.

When the diaphragm 702 is moved in a direction shown by an arrow A in FIG. 22, the ink is introduced from the suction port 701*a* into the pump frame 701 through the first check valve 701*c*. At that time, the second check valve 701*d* is not opened, so that the ink is not introduced back through the discharging port 701*b*. Then, when the diaphragm 702 is moved in a direction shown by an arrow B in FIG. 22, the ink is conveyed from the inside of the pump frame 701 to the discharging port 701*b* through the second check valve 701*d*. At that time, the first check valve 701*c* is not opened, so that the ink is not conveyed back to the suction port 701*a*. This reciprocating motion of the diaphragm 702 is repeated, so that the ink is conveyed from an IN area in the pump frame 701 (on the side of the suction port 701*a*) to an OUT area therein (on the side of the discharging port 701*b*) to achieve a pump function.

Herein, in the diaphragm pump 700, it is impossible for the In area and the OUT area to be communicated with each other to achieve an atmospheric release of the capping member 15. Therefore, for example, similarly to the case shown in FIGS. 4A and 4B, the release-valve mechanism 15*v* that is normally open may be provided at the capping member 15. The release-valve mechanism 15*v* is adapted to close only when the capping member 15 comes in contact with a frame F or the like, correspondingly to when it is necessary to suck the ink. Thus, the inside of the capping member 15 is normally communicated with the atmosphere, so that it is prevented the menisci are broken down by temperature change or the like, while the capping member 15 is suitably sealed when the ink has to be sucked.

In the above embodiments, the controlling part 11, the timer 101, the standard-time setting part 102, the judging part 103, and so on can be materialized by a computer system. A program for materializing the above one or more components in a computer system, and a storage unit 201 storing the program and capable of being read by a computer, are intended to be protected by this application.

In addition, when the above one or more components may be materialized in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk or the like, but also a network for transmitting various signals.

The above description is given for the ink-jetting printer as a liquid ejecting apparatus according to the invention. However, this invention is intended to apply to general liquid ejecting apparatuses widely. A liquid may be glue, nail polish, conductive liquid (liquidmetal) or the like, instead of the ink. Furthermore, this invention can be applied to a manufacturing unit for color filters of a display apparatus such as LCD.

Another embodiment of the invention will be described hereinafter with reference to FIGS. 23 to 37.

Figure 23:
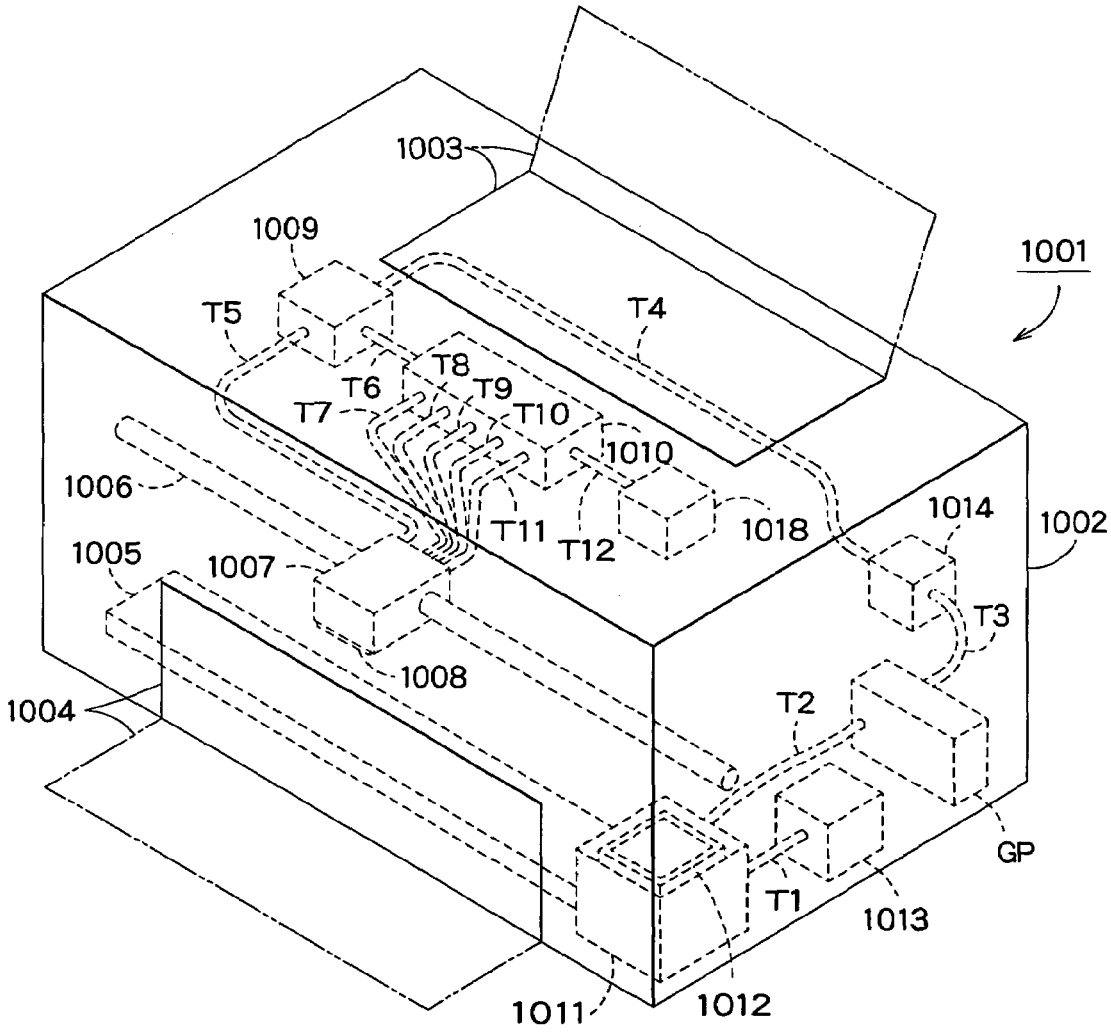
FIG. 23 is a schematic perspective view showing a printer of a sixth embodiment according to the present invention.
Figure 24:
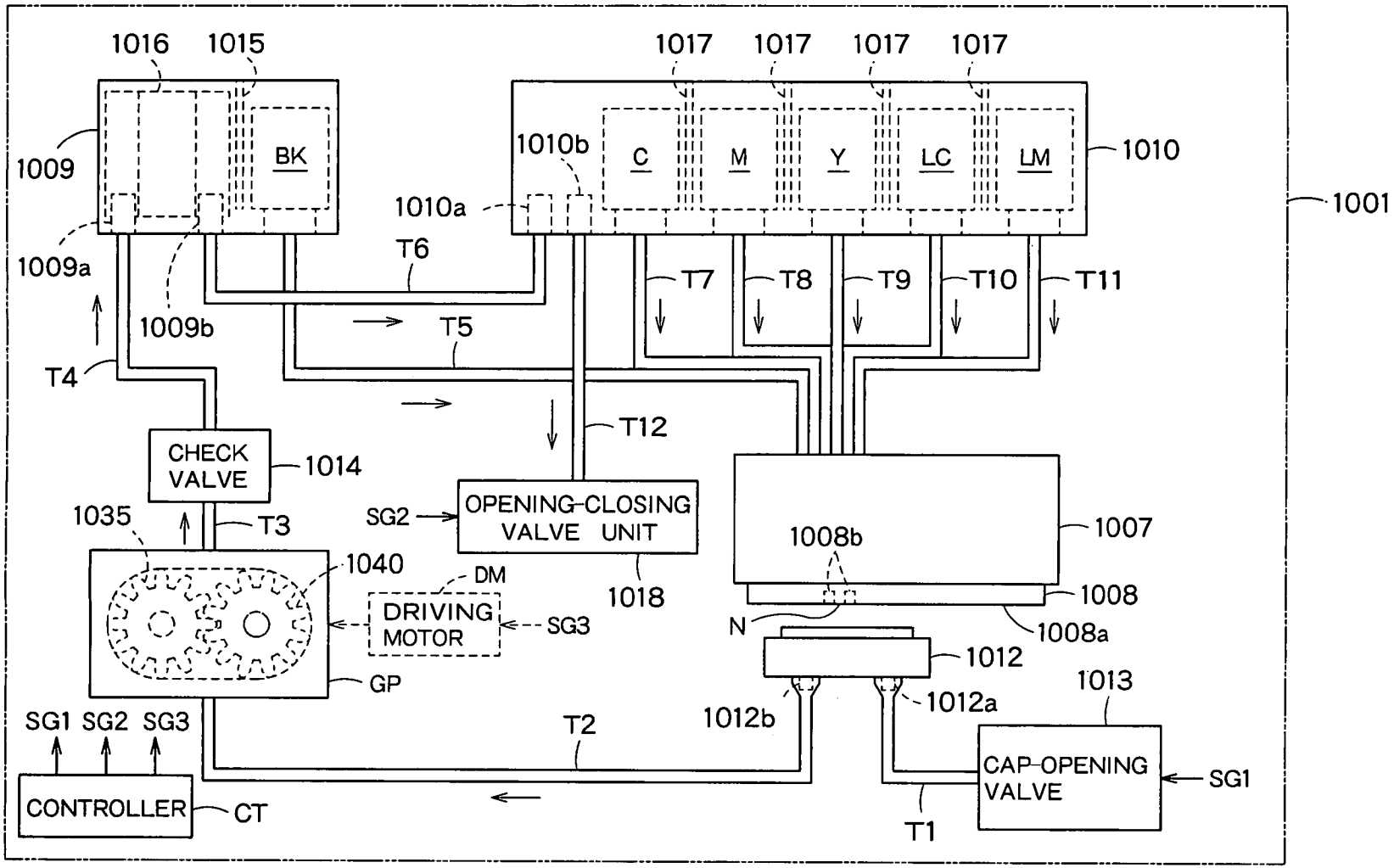
FIG. 24 is a block diagram for explaining an ink-supplying system in a recording head of the printer of FIG. 23.

FIG. 23 is a perspective view for explaining a printer of the embodiment. FIG. 24 is a block diagram for explaining an ink-supplying system in a recording head of the embodiment.

As shown in FIG. 23, the printer 1001 as a liquid ejecting apparatus has a frame 1002 of a substantially rectangular parallelepiped shape. A paper-feeding tray 1003 is provided on an upper surface of the frame 1002. A paper-discharging tray 1004 is provided in front of the frame 1002. The paper-feeding tray 1003 and the paper-discharging tray 1004 are foldable into the frame 1002 via respective hinge structures not shown.

A platen 1005 is arranged in the frame 1002, in a longitudinal direction of the frame 1002. A recording paper introduced from the paper-feeding tray 1003 into the frame 1002 is adapted to be fed on the platen 1005 by means of a paper-feeding mechanism not shown. Then, the fed recording paper is adapted to be discharged from the paper-discharging tray 1004 outside the frame 1002.

In the frame 1002, a guide member 1006 is arranged in parallel with the platen 1005. The guide member 1006 pierces a carriage 1007, which is movable along the guide member 1006.

A carriage motor (not shown) is mounted on the frame 1002. The carriage motor is connected to the carriage 1007 via a timing belt (not shown) that goes around a pair of pulleys (not shown). Thus, a driving force of the carriage motor is transmitted to the carriage 1007 via the timing belt. Due to the transmission of the driving force, the carriage 1007 can be reciprocated in a main scanning direction in parallel with the platen 1005, while guided by the guide member 1006.

A recording head 1008 is provided on a lower surface of the carriage 1007 (on a surface facing the platen 1005), as a liquid ejecting head (head member). The recording head 1008 has a nozzle-forming surface 1008*a* (see FIG. 24), which faces the recording paper. In the nozzle-forming surface 1008*a*, six rows of nozzles N (see FIG. 24) are formed, each row having n nozzles, n being a natural number.

In the present embodiment, for the convenience of explanation, the six rows of nozzles N are formed, each row having n nozzles. However, the invention is not limited to the manner. That is, the number of nozzles of a row and/or the number of rows of nozzles may be changed suitably.

Respective inks (in the present embodiment, black, cyan, magenta, yellow, light cyan and light magenta) are supplied from a first ink cartridge 1009 and a second ink cartridge 1010 provided in the frame 1002 into respective nozzles in the recording head 1008. An ink supplied to the recording head 1008 is compressed by a piezoelectric member 1008*b* (liquid ejecting unit: see FIG. 24), and ejected as an ink drop from a nozzle N of the recording head 1008. The ink drop forms a dot on the recording paper. That is, from each nozzle N formed in the recording head 1008, an ink drop of a corresponding color (black, cyan, magenta, yellow, light cyan or light magenta) is ejected.

In the printer 1001 of the present embodiment, an area for ejecting an ink drop onto the recording paper while reciprocating the carriage 1007 is a printing area. In addition, in the printer 1001, a non-printing area is also provided for sealing the nozzles N during a non-printing period. In the non-printing area, as shown in FIG. 23, a cap-holder 1011 is provided.

A capping member 1012 is provided as a flexible capping unit, on the cap-holder 1011, in such a manner that the capping member 1012 faces the nozzle-forming surface 1008*a* of the recording head 1008. The cap-holder 1011 is moved up and down by an elevating mechanism not shown, so that the capping member 1012 can seal the nozzle-forming surface 1008*a* of the recording head 1008. Thus, the respective nozzles N may be sealed.

In addition, as shown in FIG. 24, in a bottom part of the capping member 1012, a first communication port 1012*a* and a second communication port 1012*b* are formed, which are communicated with an inside of the capping member 1012.

A cap-opening valve 1013 is connected to the first communication port 1012*a* via a tube T1 outside the cap-holder 1011. The cap-opening valve 1013 is adapted to suitably open a space hermetically formed by the capping member 1012 and the nozzle-forming surface 1008*a*.

A suction port (not shown) of a gear pump GP as a built-in slide-rotator type of positive displacement pump is connected to the second communication port 1012*b* via a tube T2 as a fluid way (suction way). The gear pump GP has a driving gear 1035 and a driven gear 1040. When a driving force from a driving motor DM is transmitted, the driving gear 1035 and the driven gear 1040 are rotated, so that a negative pressure is given to the inside of the capping member 1012. Thus, when the cap-opening valve 1013 is closed and the nozzle-forming surface 1008*a* is sealed by the capping member 1012, if the gear pump is operated, a negative pressure is given to each nozzle N of the nozzle-forming surface 1008*a* so as to carry our a cleaning operation.

A check valve 1014 is connected to an exhaust port (not shown) of the gear pump GP via a tube T3. A fluid introducing member 1009*a* of the first ink cartridge 1009 is connected to the check valve 1014 via a tube T4.

The first ink cartridge 1009 is divided into two containing parts by a dividing plate 1015. An ink pack BK in which a black ink is stored is contained in one containing part. An ink absorber 1016 that may absorb inks is contained in the other containing part. The ink pack BK is connected to the recording head 1008 of the carriage 1007 via a tube T5. On the other hand, the ink absorber 1016 consists of a hydrophilic porous material such as a sponge.

Waste ink and/or air sucked from the capping member 1012 by the gear pump GP are adapted to be introduced into the first ink cartridge 1009 through the fluid introducing member 1009*a*. The waste ink introduced into the first ink cartridge 1009 is adapted to be absorbed by the ink absorber 1016. In addition, the ink pack BK is compressed by the air introduced into the first ink cartridge 1009. The check valve 1014 prevents the waste ink and/or air introduced into the first ink cartridge 1009 from reversely flowing.

An air introducing member 1010*a* of the second ink cartridge 1010 is connected to an air discharging member 1009*b* of the first ink cartridge 1009 via a tube T6. Thus, the first ink cartridge 1009 and the second ink cartridge 1010 are communicated with each other. The air introduced into the first ink cartridge 1009 is adapted to be supplied into the second ink cartridge 1010, via the air discharging member 1009*b*, the tube T6 and the air introducing member 1010*a*.

The second ink cartridge 1010 is divided into five containing parts by dividing plates 1017. Ink packs C, M, Y, LC, and LM are contained in the containing parts, respectively. In each ink pack, a cyan ink, a magenta ink, a yellow ink, a light cyan ink or a light magenta ink is stored. The respective ink packs C, M, Y, LC, and LM are connected to the recording head 1008 of the carriage 1007 via respective tube T7 to T11.

When the respective ink packs C, M, Y, LC, and LM are compressed by the air introduced into the second ink cartridge 1010, corresponding inks in the respective ink packs C, M, Y, LC, and LM are extruded and supplied into the recording head 1008 via the tube T7 to T11, respectively. An opening-closing valve unit 1018 that suitably controls an opening operation of the inside of the second ink cartridge 1010 is connected to an air discharging member 1010*b* of the second ink cartridge 1010 via a tube T12.

According to the above structure, when the gear pump GP is operated, a cleaning operation can be carried out. That is, the waste ink and/or air are sucked from the capping member 1012, and then the waste ink and/or air are introduced into the first ink cartridge 1009, through the capping member 12, the tube T2, the gear pump GP, the tube T3, the check valve 14 and the tube T4, in that order. Then, the waste ink introduced into the first ink cartridge 1009 is absorbed by the ink absorber 1016 described above. Thus, in the first ink cartridge 1009, only the air introduced into the first ink cartridge 1009 (compressing air) can move and flow. Then, the compressing air flows from the first ink cartridge 1009 into the second ink cartridge 1010 via the tube T6. At that time, the opening-closing valve unit 1018 is closed. Thus, the pressure of the compressing air is stored in the first ink cartridge 1009 and the second ink cartridge 1010.

The air pressure in the first ink cartridge 1009 and the air pressure in the second ink cartridge 1010 are always equal. Thus, when the gear pump GP is operated, the respective ink packs BK, C, M, Y, LC and LM in the both ink cartridges 1009 and 1010 are compressed by the above compressing air. Thus, the corresponding inks stored in the respective ink packs BK, C, M, Y. LC and LM are compressedly supplied into the recording head 1008 of the carriage 1007, respectively.

That is, in the printer 1001 of the present embodiment, the gear pump GP functions as a cleaning pump that gives a negative pressure to the inside of the capping member 1012, and also as a compressing pump that compresses the respective ink packs BK, C, M, Y, IC and LM. Then, when the gear pump GP is operated, the negative pressure is given to the inside of the capping member 1012, and hence the waste ink and/or air are sucked therefrom. In addition, the respective ink packs BK, C, M, Y, LC and LM are compressed so that the corresponding inks are compressedly supplied into the recording head 1008.

In addition, the printer 1001 has a controller CT. The controller CT has a driving-controlling circuit for controlling the printer 1001. The driving-controlling circuit is adapted to supply driving signals SG1 to SG3 to the cap-opening valve 1013, the opening-closing valve unit 1018 and the driving motor DM, respectively, so as to drive and control them independently. When the driving motor DM is operated, the gear pump GP is operated via a driving mechanism not shown.

(Gear Pump GP)

Figure 25:
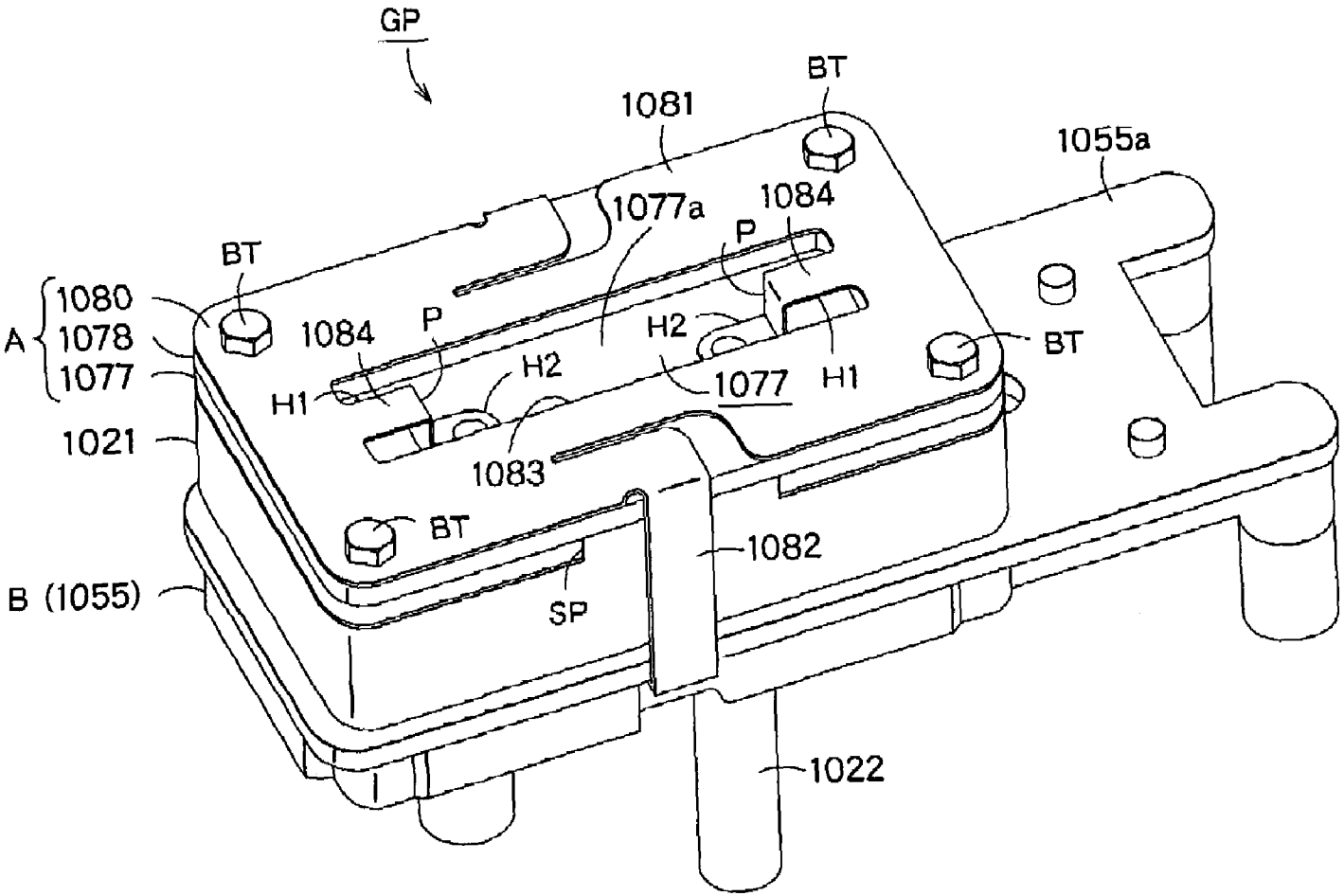
FIG. 25 is a perspective view showing a gear pump included in the printer of FIG. 23.
Figure 26:
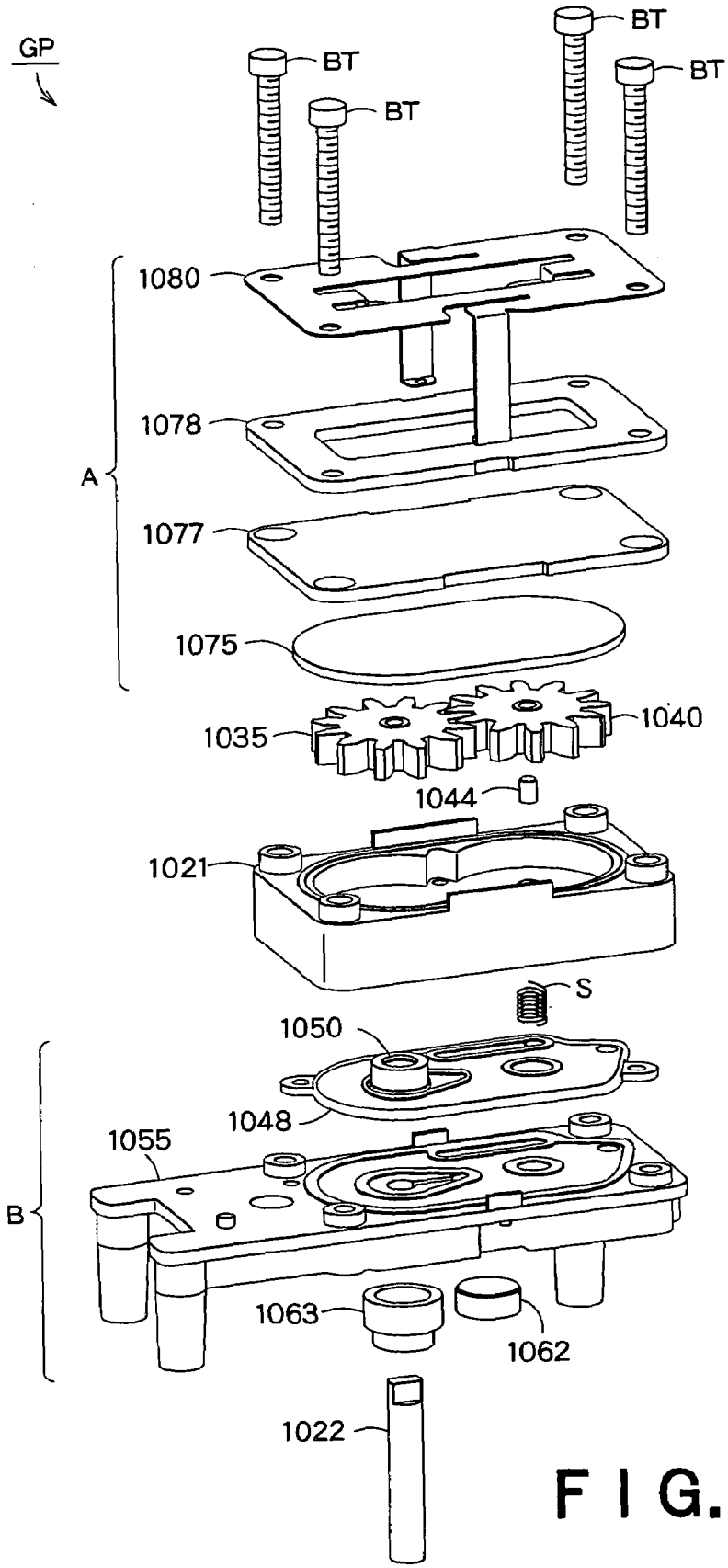
FIG. 26 is an exploded perspective view showing the gear pump of FIG. 25.

Next, the gear pump GP of the present embodiment is explained with reference to FIGS. 25 to 37. FIG. 25 is a perspective view of the whole gear pump GP. FIG. 26 is an exploded perspective view of the gear pump GP.

As shown in FIG. 25, the gear pump GP has a housing 1021, an upper sealing portion A and a lower sealing portion B. The lower sealing portion B is arranged on a bottom side of the housing 1021. A driving shaft 1022 protrudes from the lower sealing portion B. The driving shaft 1022 is connected to the driving mechanism, and hence adapted to be rotated by operating the driving motor DM.

(Housing 1021, Driving Gear 1035 and Driven Gear 1040)

Figure 27:
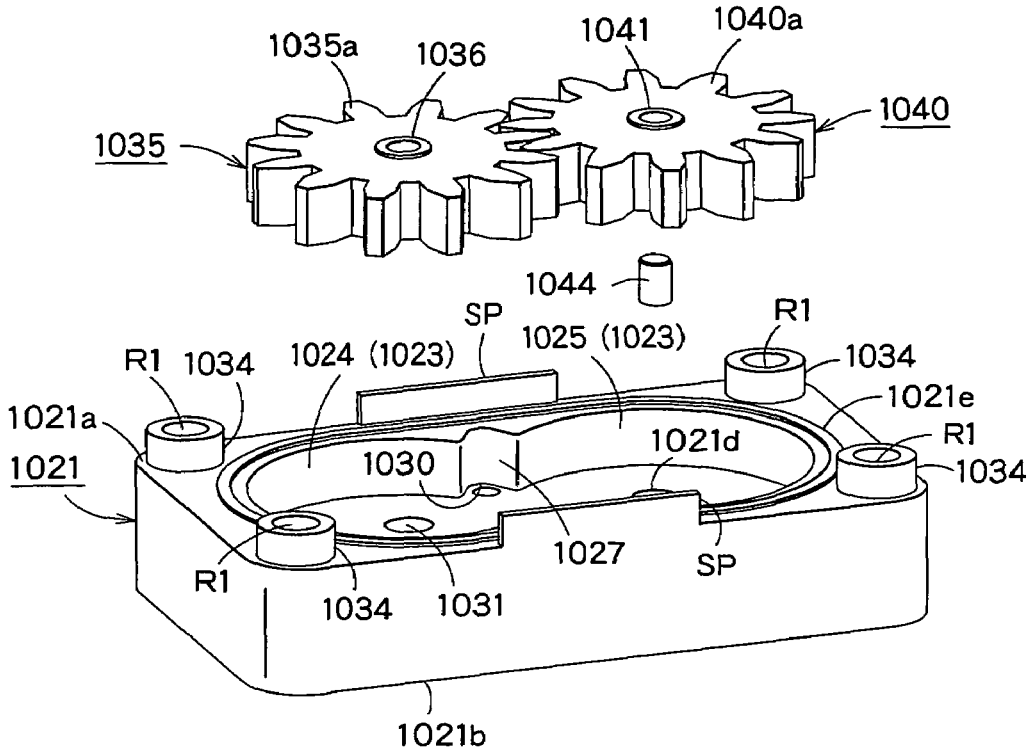
FIG. 27 is an exploded perspective view showing a housing, a driving gear, and a driven gear in the gear pump of FIG. 25.
Figure 28:
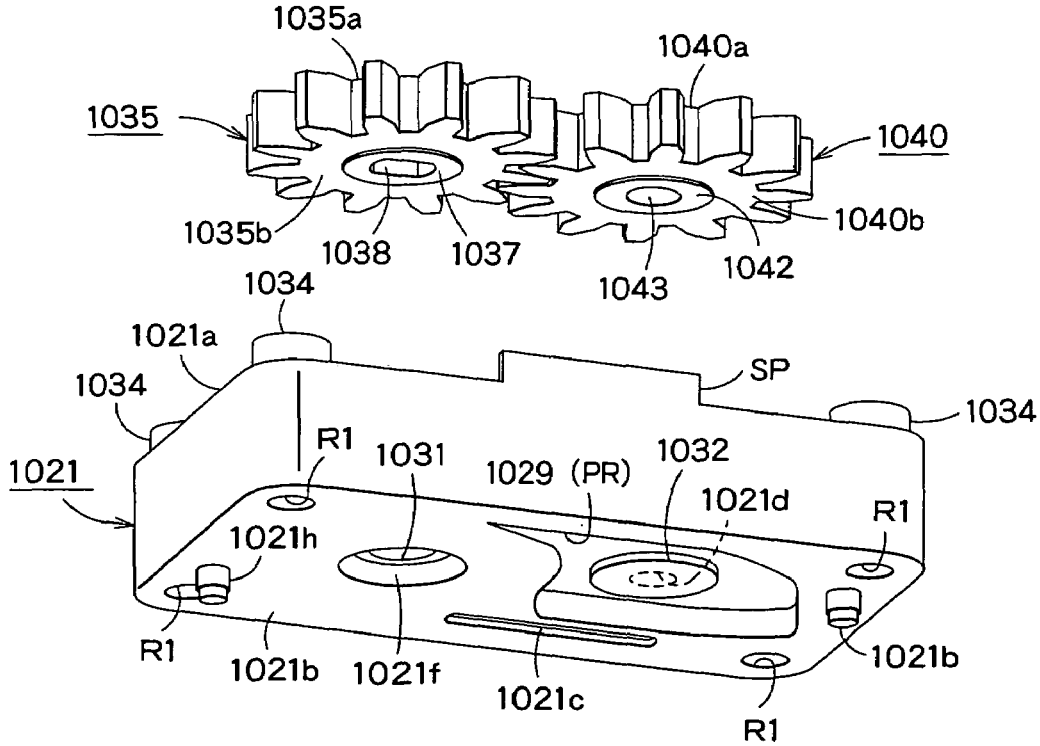
FIG. 28 is also an exploded perspective view showing the housing, the driving gear, and the driven gear in the gear pump of FIG. 25.
Figure 29:
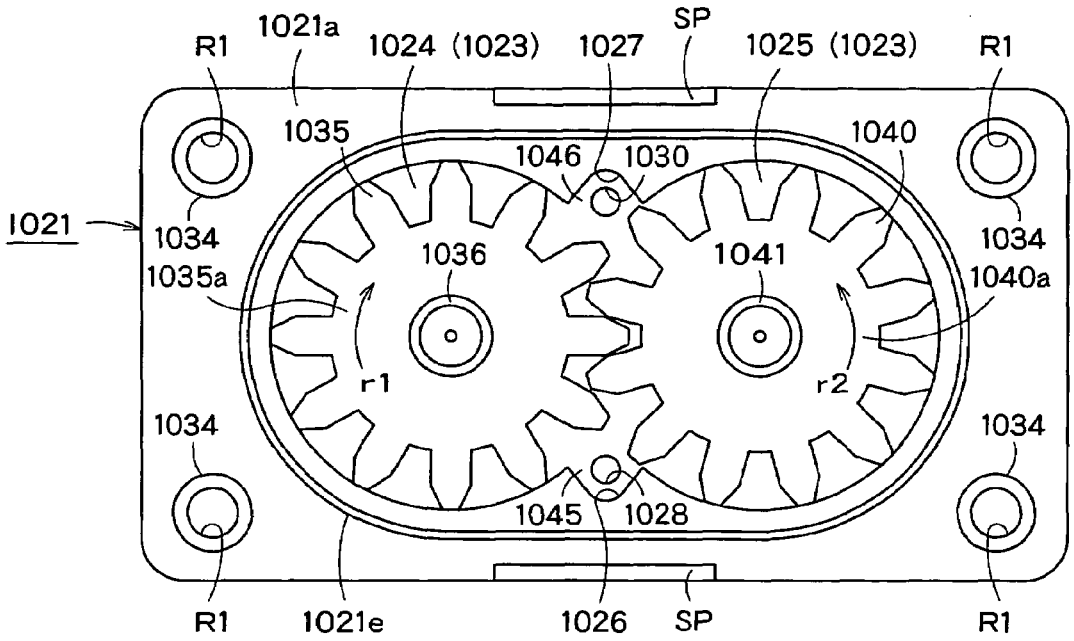
FIG. 29 is a top plan view showing the housing of the gear pump wherein the driving gear and the driven gear are included therein.
Figure 30:
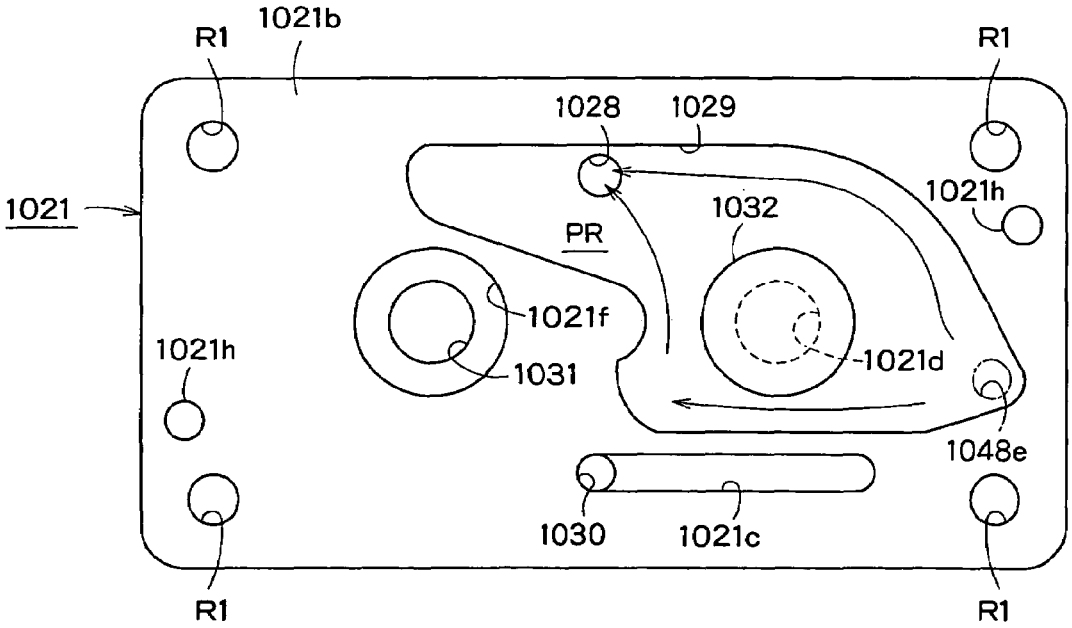
FIG. 30 is a bottom plan view showing the housing of FIG. 29.

At first, the housing 1021 is explained with reference to FIGS. 27 to 30. FIGS. 27 and 28 are perspective views of the housing 1021, and the driving gear 1035 and the driven gear 1040 contained in the housing 1021. FIG. 29 is a top plan view of the housing 1021, containing the driving gear 1035 and the driven gear 1040. FIG. 30 is a bottom plan view of the housing 1021.

As shown in FIG. 27, the housing 1021 is formed in a substantially rectangular parallelepiped shape. A containing room 1023 for containing the driving gear 1035 and the driven gear 1040 is concavely formed on an upper surface 1021*a* of the housing 1021. The containing room 1023 has a first containing room 1024 and a second containing room 1025. As shown in FIG. 29, the first containing room 1024 and the second containing room 1025 are respectively concavely formed in a substantially circle shape, and are partly overlapped with each other so as to form the containing room 1023. On an inside circumferential surface of the containing room 1023, a suction part 1026 and an ejection part 1027 are concavely formed at opposite positions sandwiched between the first containing room 1024 and the second containing room 1025, in such a manner that the suction part 1026 and the ejection part 1027 are opposed to each other.

In addition, as shown in FIG. 29, an introduction port 1028 is formed at a bottom part of the containing room 1023, on a side of the suction part 1026. The introduction port 1028 pierces the housing 1021, and is open at a bottom surface of a priming part 1029, which is formed at a bottom surface 1021*b* of the housing 1021, as shown in FIG. 30. The priming part 1029 is concavely formed at the bottom surface 1021*b*, outside a groove part 1021*c* formed at the same bottom surface 1021*b*. In addition, as shown in FIG. 29, an ejection port 1030 is formed at a bottom part of the containing room 1023, on a side of the ejection part 1027. The ejection port 1030 pierces the housing 1021, and is open at the bottom surface 1021*b*, as shown in FIG. 30. The ejection port 1030, which is open at the bottom surface 1021*b*, is communicated with the groove part 1021*c* formed at the bottom surface 1021*b*.

Figure 35:
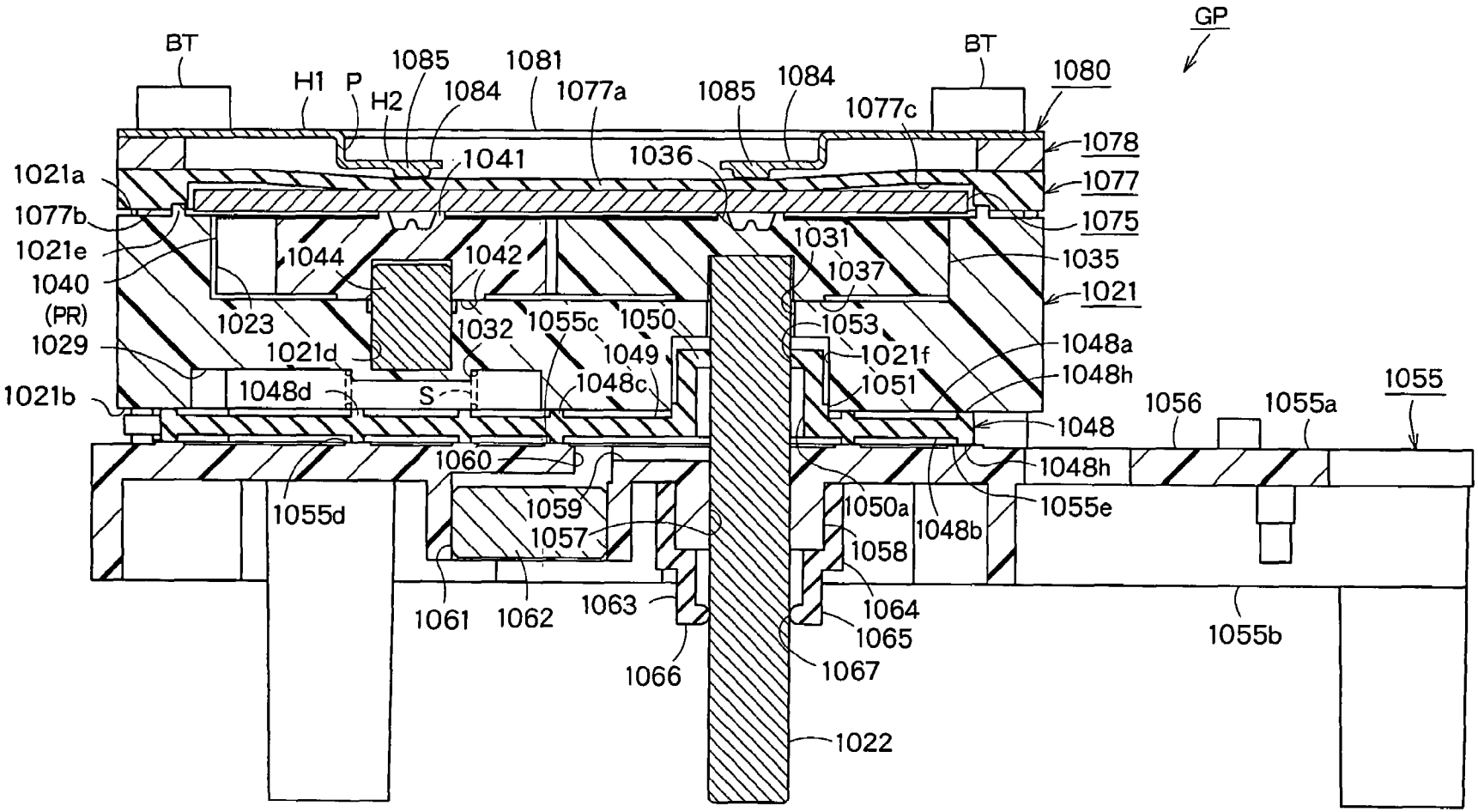
FIG. 35 is a sectional view showing the gear pump of FIG. 25.

As shown in FIGS. 27 and 35, a first bearing part 1021*d* is concavely and cylindrically formed in the bottom surface of the containing room 1023, at a position opposed to the driven gear 1040. A depth of the first bearing part 1021*d* is about half of that of the housing 1021. The first bearing part 1021*d* supports a driven shaft 1044 of the driven gear 1040.

In addition, as shown in FIG. 29, a protrudent line 1021*e* is provided in an oblong shape on the upper surface 1021*a* of the housing 1021, so as to surround an opening of the containing room 1023. The protrudent line 1021*e* is formed at a position a little away from an edge of the opening of the containing room 1023 on the upper surface 1021*a* of the housing 1021.

As shown in FIGS. 28 and 30, a concave part 1021*f* is formed at a left position of the priming part 1029 in FIG. 30, in the bottom surface 1021*b* of the housing 1021. Then, as shown in FIG. 30, a second bearing part 1031 is formed in the bottom part of the concave part 1021*f*. As shown in FIG. 27, the second bearing part 1031 pierces the housing 1021, and is open at a central position of the first containing room 1024. The second bearing part 1031 rotatably supports the driving shaft 1022 connected to the driving gear 1035.

In addition, as shown in FIGS. 28 and 30, on the bottom surface of the priming part 1029 formed at the housing 1021, a cylindrical first spring seat (washer) 1032 is provided concentrically with the first bearing part 1021*d*.

In addition, as shown in FIG. 27, at each of four corners of the upper surface 1021*a* of the housing 1021, a cylindrical insertion part 1034 is formed. Each insertion part 1034 has a threaded hole R1 which a bolt BT (see FIG. 26) can be inserted into and engaged with. As shown in FIG. 28, the threaded hole R1 pierces the housing 1021, and is open at the bottom surface 1021*b*. In addition, as shown in FIG. 27, supporting plates SP stand up at both longitudinal edges of the upper surface 1021*a*, respectively.

Then, the driving gear 1035 and the driven gear 1040 are explained. As shown in FIG. 28, the driving gear 1035 is a spur gear, and has a first shaft hole 1038 at a central position thereof. The first shaft hole 1038 has a section of a substantially rectangular shape, and is open only at a lower surface 1035*b*. In addition, as shown in FIG. 27, a circular projection 1036 is formed on an upper surface 1035*a* of the driving gear 1035. In addition, as shown in FIG. 28, a circular projection 1037 is formed around the first shaft hole 1038 on the lower surface 1035*b* of the driving gear 1035.

The driven gear 1040 engaged with the driving gear 1035 is also a spur gear, and has a second shaft hole 1043 at a central position thereof. The second shaft hole 1043 is open only at a lower surface 1040*b*. In addition, as shown in FIG. 27, a circular projection 1041 is formed on an upper surface 1040*a* of the driven gear 1040. In addition, as shown in FIG. 28, a circular projection 1042 is formed around the second shaft hole 1043 on the lower surface 1040*b*.

The driving gear 1035 and the driven gear 1040 are engaged with each other and respectively contained in the first containing room 1024 and the second containing room 1025, as shown in FIG. 29. The driving shaft 1022 (see FIG. 26) piercing the second bearing part 1031 of the housing 1021 is inserted into the first shaft hole 1038 (see FIG. 28) of the driving gear 1035 contained in the first containing room 1024, through the lower surface 1035*b*. In addition, the driven shaft 1044 (see FIG. 27) supported by the first bearing part 1021*d* of the housing 1021 is inserted into the second shaft hole 1043 (see FIG. 28) of the driven gear 1040 contained in the second containing room 1025, through the lower surface 1040*b*.

Then, as shown in FIG. 29, in the containing room 1023, a suction room 1045 and an ejection room 1046 are dividedly formed by an engaging part of the driving gear 1035 and the driven gear 1040. That is, the suction room 1045 and the ejection room 1046 are provided so as to sandwich the engaging part of the driving gear 1035 and the driven gear 1040. One side surface of the suction room 1045 is formed by the suction part 1026, and one side surface of the ejection room 1046 is formed by the ejection part 1027.

The inks are introduced from the outside into the suction room 1045 via the priming part 1029 and the introduction port 1028 formed at the housing 1021. Then, when the driving gear 1035 and the driven gear 1040 are respectively rotated in a direction r1 and in a direction r2 by rotation of the driving shaft 1022, as shown in FIG. 29, the inks in the suction room 1045 (on the suction side) are transferred into the ejection room 1046 (on the ejection side) while the inks are contained in a space formed by an inner circumferential surface of the containing room 1023 and teeth of the driving gear 1035 or the driven gear 1040. Then, when tooth tips of the driving gear 1035 and the driven gear 1040 are moved away from the inner circumferential surface of the containing room 1023, the inks contained in the space are transferred into the ejection room 1046. Thus, the pressure in the suction room 1045 becomes relatively low, and the pressure in the ejection room 1046 becomes relatively high. The inks in the ejection room 1046 are extruded into the groove part 1021*c* (see FIG. 30) via the ejection port 1030, by the pressure of the inks transferred in turn from the driving gear 1035 and the driven gear 1040.

(Lower Sealing Portion B)

Figure 31:
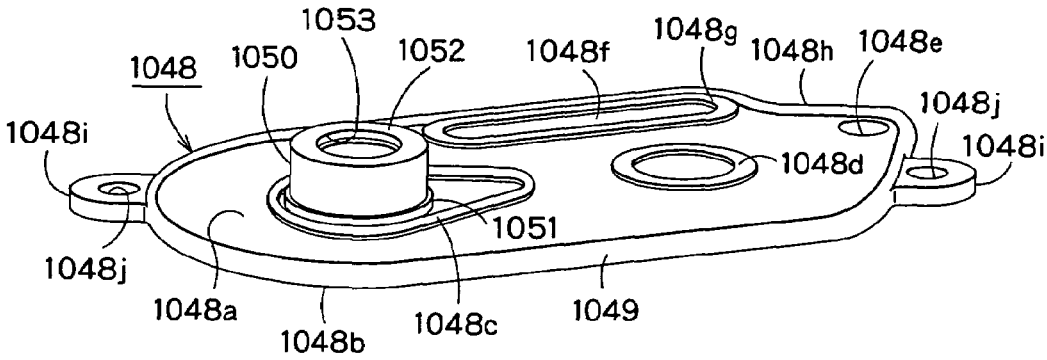
FIG. 31 is a perspective view showing a shaft sealing member forming a lower sealing portion of the gear pump of FIG. 25.
Figure 32:
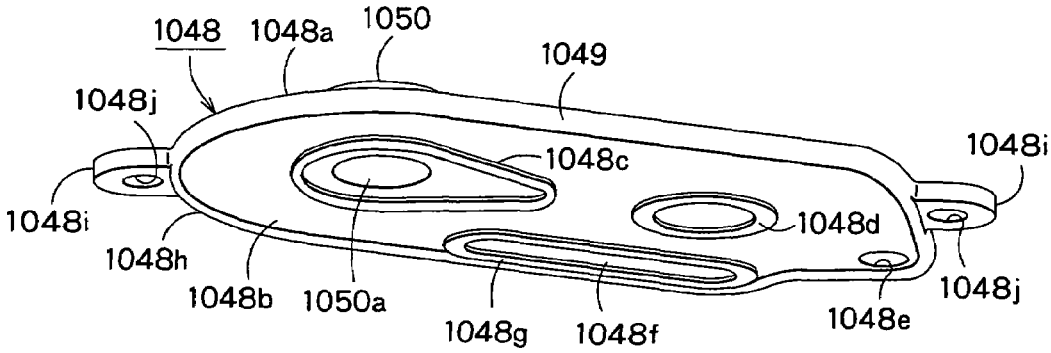
FIG. 32 is also a perspective view showing the shaft sealing member.
Figure 33:
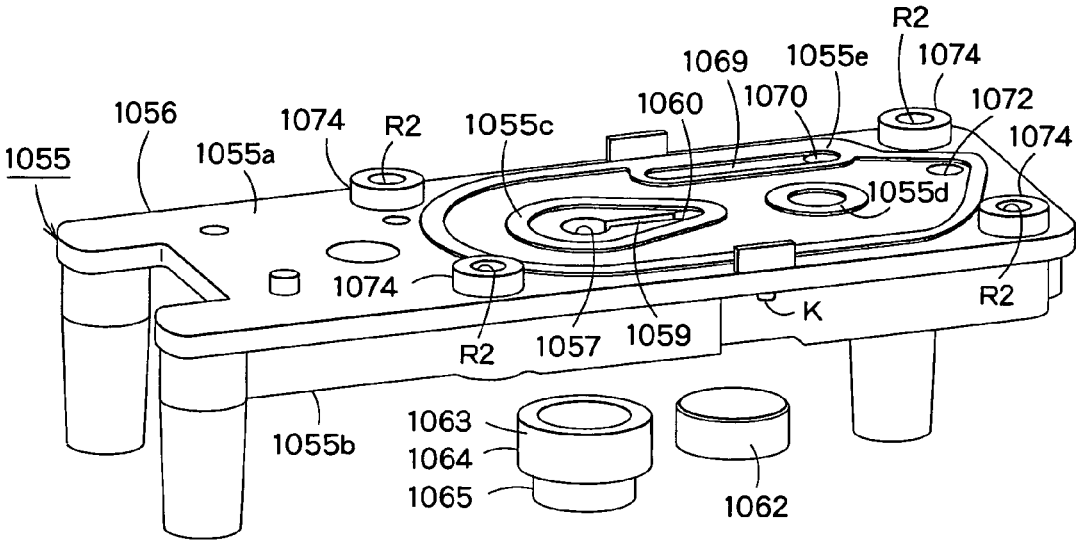
FIG. 33 is a perspective view showing a lower cover forming a lower sealing portion of the gear pump of FIG. 25.
Figure 34:
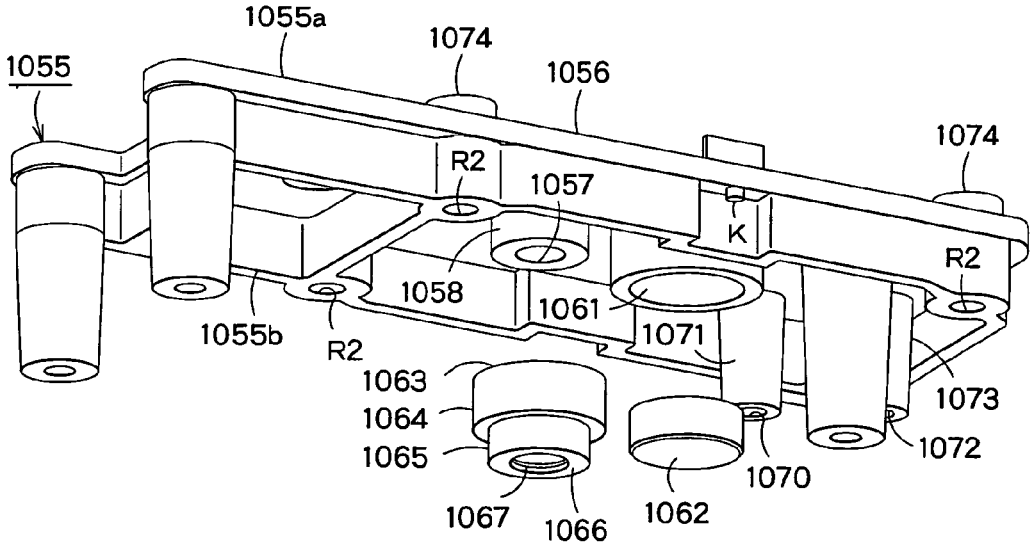
FIG. 34 is also a perspective view showing the lower cover.
Figure 36:
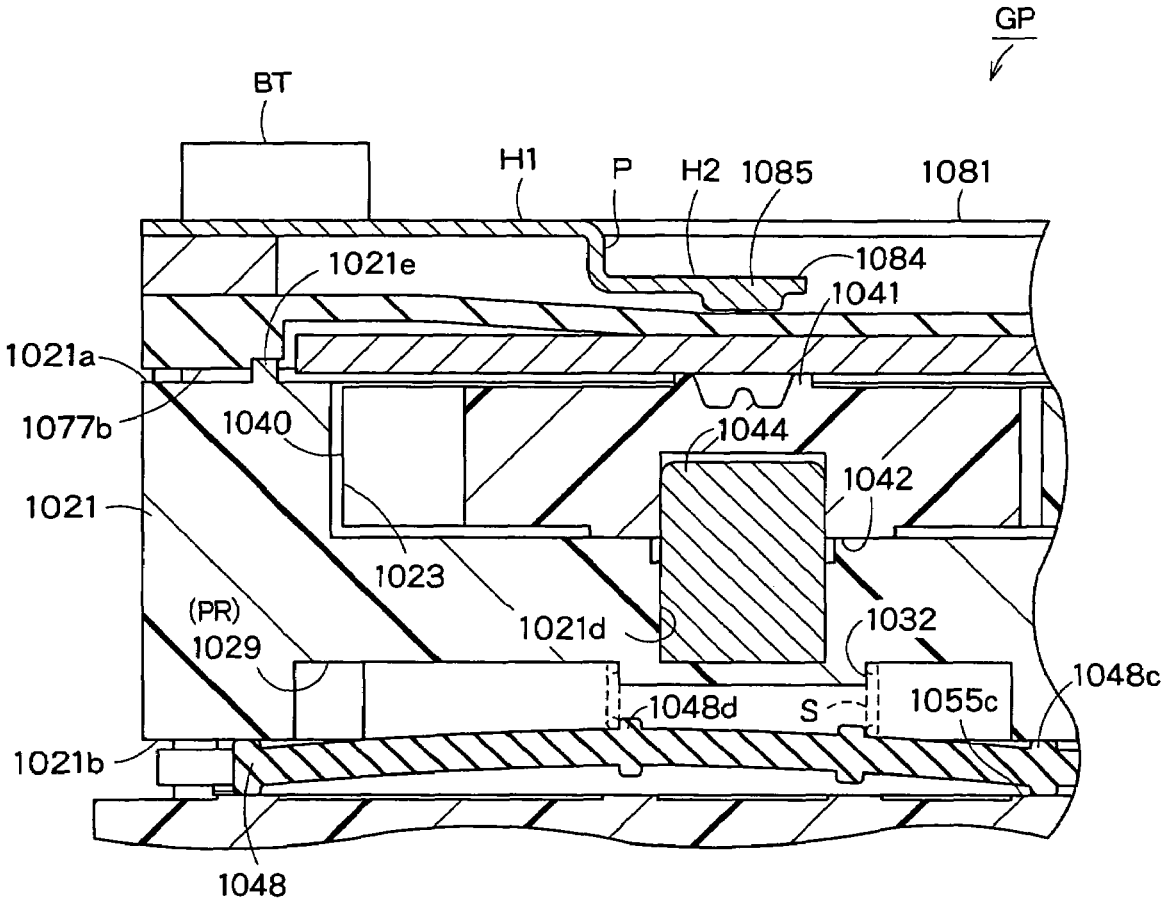
FIG. 36 is a sectional view showing the gear pump of FIG. 25 during a cleaning process.

Next, the lower sealing portion B for sealing the priming part 1029 of the housing 1021 or the like is explained. As shown in FIG. 26, the lower sealing portion B has a shaft sealing member 1048 (a part of preliminary-operation carrying-out mechanism) as a flexible member and a lower cover 1055 as a sealing member. FIGS. 31 and 32 are perspective views of the shaft sealing member 1048. FIGS. 33 and 34 are perspective views of the lower cover 1055. FIGS. 35 and 36 are partial sectional views of the gear pump GP.

At first, the shaft sealing member 1048 is explained. As shown in FIG. 31, the shaft sealing member 1048 consists of an elastomer, and has a plate like base part 1049. A cylindrical first sealing part 1050 having a lid part 1052 is formed on an upper surface 1048*a* of the base part 1049. A thick part 1051 is formed on a lower outside surface of the first sealing part 1050. An opening 1053 is formed at the lid part 1052 of the first sealing part 1050. As shown in FIG. 32, a shaft hole 1050*a* provided in the first sealing part 1050 is open at a lower surface 1048*b* of the base part 1049. First sealing protrudent lines 1048*c* are respectively formed on the upper surface 1048*a* and on the lower surface 1048*b*.

In addition, as shown FIGS. 31 and 32, a circular second spring seat 1048*d* is formed on the upper surface 1048*a* of the base part 1049, on the right side of the first sealing part 1050. In addition, another circular second spring seat 1048*d* is formed on the lower surface 1048*b* of the base part 1049, on the right side of the first sealing part 1050. A communication hole 1048*e* is formed on the right side of these second spring seats 1048*d* in FIGS. 31 and 32. A communication groove 1048*f* is formed to extend in parallel with a longitudinal direction of the shaft sealing member 1048 at an edge portion of the base part 1049, on the back side of the first sealing part 1050 in FIGS. 31 and 32. Third sealing protrudent lines 1048*g* are respectively formed on the upper surface 1048*a* and on the lower surface 1048*b*, so as to surround the communication groove 1048*f*. Then, fourth sealing protrudent lines 1048*h* are respectively formed on the upper surface 1048*a* and on the lower surface 1048*b*, along the circumferential edge of the base part 1049. Fixed pieces 1048*i* that protrude outward are respectively formed at two positions on the outside edge of the base part 1049. Each fixed piece 1048*i* has a hole 1048*j*.

The two projections 1021*h* (see FIG. 28) formed on the bottom surface 1021*b* of the housing 1021 are inserted into the holes 1048*j* of the fixed pieces 1048*i*, and the first sealing part 1050 is fitted in the concave part 1021*f* of the housing 1021, so that the shaft sealing member 1048 is fixed to the housing 1021.

In addition, as shown in FIG. 35, the base part 1049 is arranged so as to seal the priming part 1029 of the housing 1021, on the side of the bottom surface 1021*b* of the housing 1021. When the shaft sealing member 1048 is fixed to the housing 1021, the communication groove 104 8*f* formed at the base part 1049 is connected to the groove part 1021*c* (see FIG. 30) formed on the bottom surface 1021*b* of the housing 1021. Then, the communication hole 1048*e* formed at the base part 1049 is located at a position inside the priming part 1029 formed at the housing 1021 (see FIG. 30). As shown in FIG. 35, the priming part 1029 (opening of the containing room) is sealed by the base part 1049 of the shaft sealing member 1048, so that a priming room PR (see FIGS. 30 and 35) is formed as a substantially columnar induction-liquid storing room (wetting-agent storing part) by the priming part 1029 and the upper surface 1048*a* of the base part 1049. Then, as shown in FIG. 35, a coil spring S as an energizing unit (a part of preliminary-operation carrying-out mechanism) is arranged between the first spring seat 1032 provided on the bottom surface of the housing 1021 and the second spring seat 1048*d* formed on the shaft sealing member 1048. Due to a spring load W1 of the coil spring S, the shaft sealing member 1048 can come in contact with the lower cover 1055. The spring load W1 of the coil spring S is adjusted and set in such a manner that the coil spring S is retractable by a negative pressure at a cleaning operation but not retractable by any other pressure. For example, the spring load W1 of the coil spring S is adjusted and set in such a manner that the coil spring S is not retractable by a negative pressure at a non-load suction operation, which may be carried out so as to discharge the inks remaining in the capping member 1012 and the tube T2 after the cleaning operation and after the capping member 1012 is moved away from the recording head 1008.

Next, the lower cover 1055 is explained with reference to FIGS. 33 and 34. The lower cover 1055 includes a platelike cover base part 1056. Locking parts K are formed to protrude from stepped surfaces on both sides of the cover base part 1056. In addition, as shown in FIG. 33, at a substantially central portion of the upper surface 1055*a* of the cover base part 1056 (the upper surface of the lower cover 1055), a first pressure-contact part 1055*c* is formed to protrude a little from the upper surface 1055*a*. The first pressure-contact part 1055*c* is adapted to be pressed against the first sealing protrudent line 1048*c* formed at the shaft sealing member 1048, when the lower cover 1055 is mounted on the lower surface 1048*b* of the shaft sealing member 1048.

In addition, a second pressure-contact part 1055*d* and a third pressure-contact part 1055*e* are formed on the upper surface 1055*a* of the lower cover 1055. The second pressure-contact part 1055*d* is formed to protrude a little from the upper surface 1055*a*, on the right side of the first pressure-contact part 1055*c* in FIG. 33. The second pressure-contact part 1055*d* is adapted to be pressed against the second spring seat 1048*d* formed at the shaft sealing member 1048, when the lower cover 1055 is mounted on the lower surface 1048*b* of the shaft sealing member 1048. The third pressure-contact part 1055*e* is formed to protrude a little from the upper surface 1055*a*, in a substantially oblong shape. The third pressure-contact part 1055*e* is adapted to be pressed against the third and fourth sealing protrudent lines 1048*g* and 1048*h* (see FIG. 32) formed at the shaft sealing member 1048.

As shown in FIGS. 33 and 34, a first shaft hole 1057 is formed in the first pressure-contact part 1055*c*. The first shaft hole 1057 pierces the cover base part 1056 and a first bearing part 1058 formed in a bottom part 1055*b* of the lower cover 1055. In addition, an air groove 1059 is formed on the upper surface 1055*a* of the lower cover 1055, and is communicated with the first shaft hole 1057. The air groove 1059 is concavely formed on the upper surface 1055*a* in a linear shape. One end of the air groove 1059 is communicated with the first shaft hole 1057. The other end of the air groove 1059 is communicated with an air hole 1060, which is open at the upper surface 1055*a*. As shown in FIG. 35, the air hole 1060 is formed in the cover base part 1056, so as to extend in a thickness direction of the cover base part 1056. The air hole 1060 is communicated with an inside of a resistor containing part 1061, which is formed in the bottom part 1055*b* of the cover base part 1056. As shown in FIG. 34, the resistor containing part 1061 is formed in a cylindrical shape, and is open at the bottom surface 1055*b* of the lower cover 1055. A resistor 1062 consisting of a porous metal material (sintered metal) is fitted in the resistor containing part 1061. The resistor 1062 functions to limit an amount of air flowing into the air hole 1060.

In addition, a second sealing part 1063 is fitted in the first bearing part 1058. The second sealing part 1063 consists of an elastomer, and has a larger-diameter part 1064 and a smaller-diameter part 1065. The larger-diameter part 1064 is formed in a substantially cylindrical shape, and has an inside diameter suitable for an "interference fit" to the first bearing part 1058. The smaller-diameter part 1065 is formed in a cylindrical shape having a bottom part 1066, and has an inside diameter a little larger than the outside diameter of the driving shaft 1022. Then, an opening 1067 is formed at the bottom part 1066 of the smaller-diameter part 1065. The driving shaft 1022 is slidably inserted through the opening 1067.

As shown in FIG. 35, when the second sealing part 1063 is fitted in the lower cover 1055, the driving shaft 1022 protrudes from the opening 1067 of the fitted second sealing part 1063. In addition, the opening 1067 and the driving shaft 1022 keep a high contact pressure, that is, high airtightness is maintained in such a manner that no air flows into the first shaft hole 1057 through a gap between them. Herein, the second sealing part 1063 prevents air from flowing into the housing 1021 (seals), differently from the first sealing part 1050.

As shown in FIG. 33, an ejection groove 1069 is concavely formed at an edge portion of the upper surface 1055*a* of the cover base part 1056. An ejection hole 1070 is communicated with the ejection groove 1069. The ejection hole 1070 pierces the cover base part 1056 and an ejection part 1071 formed in the bottom part 1055*b* of the lower cover 1055. The ejection hole 1070 is open at a lower surface of the ejection part 1071, as shown in FIG. 34.

In addition, as shown in FIG. 33, an introduction hole 1072 is open at a corner portion inside the third pressure-contact part 1055*e* of the cover base part 1056. The introduction hole 1072 pierces the cover base part 1056 and an introduction part 1073 (see FIG. 34) formed in the bottom part 1055*b* of the lower cover 1055. The introduction hole 1072 is open at a lower surface of the introduction part 1073.

As shown in FIG. 33, a cylindrical insertion part 1074 is formed at each of four positions on the upper surface 1055*a* of the lower cover 1055. Each insertion part 1074 has a threaded hole R2, which the bolt BT can be inserted into and engaged with. The threaded hole R2 pierces the cover base part 1056, and is open at the bottom surface 1055*b* of the lower cover 1055.

As shown in FIG. 26, the lower cover 1055 is arranged on the side of the lower surface 1048*b* of the shaft sealing member 1048 fixed to the bottom surface 1021*b* of the housing 1021. Each bolt BT engaged with each threaded hole R1 of the housing 1021 is engaged with each threaded hole R2 of the lower cover 1055, and is fastened by means of each nut not shown. Then, the lower cover 1055 is fixed to the housing 1021 via the shaft sealing member 1048. At that time, the introduction hole 1072 formed at the introduction part 1073 of the lower cover 1055, the communication hole 1048*e* formed at the shaft sealing member 1048, and the priming room PR formed by the priming part 1029 of the housing 1021 and the base part 1049 of the shaft sealing member 1048, are communicated with each other. That is, the introduction hole 1072 is communicated with the introduction port 1028, which is communicated with the inside of the containing room 1023 of the housing 1021, via the communication hole 1048*e* and the priming room PR.

In addition, the ejection hole 1070 formed at the ejection part 1071 of the lower cover 1055, the ejection groove 1069, the communication groove 1048*f* formed at the shaft sealing member 1048, and the groove part 1201*c* formed at the housing 1021, are communicated with each other. That is, the ejection hole 1070 is communicated with the ejection port 1030, which is communicated with the inside of the containing room 1023 of the housing 1021, via the ejection groove 1069, the communication groove 1048*f* and the groove part 1021*c*.

Thus, the inks introduced from the introduction hole 1072 of the lower cover 1055 are introduced into the priming part 1029 (priming room PR) via the communication hole 1048*e* formed at the shaft sealing member 1048. That is, the priming room PR is located in the gear pump GP, on the side of the capping member 1012 (on the upstream side). Then, the inks ejected into the priming room PR flow toward the introduction port 1028 via a gap between the first spring seat 1032 and the wall surface of the priming part 1029 or the like, as shown by respective arrows in FIG. 30. The inks introduced from the introduction port 1028 to the suction room 1045 are transferred from the suction room 1045 to the ejection room 1046 by the rotations of the driving gear 1035 and the driven gear 1040. The inks transferred to the ejection room 1046 flow out from the ejection port 1030 via the groove part 1021*c*, the communication groove 1048*f* and the ejection groove 1069. Then, the inks ejected from the ejection groove 1069 are discharged out via the ejection hole 1070 of the lower cover 1055 connected to the ejection groove 1069.

In addition, as shown in FIG. 35, when the lower cover 1055 is fixed to the housing 1021 wherein the shaft sealing member 1048 is sandwiched between the lower cover 1055 and the housing 1021, the inside of the resistor containing part 1061 formed at the lower cover 1055 is communicated with the shaft hole 1050*a* of the first sealing part 1050 of the shaft sealing member 1048 via the air hole 1060 and the air groove 1059 formed at the lower cover 1055. That is, air that has passed through the resistor 1062 can flow into the first sealing part 1050 via the air hole 1060 and the air groove 1059. At that time, the resistor 1062 limits an amount of the air flowing into the first sealing part 1050.

In addition, as shown in FIG. 35, the fourth sealing protrudent line 1048*h* of the shaft sealing member 1048 is pressed between the third pressure-contact part 1055*e* of the lower cover 1055 and the bottom surface 1021*b* of the housing 1021. Thus, airtightness of the priming room PR formed by the priming part 1029 of the housing 1021 and the shaft sealing member 1048 is maintained. In addition, the third sealing protrudent line 1048*g* of the shaft sealing member 1048 is pressed between the third pressure-contact part 1055*e* and the bottom surface 1021*b* around the groove part 1021*c* of the housing 1021. Thus, the groove part 1021*c*, the communication groove 1048*f* of the shaft sealing member 1048 and the ejection groove 1069 of the lower cover 1055 are hermetically sealed, that is, airtightness of the ink way is maintained.

Next, the priming room PR is explained with reference to FIGS. 35 and 36.

At a start of the cleaning operation, when the capping member 1012 is hermetically in contact with the recording head 1008 but the gear pump GP doesn't start the sucking operation yet, the spring load W1 of the coil spring S is given to the shaft sealing member 1048 forming the priming room PR. In addition, the compressing force P1 of the inks supplied into the priming room PR is also given to the shaft sealing member 1048.

Then, when the gear pump GP starts the sucking operation, as shown in FIG. 36, a negative pressure P2 is generated in the priming room PR. Thus, the shaft sealing member 1048 moves toward the housing 1021 against the spring load W1 of the coil spring S. At that time, a reaction force Wd of displacement of the shaft sealing member 1048 satisfies P2>W1+P1+Wd. When the shaft sealing member 1048 bends so that the volume of the priming room PR is decreased, all the inks in the priming room PR are sucked into the housing 1021 through the introduction port 1028. The inks function as "priming". That is, the inks sucked into the housing 1021 improve an ability to generate a negative pressure in the gear pump GP.

As a result, a flow velocity of the inks sucked from the recording head 1008 is increased. That is, the inks sucked from the recording head 1008 arrive at the gear pump GP within a shorter time. Thus, compared with dispersion of the arrival time of the inks to the gear pump GP, a proportion of a sucking time (real sucking time) after the arrival of the inks to the gear pump GP is larger. That is, compared with dispersion of a volume of the inks sucked at the arrival time, a proportion of a volume of the inks sucked during the real sucking time is larger. Thus, dispersion of the total of the volume of the inks sucked at the arrival time and the volume of the inks sucked during the real sucking time can be reduced.

After the cleaning operation, that is, when the gear pump GP stops the sucking operation, as shown in FIG. 35, the shaft sealing member 1048 moves toward the lower cover 1055 because of an effect of the coil spring S, so that the volume of the priming room PR is-increased. Thus, a negative pressure P3 is generated in the priming room PR. At that time, the inside of the capping member 1012 and the inside of the tube T2 are filled with the inks sucked from the recording head 1008. The inks are sucked into the priming room PR by the negative pressure P3. Thus, the priming room PR is filled with the inks again. That is, "priming" for the next cleaning operation is secured.

Even after the next priming is secured, the inks still remain in the capping member 1012 and the tube T2. Thus, the capping member 1012 is moved away from the recording head 1008 and a non-load sucking operation is carried out. At that time, a negative pressure P4 is generated in the priming room PR, but the negative pressure P4 is smaller than the spring load W1. Thus, the effect of the coil spring S is superior, so that the shaft sealing member 1048 doesn't bend. Thus, the inks stored in the priming room PR are not sucked into the housing 1021, even when the negative pressure P4 is generated. That is, priming for the next cleaning operation is still secured.

(Upper Sealing Portion A)

Figure 37:
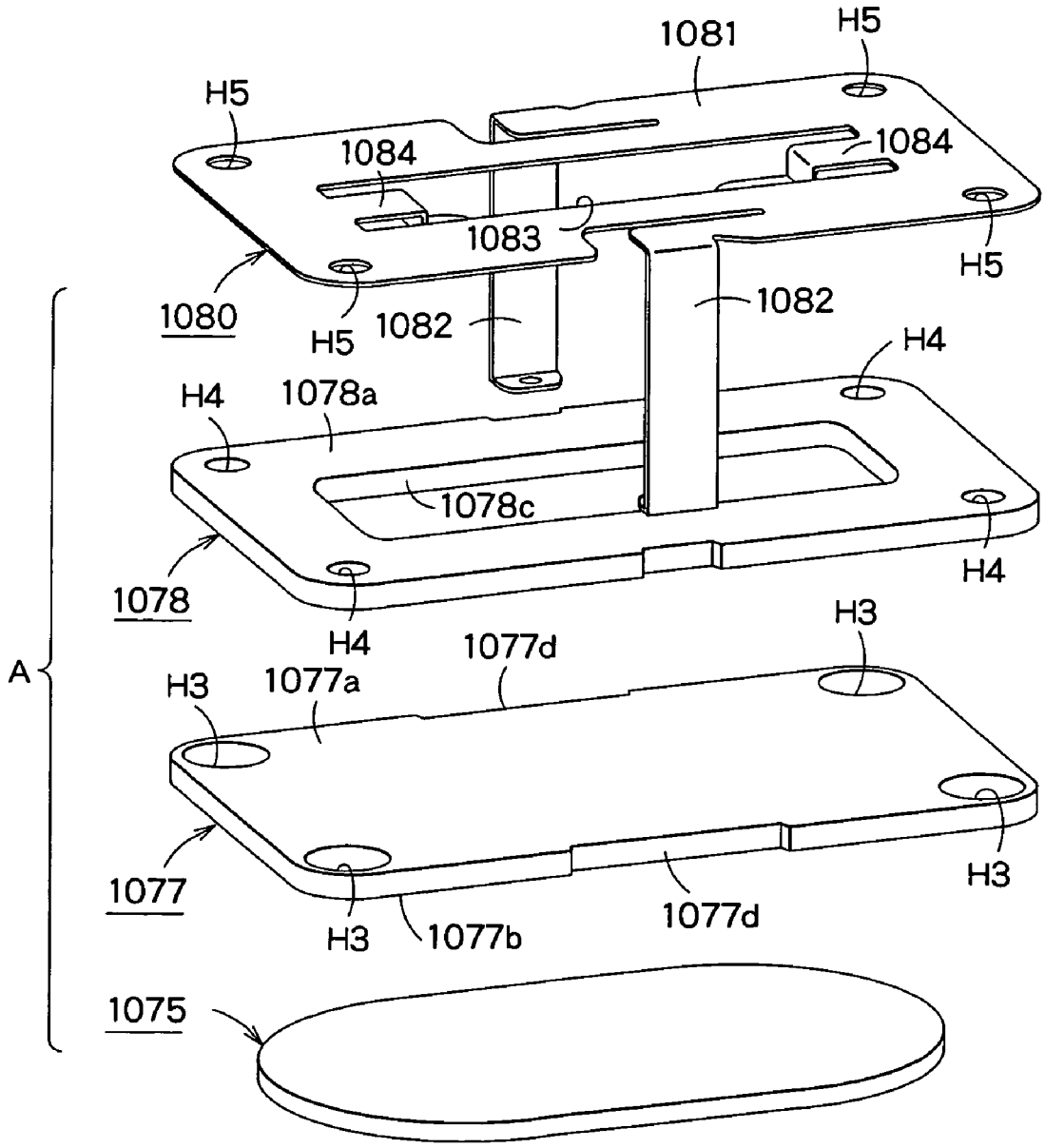
FIG. 37 is an exploded perspective view showing an upper sealing portion of the gear pump of FIG. 25.

Next, the upper sealing portion A is explained with reference to FIGS. 35 and 37. FIG. 37 is an exploded perspective view of the upper sealing portion A. As shown in FIG. 37, the upper sealing portion A has a sealing plate 1075, a packing 1077, a pushing plate 1078 and a regulating member 1080.

As shown in FIG. 37, the sealing plate 1075 consists of a metal plate, and is formed in a substantially oblong shape. The sealing plate 1075 is arranged inside the prudent line 1021*e* on the upper surface 1021*a* of the housing 1021, as shown in FIG. 35. Then, the sealing plate 1075 is positioned in an axial direction of the driving gear 1035 and the driven gear 1040 in such a manner that a surface of the sealing plate 1075 on the side of the containing room 1023 is in contact with the circular projections 1036, 1041 of the driving gear 1035 and the driven gear 1040.

The packing 1077 consists of a flexible material such as an elastomer, and is mounted outside (on) the sealing plate 1075. As shown in FIG. 37, the packing 1077 is formed in a substantially rectangular plate having a size capable of covering the opening of the containing room 1023. As shown in FIG. 35, a concave part 1077*c* is formed in the lower surface 1077*b* of the packing 1077. In addition, as shown in FIG. 37, supporting parts 1077*d* are concavely formed at both sides of the packing 1077. Four insertion holes H3 are formed at respective corners of the packing 1077. The bolt BT is inserted into each insertion bole H3.

As shown in FIG. 35, when the packing 1077 is arranged on the sealing plate 1075 and an external pressing force or the like is given, the lower surface 1077*b* of the packing 1077 is pressed against the protrudent line 1021*e* of the housing 1021, so that the pressed portion is elastically deformed and her metically fixed to the protrudent line 1021*e*. As a result, the opening of the containing room 1023 is her metically sealed. In addition, at that time, the sealing plate 1075 is contained in the concave part 1077*c* of the packing 1077.

The pushing plate 1078 is mounted on the upper surface 1077*a* of the packing 1077. As shown in FIG. 37, the pushing plate 1078 is formed in a square frame having an inside opening 1078*c*. Four insertion holes H4 are formed at respective corners of the pushing plate 1078. The bolt BT is inserted into each insertion bole H4. The, regulating member 1080 is mounted on the upper surface 1078*a* of the pushing plate 1078.

The regulating member 1080 has a main body 1081 formed in a substantially square frame, and two arms 1082 extending downward from both sides of the main body 1081. Each arm 1082 is formed in a substantially L-shape. A tip end of each arm 1082 is bent inwardly, and has a hole. Four insertion holes H5 are formed at respective corners of the main body 1081. The bolt BT is inserted into each insertion bole H5.

As shown in FIGS. 25 and 37, two regulation parts 1084 are oppositely provided, each of which is formed in a crank shape having two right-angled bent portions from a thin longitudinal plate strip. In detail, as shown in FIG. 35, each regulation part 1084 has a first horizontal part H1 extending inwardly, a perpendicular part P extending perpendicularly downwardly from the first horizontal part H1, and a second horizontal part H2 bent inwardly from the perpendicular part P. A pressing part 1085 is formed by a press working on the lower surface of the second horizontal part H2. The perpendicular part P of the regulation part 1084 has substantially the same length as a thickness of the pushing plate 1078.

As shown in FIG. 25, when the regulating member 1080 is mounted on the pushing plate 1078, the locking parts K (see FIG. 34) of the lower cover 1055 are engaged with the holes of the tip ends of the arms 1082 of the regulating member 1080. In addition, the packing 1077 is arranged to be fitted in the supporting plates SP of the housing 1021. At that time, the arms 1082 are fitted in the supporting parts 1077*d* of the packing 1077. Then, the bolts BT are inserted into corresponding insertion holes H3 to H5, and nuts not shown are fastened to the tip ends of the bolts BT protruding from the threaded holes R2 of the lower cover 1055.

As a result, by means of the regulating member 1080, the pushing plate 1078, the packing 1077, the sealing plate 1075 and the housing 1021 are fixed to the lower cover 1055. At that time, as shown in FIG. 35, the pressing parts 1085 of the regulating member 1080 contact with the upper surface 1077*a* of the packing 1077, and further press down the same.

Next, an operation of the above gear pump GP is explained. At a cleaning operation, the elevating mechanism is driven, so that the nozzle-forming surface of the recording head 1008 is sealed by the capping member 1012. Then, a driving command is outputted from the controller CT of the printer 1001 at a predetermined timing. Thus, the driving motor DM is operated, and the driving shaft 1022 is rotated in the reverse direction. As a result, as shown in FIG. 29, the driving gear 1035 is rotated in the direction r1, and the driven gear 1040 is rotated in the direction r2 by means of the engagement with the driving gear 1035.

At that time, the shaft sealing member 1048 bents because of the negative pressure P2. Thus, the inks stored in the priming room PR are sucked into the housing 1021, and function as "priming". Thus, the ability to generate the negative pressure in the gear pump GP is improved. As a result, the dispersion of the total volume of the sucked inks can be reduced. Thus, the difference from a sequence prepared in advance for securing a minimum volume of the sucked inks necessary for the cleaning operation becomes smaller. Thus, for example, it can be prevented that a volume of the sucked inks becomes much larger than the minimum volume of the sucked inks. That is, the volume of the inks consumed at the cleaning operation can be reduced.

The inks introduced from the capping member 1012 into the suction room 1045 and transferred into the ejection room 1046 by the driving gear 1035 and the driven gear 1040 are introduced into the tube T3 connected to the ejection part 1071, via the ejection port 1030, the groove part 1021*c*, the communication groove 1048*f*, the ejection groove 1069 and the ejection hole 1070. The inks ejected to the tube T3 are discharged into the first ink cartridge 1009 via the check valve 1014 and the tube T4. As a result, the inside pressure of the capping member 1012 becomes negative, so that the inks and/or air bubbles and the like are discharged from the nozzles of the recording head 1008.

After the cleaning operation (when the gear pump GP stops the sucking operation), the shaft sealing member 1048 is moved back to the lower cover 1055 by the effect of the coil spring S, so that the volume of the priming room PR is increased and the negative pressure P3 is generated. Thus, the inks stored in the capping member 1012 flow into the priming room PR via the tube T2, the introduction hole 1072 and the communication hole 1048*e*, so that the inside of the priming room PR is filled with the inks.

After that, the capping member 1012 is moved away from the recording head 1008. At that time, the inks still remain in the capping member 1012 and in the tube T2. The inks are introduced into the first ink cartridge 1009 via the capping member 1012, the tube T2, the priming room PR, the tube T3, the check valve 1014 and the tube T4, by carrying out the non-load sucking operation of the gear pump GP under a condition wherein the capping member 1012 is away from the recording head 1008.

The negative pressure P4 generated in the priming room PR at that time is smaller than the spring load W1 of the coil spring S. Thus, the shaft sealing member 1048 doesn't bent, and the inks in the priming room PR are not sucked into the housing 1021. Thus, the inks remain in the priming room PR for functioning as "priming" at the next cleaning operation.

According to the above embodiment, the following effects are obtained.

(1) According to the embodiment, since the priming room PR is provided in the gear pump GP, when the gear pump GP starts the sucking operation at a cleaning operation, the inks are sucked into the housing 1021 as "priming". As a result, the ability to generate the negative pressure in the gear pump GP is improved, and the inks are sucked from the recording head 1008 to the gear pump GP within a shorter time. As a result, the dispersion of the arrival time of the inks to the gear pump GP is reduced. Thus, the dispersion of the volume of the inks sucked from the capping member 1012 is reduced. Thus, the difference from a sequence prepared in advance for securing the minimum volume of the sucked inks necessary for the cleaning operation becomes smaller. Thus, for example, it can be prevented that a volume of the sucked inks becomes much larger than the minimum volume of the sucked inks. That is, the volume of the inks consumed at the cleaning operation can be reduced.

(2) According to the embodiment, the priming room PR is located on the side of the capping member 1012 (on the upstream side) in the gear pump GP. Thus, when the gear pump GP starts the sucking operation, the inks in the priming room PR are immediately sucked into the housing 1021. Thus, after the start of the cleaning operation, the ability to generate the negative pressure in the gear pump GP can be immediately improved, and the dispersion of the volume of the inks sucked by the gear pump GP can be reduced effectively.

(3) According to the embodiment, the volume of the priming room PR can be varied depending on the negative pressure in the priming room PR. Thus, when the gear pump GP starts the sucking operation, if the volume of the priming room PR is decreased, the inks in the priming room PR can be immediately introduced into the housing 1021. In addition, when the sucking operation of the gear pump GP is stopped, the volume of the priming room PR is returned back. Thus, the inks for using as "priming" in the next cleaning operation can be secured. Thus, no separate apparatus is necessary for sucking the inks (priming) into the housing 1021 and for securing the inks (priming) in the priming room PR. Thus, although the gear pump GP has such a simple and compact structure, the dispersion of the volume of the inks sucked by the gear pump GP can be reduced effectively.

(4) According to the embodiment, the shaft sealing member 1048 forming the priming room PR functions not only as a packing of the gear pump GP, but also as a diaphragm. Thus, it is unnecessary to add a new element for a diaphragm function, which may reduce the number of parts. Thus, without increasing manufacturing cost, the dispersion of the volume of the inks sucked by the gear pump GP can be reduced effectively.

(5) According to the embodiment, the spring load W1 of the coil spring S arranged in the priming room PR is set to such a degree that the coil spring S can be retracted by the negative pressure at the cleaning operation but cannot be retracted by the negative pressure at the non-load sucking operation. Thus, the shaft sealing member 1048 bends at the start of the cleaning operation, but the shaft sealing member 1048 doesn't bend at the non-load sucking operation. That is, even if the non-load sucking operation is carried out after the inks are secured in the priming room PR as "priming" after the cleaning operation, the shaft sealing member 1048 doesn't bend. Thus, the unnecessary inks remaining in the tube T2 or the like can be discharged into the first ink cartridge 1009 while the "priming" is secured.

The above gear pump GP may be used in not only the printer 1001, but also any other apparatus, for example, a liquid ejecting apparatus that ejects a liquid such as an electrode material or a color material used for manufacturing a liquid crystal display, an EL display or a surface-emission display; a liquid ejecting apparatus that ejects an organic material used for manufacturing biochips; or a sample ejecting apparatus as a precise pipette.

In addition, in the above embodiment, the priming room PR is formed in the gear pump GP. However, instead of the gear pump, the priming room PR may be formed in another built-in slide-rotator type of positive displacement pumps (see FIGS. 16 to 18) or a reciprocating-mechanism type of positive displacement pumps (see FIGS. 20 to 22).

What is claimed is:

1. A liquid ejecting apparatus comprising:

a head member having a nozzle and a liquid-ejecting unit that ejects liquid in the nozzle, a main controlling part that drives the liquid-ejecting unit based on ejecting data, a capping member relatively movable between a position away from the head member and a position in contact with the head member, a suction way communicated with an inside of the capping member, a built-in slide-rotator type of positive displacement pump provided in the suction way, a state-quantity recognizing part that recognizes a state quantity related to a dry state in an inside of the built-in slide-rotator type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

2. A liquid ejecting apparatus according to claim 1, wherein:

the preliminary-operation carrying-out part is adapted to cause the liquid-ejecting unit to eject liquid from the nozzle into the capping member, and thereafter drive the built-in slide-rotator type of positive displacement pump for a predetermined preliminary-operation time.

3. A liquid ejecting apparatus according to claim 1, wherein:

the built-in slide-rotator type of positive displacement pump has a pump frame connected to the suction way, a wetting-agent supplying way for supplying a wetting agent is connected to the pump frame, and the preliminary-operation carrying-out part is adapted to supply the wetting agent into the pump frame via the wetting-agent supplying way.

4. A liquid ejecting apparatus according to claim 3, wherein:

a priming pump is provided in the wetting-agent supplying way, and the preliminary-operation carrying-out part is adapted to supply the wetting agent into the pump frame by causing the priming pump to operate.

5. A liquid ejecting apparatus according to claim 4, wherein:

the head member is integrated with a pushing member, the pushing member is movable in a direction in such a manner that the pushing member can push the priming pump to cause the priming pump to operate, and the preliminary-operation carrying-out part is adapted to supply the wetting agent into the pump frame by causing the priming pump to operate via the pushing member by moving the head member.

6. A liquid ejecting apparatus according to claim 1, wherein:

the state quantity related to a dry state in an inside of the built-in slide-rotator type of positive displacement pump is a non-operating time of the positive displacement pump, the state-quantity recognizing part is a non-operating-time recognizing part that recognizes the non-operating time, the standard state quantity being a standard for carrying out a preliminary operation is a standard time being a standard for carrying out a preliminary operation, the standard-state-quantity setting part is a standard-time setting part in which the standard time is set, and the judging part is adapted to judge that the inside of the positive displacement pump is dry, when the non-operating time recognized by the non-operating-time recognizing part is equal to or longer than the standard time set in the standard-time setting part.

7. A liquid ejecting apparatus according to claim 1, wherein:

the state quantity related to a dry state in an inside of the built-in slide-rotator type of positive displacement pump is a state quantity related to an operating state of the positive displacement pump after the positive displacement pump has been driven for a predetermined time.

8. A liquid ejecting apparatus according to claim 1, wherein:

the built-in slide-rotator type of positive displacement pump is a gear pump.

9. A liquid ejecting apparatus according to claim 1, wherein:

the built-in slide-rotator type of positive displacement pump is a roots pump.

10. A liquid ejecting apparatus according to claim 1, wherein:

the built-in slide-rotator type of positive displacement pump is a quimby screw pump.

11. A liquid ejecting apparatus according to claim 1, wherein:

the built-in slide-rotator type of positive displacement pump is a vane pump.

12. A liquid ejecting apparatus comprising:

a head member having a nozzle and a liquid-ejecting unit that ejects liquid in the nozzle, a main controlling part that drives the liquid-ejecting unit based on ejecting data, a capping member relatively movable between a position away from the head member and a position in contact with the head member, a suction way communicated with an inside of the capping member, a built-in slide-rotator type of positive displacement pump provided in the suction way, a state-quantity recognizing part that recognizes a state quantity related to a dry state in an inside of the built-in slide-rotator type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, a displaying part that displays judge result by the judging pan, an inputting part into which a preliminary-operation instruction is manually inputted, and a preliminary-operation carrying-out part that carries out the preliminary operation for wetting the inside of the positive displacement pump, based on the preliminary-operation instruction inputted into the inputting part.

13. A liquid ejecting apparatus comprising:

a head member having a nozzle and a liquid-ejecting unit that ejects liquid in the nozzle, a main controlling part that drives the liquid-ejecting unit based on ejecting data, a capping member relatively movable between a position away from the head member and a position in contact with the head member, a suction way communicated with an inside of the capping member, a built-in slide-rotator type of positive displacement pump provided in the suction way, a state-quantity recognizing pad that recognizes a state quantity related to a dry state in an inside of the built-in slide-rotator type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a displaying part that displays judge result by the judging part, wherein the built-in slide-rotator type of positive displacement pump has a pump frame connected to the suction way, a wetting-agent supplying way for supplying a wetting agent is connected to the pump frame, a priming pump is provided in the wetting-agent supplying way, and a manual inputting part for causing the priming pump to operate is connected to the priming pump.

14. A liquid ejecting apparatus comprising:

a head member having a nozzle and a liquid-ejecting unit that ejects liquid in the nozzle, a main controlling part that drives the liquid-ejecting unit based on ejecting data, a capping member relatively movable between a position away from the head member and a position in contact with the head member, a suction way communicated with an inside of the capping member, a reciprocating-mechanism type of positive displacement pump provided in the suction way, a state-quantity recognizing part that recognizes a state quantity related to a dry state in an inside of the reciprocating-mechanism type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

15. A liquid ejecting apparatus according to claim 14, wherein:

the preliminary-operation carrying-out part is adapted to cause the liquid-ejecting unit to eject liquid from the nozzle into the capping member, and thereafter drive the reciprocating-mechanism type of positive displacement pump for a predetermined preliminary-operation time.

16. A liquid ejecting apparatus according to claim 14, wherein:

the reciprocating-mechanism type of positive displacement pump has a pump frame connected to the suction way, a wetting-agent supplying way for supplying a wetting agent is connected to the pump frame, and the preliminary-operation carrying-out part is adapted to supply the wetting agent into the pump frame via the wetting-agent supplying way.

17. A liquid ejecting apparatus according to claim 16, wherein:

a priming pump is provided in the wetting-agent supplying way, and the preliminary-operation carrying-out part is adapted to supply the wetting agent into the pump frame by causing the priming pump to operate.

18. A liquid ejecting apparatus according to claim 17, wherein:

the head member is integrated with a pushing member, the pushing member is movable in a direction in such a manner that the pushing member can push the priming pump to cause the priming pump to operate, and the preliminary-operation carrying-out part is adapted to supply the wetting agent into the pump frame by causing the priming pump to operate via the pushing member by moving the head member.

19. A liquid ejecting apparatus according to claim 14, wherein:

the state quantity related to a dry state in an inside of the reciprocating-mechanism type of positive displacement pump is a non-operating time of the positive displacement pump, the state-quantity recognizing part is a non-operating-time recognizing part that recognizes the non-operating time, the standard state quantity being a standard for carrying out a preliminary operation is a standard time being a standard for carrying out a preliminary operation, the standard-state-quantity setting part is a standard-time setting part in which the standard time is set, and the judging part is adapted to judge that the inside of the positive displacement pump is dry, when the non-operating time recognized by the non-operating-time recognizing part is equal to or longer than the standard time set in the standard-time setting part.

20. A liquid ejecting apparatus according to claim 14, wherein:

the state quantity related to a dry state in an inside of the reciprocating-mechanism type of positive displacement pump is a state quantity related to an operating state of the positive displacement pump after the positive displacement pump has been driven for a predetermined time.

21. A liquid ejecting apparatus according to claim 14, wherein:

the reciprocating-mechanism type of positive displacement pump is a piston pump.

22. A liquid ejecting apparatus according to claim 14, wherein:

the reciprocating-mechanism type of positive displacement pump is a bellows pump.

23. A liquid ejecting apparatus according to claim 14, wherein:

the reciprocating-mechanism type of positive displacement pump is a diaphragm pump.

24. A liquid ejecting apparatus comprising:

a head member having a nozzle and a liquid-ejecting unit that ejects liquid in the nozzle, a main controlling part that drives the liquid-ejecting unit based on ejecting data, a capping member relatively movable between a position away from the head member and a position in contact with the head member, a suction way communicated with an inside of the capping member, a reciprocating-mechanism type of positive displacement pump provided in the suction way, a state-quantity recognizing part that recognizes a state quantity related to a dry state in an inside of the reciprocating-mechanism type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, a displaying part that displays judge result by the judging part, an inputting part into which a preliminary-operation instruction is manually inputted, and a preliminary-operation carrying-out part that carries out the preliminary operation for wetting the inside of the positive displacement pump, based on the preliminary-operation instruction inputted into the inputting part.

25. A liquid ejecting apparatus comprising:

a head member having a nozzle and a liquid-ejecting unit that ejects liquid in the nozzle, a main controlling part that drives the liquid-ejecting unit based on ejecting data, a capping member relatively movable between a position away from the head member and a position in contact with the head member, a suction way communicated with an inside of the capping member, a reciprocating-mechanism type of positive displacement pump provided in the suction way, a state-quantity recognizing part that recognizes a state quantity related to a dry state in an inside of the reciprocating-mechanism type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a displaying part that displays judge result by the judging part, wherein the reciprocating-mechanism type of positive displacement pump has a pump frame connected to the suction way, a wetting-agent supplying way for supplying a wetting agent is connected to the pump frame, a priming pump is provided in the wetting-agent supplying way, and a manual inputting part for causing the priming pump to operate is connected to the priming pump.

26. A controlling unit for controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a built-in slide-rotator type of positive displacement pump provided in the suction way; the controlling unit comprising a state-quantity recognizing part that recognizes a state quantity related to a dry state in an inside of the built-in slide-rotator type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

27. A controlling unit according to claim 26, wherein:

the preliminary-operation carrying-out part is adapted to cause the liquid-ejecting unit to eject liquid from the nozzle into the capping member, and thereafter drive the built-in slide-rotator type of positive displacement pump for a predetermined preliminary-operation time.

28. A controlling unit according to claim 26, wherein:

the built-in slide-rotator type of positive displacement pump has a pump frame connected to the suction way, a wetting-agent supplying way for supplying a wetting agent is connected to the pump frame, and the preliminary-operation carrying-out part is adapted to supply the wetting agent into the pump frame via the wetting-agent supplying way.

29. A controlling unit according to claim 28, wherein:

a priming pump is provided in the wetting-agent supplying way, and the preliminary-operation carrying-out pad is adapted to supply the wetting agent into the pump frame by causing the priming pump to operate.

30. A controlling unit according to claim 29, wherein:

the head member is integrated with a pushing member, the pushing member is movable in a direction in such a manner that the pushing member can push the priming pump to cause the priming pump to operate, and the preliminary-operation carrying-out pad is adapted to supply the wetting agent into the pump frame by causing the priming pump to operate via the pushing member by moving the head member.

31. A controlling unit according to claim 26, wherein:

the state quantity related to a dry state in an inside of the built-in slide-rotator type of positive displacement pump is a non-operating time of the positive displacement pump, the state-quantity recognizing pad is a non-operating-time recognizing pad that recognizes the non-operating time, the standard state quantity being a standard for carrying out a preliminary operation is a standard time being a standard for carrying out a preliminary operation, the standard-state-quantity setting part is a standard-time setting pad in which the standard time is set, and the judging part is adapted to judge that the inside of the positive displacement pump is dry, when the non-operating time recognized by the non-operating-time recognizing part is equal to or longer than the standard time set in the standard-time setting part.

32. A controlling unit according to claim 26, wherein:

the state quantity related to a dry state in an inside of the built-in slide-rotator type of positive displacement pump is a state quantity related to an operating state of the positive displacement pump after the positive displacement pump has been driven for a predetermined time.

33. A controlling unit for controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a reciprocating-mechanism type of positive displacement pump provided in the suction way; the controlling unit comprising a state-quantity recognizing part that recognizes a state quantity related to a dry state in an inside of the reciprocating-mechanism type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

34. A controlling unit according to claim 33, wherein:

the preliminary-operation carrying-out part is adapted to cause the liquid-ejecting unit to eject liquid from the nozzle into the capping member, and thereafter drive the reciprocating-mechanism type of positive displacement pump for a predetermined preliminary-operation time.

35. A controlling unit according to claim 33, wherein:

the reciprocating-mechanism type of positive displacement pump has a pump frame connected to the suction way, a wetting-agent supplying way for supplying a wetting agent is connected to the pump frame, and the preliminary-operation carrying-out part is adapted to supply the wetting agent into the pump frame via the wetting-agent supplying way.

36. A controlling unit according to claim 35, wherein:

a priming pump is provided in the wetting-agent supplying way, and the preliminary-operation carrying-out part is adapted to supply the wetting agent into the pump frame by causing the priming pump to operate.

37. A controlling unit according to claim 36, wherein:

the head member is integrated with a pushing member, the pushing member is movable in a direction in such a manner that the pushing member can push the priming pump to cause the priming pump to operate, and the preliminary-operation carrying-out part is adapted to supply the wetting agent into the pump frame by causing the priming pump to operate via the pushing member by moving the head member.

38. A controlling unit according to claim 33, wherein:

the state quantity related to a dry state in an inside of the reciprocating-mechanism type of positive displacement pump is a non-operating time of the positive displacement pump, the state-quantity recognizing part is a non-operating-time recognizing part that recognizes the non-operating time, the standard state quantity being a standard for carrying out a preliminary operation is a standard time being a standard for carrying out a preliminary operation, the standard-state-quantity setting part is a standard-time setting part in which the standard time is set, and the judging part is adapted to judge that the inside of the positive displacement pump is dry, when the non-operating time recognized by the non-operating-time recognizing part is equal to or longer than the standard time set in the standard-time setting part.

39. A controlling unit according to claim 33, wherein:

the state quantity related to a dry state in an inside of the reciprocating-mechanism type of positive displacement pump is a state quantity related to an operating state of the positive displacement pump after the positive displacement pump has been driven for a predetermined time.

40. A program being executed by a computer system including at least a computer to materialize a controlling unit for controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a built-in slide-rotator type of positive displacement pump provided in the suction way; the controlling unit comprising a state-quantity recognizing part that recognizes a state quantity related to a dry state in an inside of the built-in slide-rotator type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

41. A program being executed by a computer system including at least a computer to materialize a controlling unit for controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a reciprocating-mechanism type of positive displacement pump provided in the suction way; the controlling unit comprising a state-quantity recognizing part that recognizes a state quantity related to a dry state in an inside of the reciprocating-mechanism type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

42. A program including a command for controlling a second program executed by a computer system including at least a computer, the program being executed by the computer system to control the second program to materialize a controlling unit for controlling a liquid ejecting apparatus including: a head member having a nozzle and a liquid-ejecting unit that ejects liquid in the nozzle; a main controlling pad that drives the liquid-ejecting unit based on ejecting data; a capping member relatively movable between a position away from the head member and a position in contact with the head member; a suction way communicated with an inside of the capping member; and a built-in slide-rotator type of positive displacement pump provided in the suction way; the controlling unit comprising a state-quantity recognizing pad that recognizes a state quantity related to a dry state in an inside of the built-in slide-rotator type of positive displacement pump, a standard-state-quantity setting part in which a standard state quantity is set, the standard state quantity being a standard for carrying out a preliminary operation for wetting the inside of a judging pad that judges whether the inside of the positive displacement pump is dry or not, by comparing the state quantity recognized by the state-quantity recognizing pad with the standard state quantity set in the standard-state-quantity setting pad, and a preliminary-operation carrying-out pad that carries out the preliminary operation for wetting the inside of the positive displacement pump, when it is judged by the judging pad that the inside of the positive displacement pump is dry.

43. A program including a command for controlling a second program executed by a computer system including at least a computer, the program being executed by the computer system to control the second program to materialize a controlling unit for controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a reciprocating-mechanism type of positive displacement pump provided in the suction way; the controlling unit comprising a state-quantity recognizing part that recognizes a state quantity related to a dry state in an inside of the reciprocating-mechanism type of positive displacement pump, a standard-state-quantity setting part in which a standard state quantity is set, the standard state quantity being a standard for carrying out a preliminary operation for wetting the inside of the positive displacement pump, a judging part that judges whether the inside of the positive displacement pump is dry or not, by comparing the state quantity recognized by the state-quantity recognizing part with the standard state quantity set in the standard-state-quantity setting part, and a preliminary-operation carrying-out part that carries out the preliminary operation for wetting the inside of the positive displacement pump, when it is judged by the judging part that the inside of the positive displacement pump is dry.

44. A method of controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a built-in slide-rotator type of positive displacement pump provided in the suction way; the method comprising a step of recognizing a state quantity related to a dry state in an inside of the built-in slide-rotator type of positive displacement pump, a step of judging whether the inside of the positive displacement pump is dry or not, by comparing the state quantity related to a dry state in an inside of the built-in slide-rotator type of positive displacement pump with a standard state quantity that has been set in advance, and a step of carrying out a preliminary operation for wetting the inside of the positive displacement pump, when it is judged that the inside of the positive displacement pump is dry.

45. A method of controlling a liquid ejecting apparatus including: a head member having a nozzle and a liquid-ejecting unit that ejects liquid in the nozzle; a main controlling part that drives the liquid-ejecting unit based on ejecting data; a capping member relatively movable between a position away from the head member and a position in contact with the head member; a suction way communicated with an inside of the capping member; and a reciprocating-mechanism type of positive displacement pump provided in the suction way; the a step of recognizing a state quantity related to a dry state in an inside of the reciprocating-mechanism type of positive displacement pump, a step of judging whether the inside of the positive displacement pump is dry or not, by comparing the state quantity related to a dry state in an inside of the reciprocating-mechanism type of positive displacement pump with a standard state quantity that has been set in advance, and a step of carrying out a preliminary operation for wetting the inside of the positive displacement pump, when it is judged that the inside of the positive displacement pump is dry.

46. A liquid ejecting apparatus comprising:

a head member having a nozzle and a liquid-ejecting unit that ejects liquid in the nozzle, a main controlling part that drives the liquid-ejecting unit based on ejecting data, a capping member relatively movable between a position away from the head member and a position in contact with the head member, a suction way communicated with an inside of the capping member, a built-in slide-rotator type of positive displacement pump provided in the suction way, and a preliminary-operation carrying-out mechanism that automatically carries out a preliminary operation for wetting an inside of the positive displacement pump, in connection with a driving start of the positive displacement pump, when the capping member is located at the position in contact with the head member, wherein the built-in slide-rotator type of positive displacement pump has a pump frame connected to the suction way, a wetting-agent storing part for storing a wetting agent temporarily is formed in the pump frame, and the preliminary-operation carrying-out mechanism is adapted to supply the wetting agent stored in the wetting-agent storing part into the pump frame, in connection with a driving start of the positive displacement pump, when the capping member is located at the position in contact with the head member.

47. A liquid ejecting apparatus according to claim 46, wherein a portion of a defining wall forming the wetting-agent storing part is elastically deformable, and the preliminary-operation carrying-out mechanism is adapted to supply the wetting agent stored in the wetting-agent storing part into the pump frame by elastic deformation of the portion of a defining wall.

48. A liquid ejecting apparatus according to claim 47, wherein the wetting-agent storing part is communicated with the suction way, the wetting agent is the same as the liquid ejected from the nozzle, and the portion of a defining wall is adapted to be elastically deformed by a negative pressure in the wetting-agent storing part, which is generated in connection with a driving start of the positive displacement pump when the capping member is located at the position in contact with the head member.

49. A liquid ejecting apparatus according to claim 48, wherein elasticity of the portion of a defining wall is adjusted in such a manner that the portion is elastically deformed by a negative pressure in the wetting-agent storing part, which is generated in connection with a driving start of the positive displacement pump when the capping member is located at the position in contact with the head member, and that the portion is not deformed by another negative pressure in the wetting-agent storing part, which is generated in connection with a driving start of the positive displacement pump when the capping member is located at the position away from the head member.

* * * * *